US006293038B1

(12) United States Patent
Chang

(10) Patent No.: US 6,293,038 B1
(45) Date of Patent: Sep. 25, 2001

(54) FRAME

(76) Inventor: Cherng Chang, P.O. Box 693, Miamisburg, OH (US) 45343

( * ) Notice: Subject to any disclaimer, the term of this patent is extended or adjusted under 35 U.S.C. 154(b) by 0 days.

(21) Appl. No.: 09/360,386

(22) Filed: Jul. 23, 1999

Related U.S. Application Data

(63) Continuation-in-part of application No. 08/962,095, filed on Oct. 31, 1997, which is a continuation-in-part of application No. 08/929,193, filed on Sep. 8, 1997, now abandoned, which is a continuation of application No. 08/270,008, filed on Jul. 1, 1994, now abandoned.

(60) Provisional application No. 60/094,126, filed on Jul. 24, 1998.

(51) Int. Cl.[7] ..... A47G 1/06

(52) U.S. Cl. ..... 40/738; 40/743; 40/711

(58) Field of Search ..... 40/738, 743, 768, 40/771, 800, 711; 428/13, 14

(56) References Cited

U.S. PATENT DOCUMENTS 3,041,762 * 7/1962 Knox ..... 40/738
3,333,358 * 8/1967 Green et al. ..... 40/738
3,596,391 * 8/1971 Knight, Jr. ..... 40/720
3,949,506 * 4/1976 Benkowski ..... 40/735 X
5,265,357 * 11/1993 Yu ..... 40/738 X
5,461,810 * 10/1995 Goserud ..... 40/771 X
5,617,663 * 4/1997 Miki et al. ..... 40/738
5,619,816 * 4/1997 Ellison ..... 40/738
5,666,712 * 9/1997 Cvetkov ..... 40/711 X

* cited by examiner

*Primary Examiner*—Brian K. Green

(57) ABSTRACT

A frame system for holding a normally flat picture and bending it into a concavo-convex shape for adding a three dimensional effect and/or eye movement effect to its display. This concavo-convex shape can be created by either urging the picture toward a pre-curved transparent plate or placing the picture in a pre-curved holder. In this frame system an arch-shaped void space is provided for housing a complementary three dimensional article and/or reinforced picture supported by magnetic means. A top edge glass and bottom edge glass are placed in the present frame system perpendicular to the pre-curved transparent plate. A top edge picture sheet and bottom edge picture sheet can be displayed through said top edge glass and bottom edge glass, respectively, for complementing the main picture on display, and for creating a 3D feeling toward the main picture in the mind of the viewer. Pre-curved backing plate with adhesive and pre-curved mat sheet provide 3D space needed for the display of fabric art, relief arts or any 3D object in the present frame system.

12 Claims, 25 Drawing Sheets

FIG 16
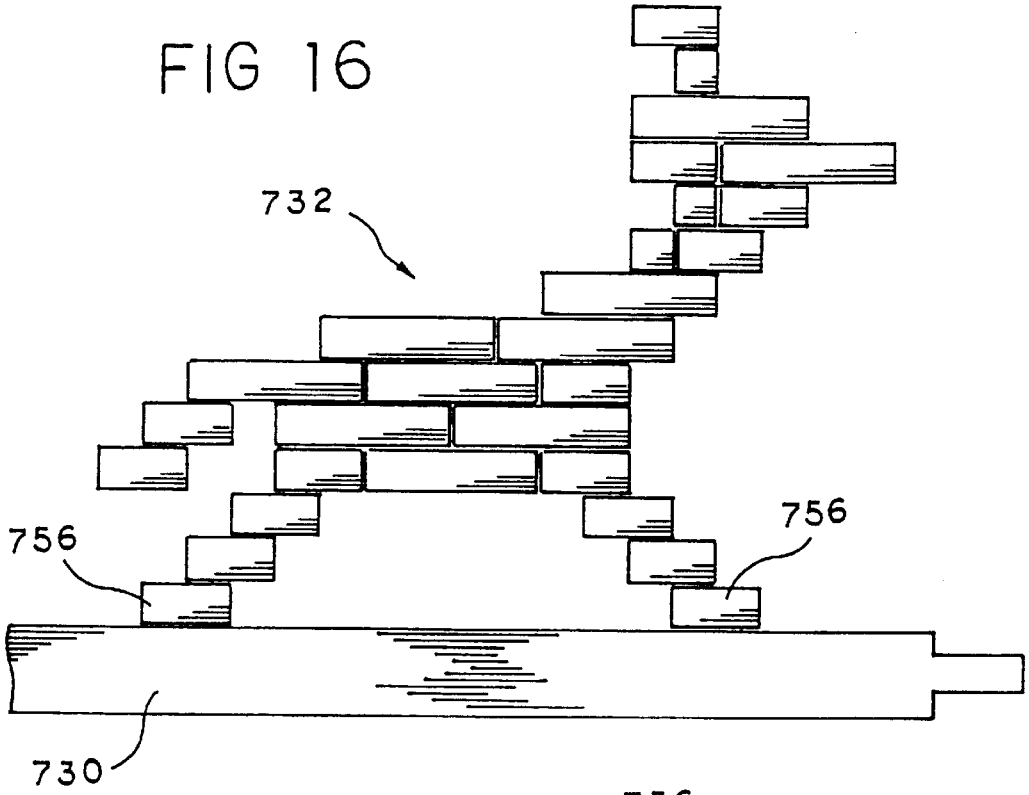
FIG 17
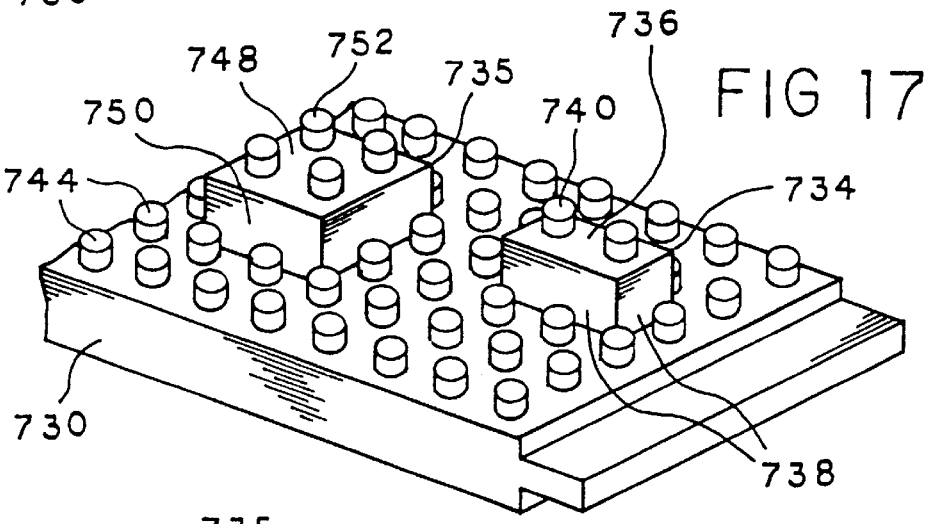
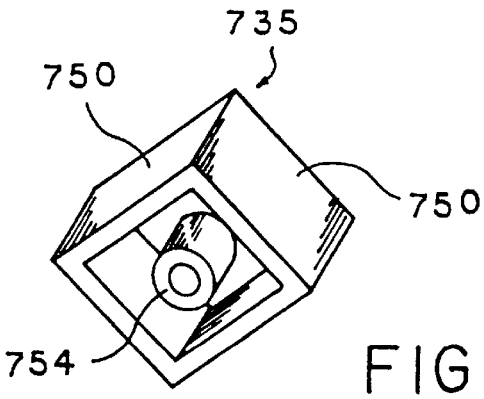
FIG 19
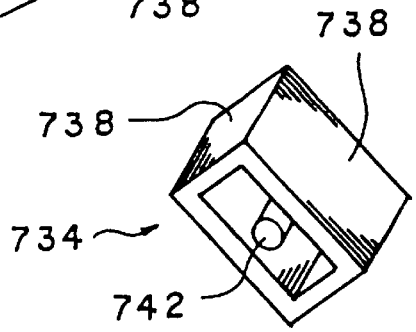
FIG 18

FIG 20
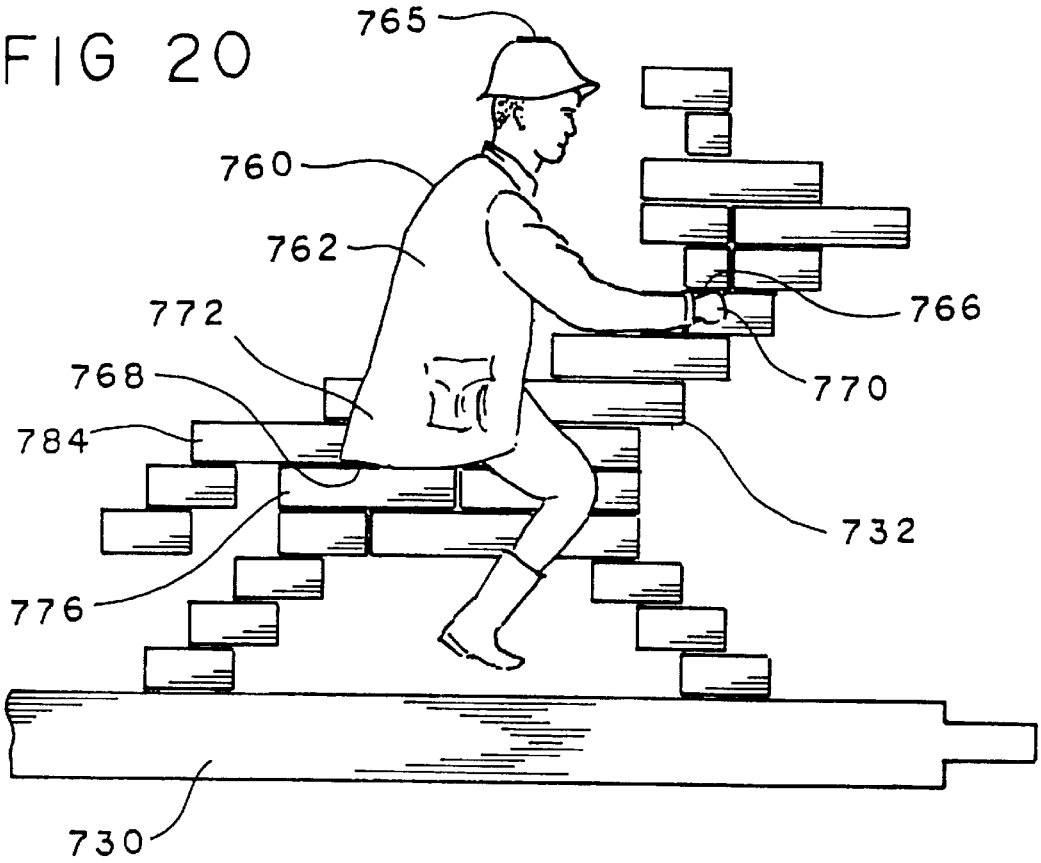
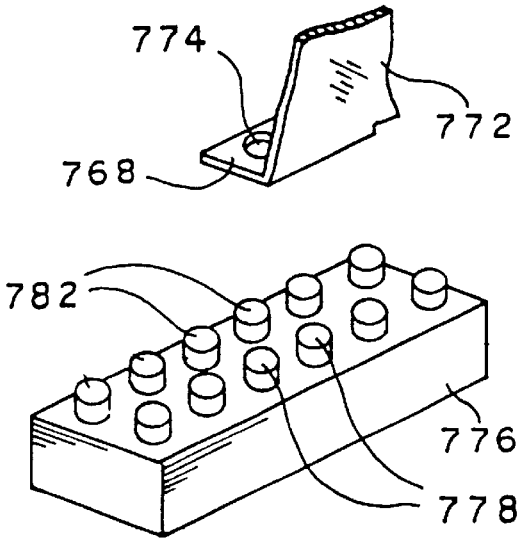
FIG 21
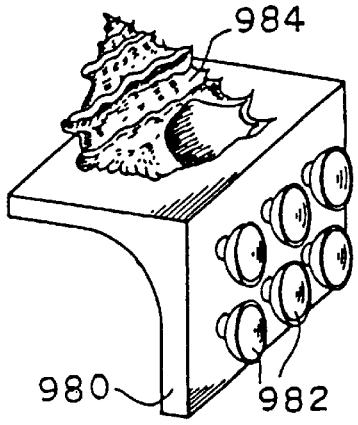
FIG 29

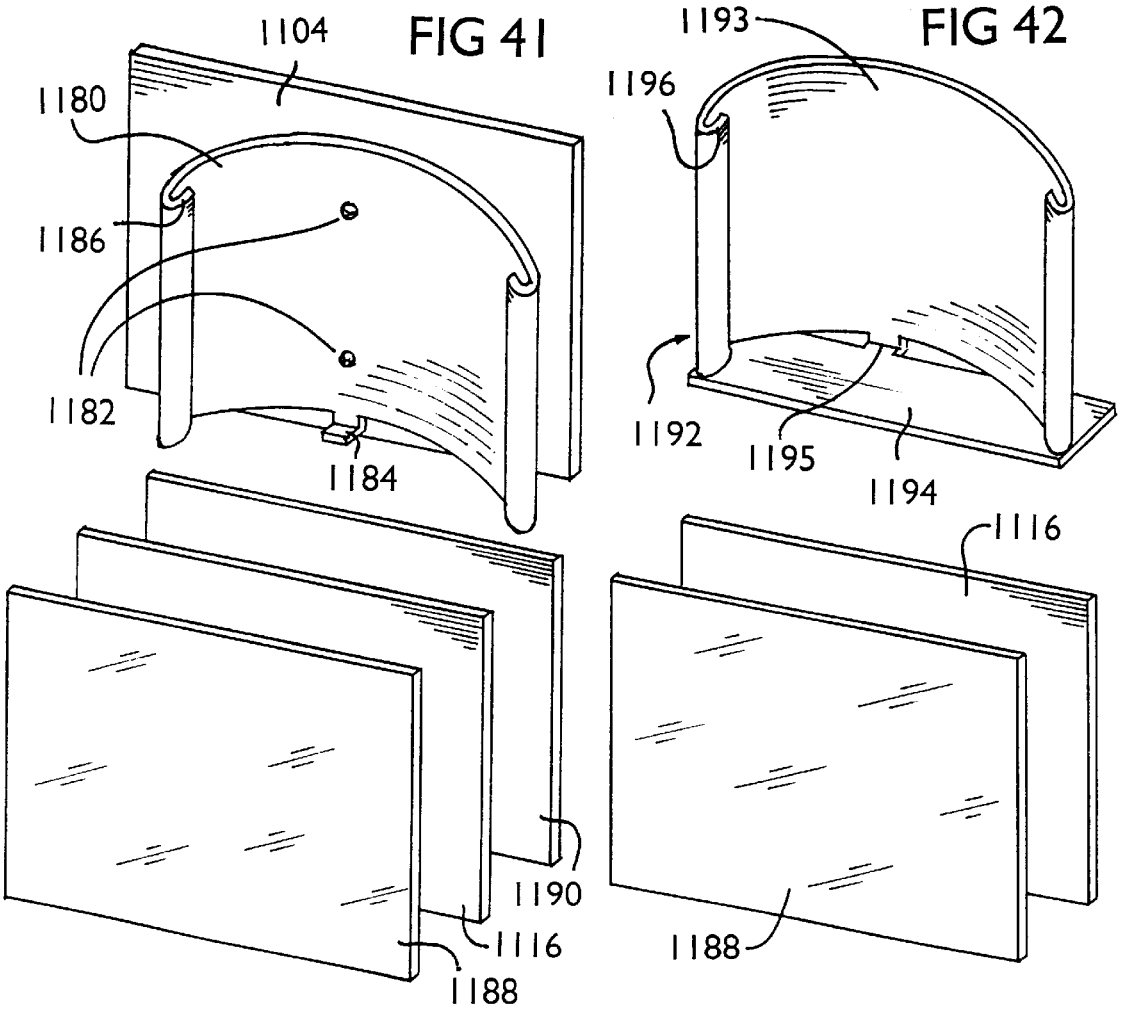
*Why the eyes on the curved sheet "follow" you as you move?*
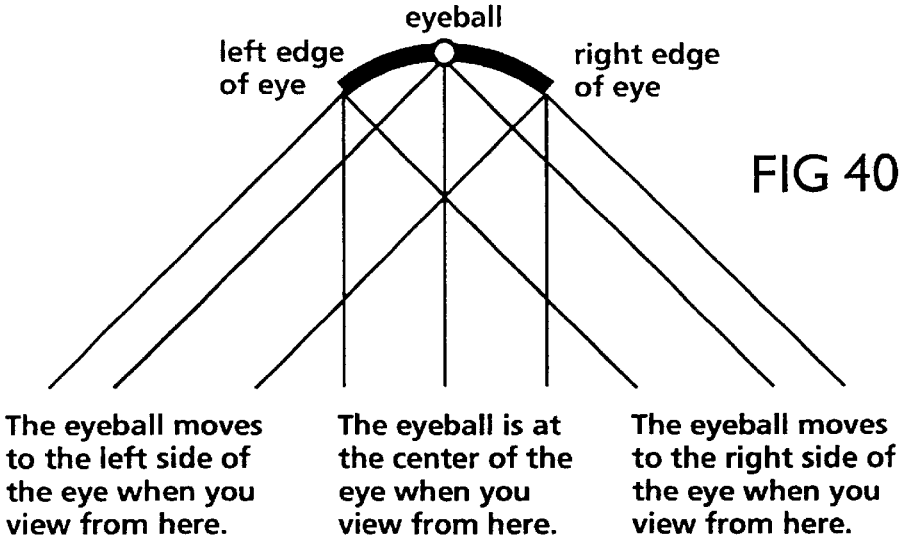

1340
1350
1348
1352
1354
1348
1346
1342
1344

1360
1362
1364
1366
1242
1244
1241
1246

FRAME

This is a continuation-in-part of application Ser. No. 08/962,095, filed Oct. 31, 1997 now pending, which is a continuation-in-part of application Ser. No. 08/929,193, filed Sep. 8, 1997 now abandoned which is a continuation of application Ser. No. 08/270,008, filed Jul. 1, 1994 now abandoned. Claim priority: Provisional Application Ser. 60/094,126, filed Jul. 24, 1998.

BACKGROUND OF THE INVENTION

This invention relates in general to vertically positionable calendars. Such calendars can either be vertically mountable on a wall or nearly vertically positionable on a table. This invention also relates to frames in general, and more specifically relates to frames for mounting calendars.

Most conventional calendars consist of a stack of calendar sheets in either loose or book forms. Each of these calendar sheets typically contains a calendar date table illustration and a calendar picture illustration. It is often desirable to display the calendar picture illustration in a suitable frame to enhance its aesthetic value. However, framing of a vertically positionable calendar is not generally done because there is no desirable way to frame the calendar picture illustration while exposing the calendar date table illustration for memorandum writing and date checking.

For a typical calendar, the calendar picture to be displayed are limited by the pictures selected by the calendar manufacturer. It is sometimes desirable that the displayed calendar picture be temporarily replaced by a custom picture. There is no calendar system in the prior art that can alternately display a calendar picture and a custom picture in a desirable manner.

U.S. Pat. Nos. 2,038,666 and 2,179,857 describe a calendar pad attached to a conventional picture frame. In this prior art the calendar pad does not have calendar pictures displayable in the picture frame. The picture frame serves as nothing more than a holder for the calendar pad.

For a large wall-mounted calendar the frame assembly to be chosen for the display of the calendar is unavoidably large and heavy. It is desirable for such frame calendars that the change of the calendar display can be achieved without taking down the frame from the mounting wall. No frame assembly known in the prior art can be adapted for such use without the need of taking down the frame during the calendar display changes.

It is desirable that the appearance of a calendar frame or picture frame be changeable to complement the picture on display. No frame system in the prior art is capable of changing the appearance of its frame in easy and desirable manner.

Display cases are generally known in the prior art for the display of collectable articles such as coins, sea shells, etc. It is often desirable that a background picture or narrative sheet be displayed along with the articles on display. This is difficult for most display cases since they are generally incapable of removably mounting a picture sheet. On the other hand, no picture frame known in the prior art is equipped with desirable support structure for the simultaneous display of the collectable articles and background pictures.

Most conventional picture frames basically allow a picture to be displayed as it is. It would be desirable to provide a picture frame that could add some 3D effect to a mounted picture. This 3D effect is absent if the picture is viewed by itself without the frame.

It would also be desirable to provide a picture frame which, in addition to displaying a main picture, could also display one or more complementary pictures that would create a 3D feeling toward the main picture in the mind of a viewer. Such 3D feeling is absent if the main picture is viewed by itself without the frame, with or without said complementary pictures placed on the side of the main picture.

SUMMARY OF THE INVENTION

In the present invention a frame calendar is disclosed in which the frame is an integral part of the calendar. The calendar also includes a stack of calendar sheets with each one having a calendar picture illustration and a calendar date table illustration. All calendar sheets are mounted on the frame with one calendar picture illustration in view through the window of the frame and one calendar date table illustration exposed outside the frame.

Therefore, the first object of the present invention is to provide a frame calendar which elegantly displays each calendar picture in a frame. It greatly enhances the aesthetic value of the calendar picture on display. In the mean time the calendar date table on display is exposed outside of the frame to facilitate memorandum writing and calendar date checking without disassembling the frame.

In the present frame calendar system a custom picture can be placed in the frame and be displayed in lieu of the calendar picture. One is no longer limited by the pictures selected by the calendar manufacturer. The picture chosen for display can also be changed as frequently as desired. After the end of the calendar year with the removal of the calendar sheets the present system is readily converted to a picture frame/storage device and used indefinitely for storing and displaying custom pictures. The calendar pictures can also be separated from the calendar date tables and stored in the frame for future display if desired.

In the present invention an one-piece molded back member with resilient arms is disclosed. It greatly eases the effort in loading and unloading the calendar sheets and custom pictures. Two insertion tabs and a spring clip on the back member allow each loading or unloading to be achieved in two simple steps. After each loading the resilient arms of the back member are in engagement with the corners of the stack of the calendar sheets/custom pictures. It allows the calendar sheets/custom pictures to be properly stored and displayed regardless of the number of sheets mounted up to the capacity of the frame.

The frame of the present invention can have a frame border which is molded to form some carved art pattern with many openings. A stack of border sheets with different contrasting colors can be loaded behind the frame border. The first border sheet of the stack will be partially visible through the openings. This allows the appearance of the frame to be easily changed. The top border sheet on display can therefore be chosen to complement the calendar picture or custom picture on display.

Alternatively, the frame border of the present invention can also have a border window. A stack of border sheets with different printed graphic patterns can therefore be loaded with the top sheet displayed through the border window. More variation of the appearance of the frame can be achieved in this design. A border mat with an intricate laser-cut pattern coupled with one or more matching border sheets as disclosed in the present invention would make the appearance of the frame and its variation even more interesting.

In addition to a stationary window glass a second window glass is also provided in the frame of the present invention. Unsymmetrical tabs on the sides of this second window glass are engageable with many grooves having different depths on the inner side wall of the frame. This allows the second window glass to be stopped at four different depths while mounted, depending on the orientation of the entry of the second window glass. Consequently, a void space with adjustable depth is created between the stationary window glass and the second window glass.

The newly created space will allow dried flowers, reinforced laser-cut pictures, etc., to be installed and displayed. In the mean time, a complementary calendar sheet or custom picture is also mounted behind the second window glass and displayed. This creates a vivid and interesting three dimensional display. The changing of the calendar sheet/custom picture for display can be achieved without affecting the articles mounted in the front of the second window glass.

Small collectable articles such as coins, sea shells, etc., can also be mounted in the space between the stationary window glass and the second window glass. This is achieved with support members of the present invention. Support building blocks, support building plates and other support members can be assembled into support assemblies with different shapes and complexities for the support and display of small collectable articles. One other novel support member with a magnetic plate is also disclosed. This support member is designed to be individually mounted in the frame assembly for supporting an article on display. This support member is magnetically held in place and will not easily slide down under load.

A frame assembly of the present invention can also be equipped with a support base for the support of assembled toy building blocks. This allows the display of the assembled toy building blocks to be accompanied by a complementary custom picture or calendar picture. Paper toy figures with novel attachment members of the present invention can also be added to make the overall display much more interesting.

A large wall-mounted frame calendar is unavoidably bulky and heavy. Several embodiments of the frame calendar of the present invention enable such large calendar/custom pictures to be loaded and unloaded without taking down the frame assembly from the wall. The frame body of the frame assembly swings open horizontally. It requires no lifting or holding of the heavy frame body during the loading or unloading operation.

Also disclosed in the present invention is a frame system for holding a normally flat picture and bending it into an one dimensional concavo-convex shape for adding a three dimensional effect and/or eye movement effect to its display. This one dimensional concavo-convex shape can be created by either urging the picture toward a pre-curved transparent plate or placing the picture in a pre-curved holder. In this frame system an arch-shaped void space is provided for housing a complementary three dimensional article and/or reinforced picture supported by magnetic means. A top edge glass and bottom edge glass are placed in the present frame system perpendicular to the pre-curved transparent plate. A top edge picture sheet and bottom edge picture sheet can be displayed through said top edge glass and bottom edge glass, respectively, for complementing the main picture on display, and for creating a 3D feeling toward the main picture in the mind of the viewer. Pre-curved backing plate with adhesive and pre-curved mat sheet provide 3D space needed for the display of fabric art, relief arts or any 3D object in the present frame system.

Other objects and advantages of this invention reside in the construction of parts and the combination thereof, the mode of operation and use, as will become more apparent from the following description.

BRIEF DESCRIPTION OF THE DRAWINGS

FIG. 16 is an elevational view illustrating another embodiment of the support base of the present invention, for the support and display of an assembled toy horse.

FIG. 17 is a perspective view showing a portion of the support base of FIG. 16, with two mounted toy building blocks.

FIGS. 18 and 19 are perspective views showing the two toy building blocks of FIG. 17.

FIG. 20 is an elevational view showing a paper toy figure supported on the toy horse of FIG. 16.

FIG. 21 is a perspective view showing a portion of an attachment member of the paper toy figure of FIG. 20, to be engaged with a toy building block of the toy horse of FIG. 20.

FIG. 29 is a perspective view showing a support member with six suction cups for the support of small articles to be displayed in the frame assembly of the present invention.

FIG. 40 is a schematic drawing explaining an eye movement effect of the present frame system.

FIG. 41 is a perspective view showing a novel holder of the present invention.

FIG. 42 is a perspective view showing another novel holder of the present invention.

REFERENCE NUMERALS IN DRAWINGS

FIG. 1

Figure 1:
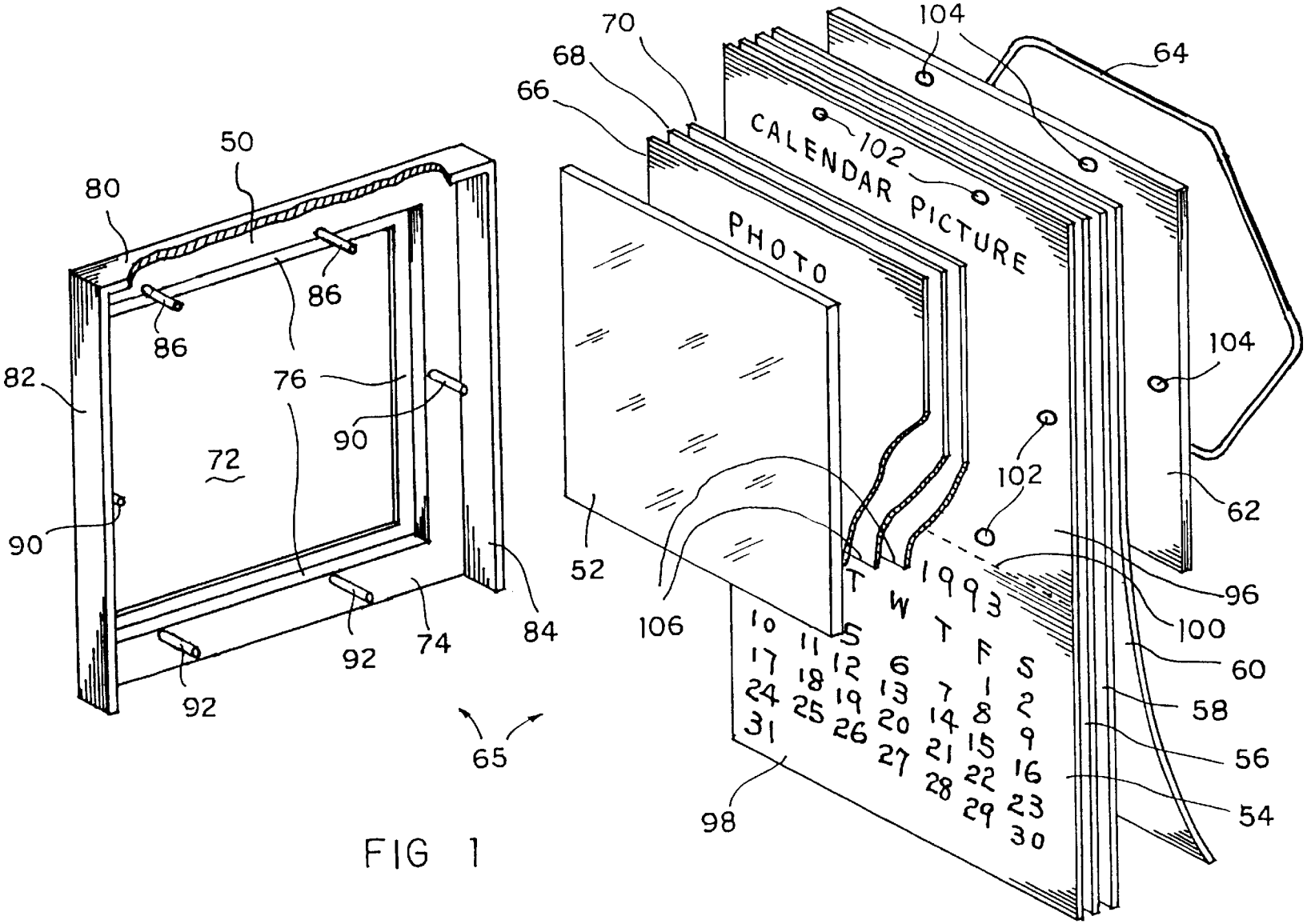
FIG. 1 is a perspective view showing a frame calendar system of the present invention, with parts broken away. The frame calendar is shown disassembled to reveal the details of each component.

| | | | |
|---|---|---|---|
| 50 | frame body | 52 | glass |
| 54 | calendar sheet | 56 | calendar sheet |
| 58 | calendar sheet | 60 | calendar sheet |
| 62 | back member | 64 | elastic band |
| 65 | frame assembly | 66 | custom picture sheet |
| 68 | custom picture sheet | 70 | custom picture sheet |
| 72 | frame window | 74 | back surface |
| 76 | rabbet | 80 | top wall |
| 82 | side wall | 84 | side wall |
| 86 | top studs | 90 | side studs |
| 92 | bottom studs | 96 | calendar picture illustration |
| 98 | calendar date table illustration | 100 | perforation line |
| 102 | holes | 104 | holes |
| 106 | bottom edge | | |

FIGS. 2–3

| | | | |
|---|---|---|---|
| 120 | calendar sheet | 122 | calendar sheet |
| 124 | calendar sheet | 126 | frame assembly |
| 128 | back casing | 130 | frame body |
| 132 | mounting holes | 134 | hinges |
| 136 | latch | 138 | catch |
| 139 | frame window | 140 | glass |
| 142 | side studs | 144 | bottom studs |
| 146 | custom picture sheet | 148 | custom picture sheet |
| 150 | back member | 152 | holes |
| 154 | wire guard | 156 | catch |
| 157 | dash line | 158 | spring plate |
| 160 | horizontal arms | 162 | vertical arms |
| 164 | groove | 166 | breakaway section |
| 168 | second window | 170 | tray |
| 172 | thumb notch | 174 | notch |
| 176 | light adhesive | | |

FIGS. 4–5

| | | | |
|---|---|---|---|
| 200 | frame assembly | 202 | back casing |
| 204 | framebody | 206 | frame window |
| 208 | mounting hole | 210 | hinges |
| 212 | latch | 214 | catch |
| 216 | back member | 218 | calendar sheet |
| 220 | custom picture sheet | 222 | custom picture sheet |
| 224 | glass | 226 | spring wire |
| 227 | wire legs | 228 | fasteners |
| 230 | fasteners | 232 | top stud |
| 234 | side studs | 236 | bottom studs |
| 238 | top slot | 240 | side slots |

-continued

REFERENCE NUMERALS IN DRAWINGS 242 bottom slots
244 rail guard
246 horizontal section
248 side section
250 end elbow
252 leg
254 dash line
256 stops
258 dash line
260 breakaway section
262 indentation line

FIG. 6

302 frame assembly
304 frame body
306 back casing
307 frame window
308 glass
310 top wall
312 side walls
314 hinges
316 spring leaf
318 steps
320 custom picture sheet
321 bottom edge
322 breakaway section
324 second window
326 bottom plate
327 notch
328 calendar sheet
329 bottom edge
330 clamp
332 bars
334 clearance opening
336 mounting hole
338 calendar sheet
340 calendar book
342 back board
344 tabs

FIGS. 7–8

401 frame assembly
402 frame body
404 border sheet
406 border sheet
408 first window glass
410 second window glass
411 back member
412 custom picture sheet
414 calendar
417 frame window
418 outer wall
419 top wall
420 side walls
422 bottom walls
423 inner partitioning wall
424 inner top wall
426 inner side wall
427 inner side wall
428 inner bottom wall
430 slot hole on bottom wall
432 slot hole on top wall
434 counter recess
440 calendar page
442 calendar page
443 upper stack
444 lower stack
445 binding loops
446 holes
448 lips
449 steps
450 outer portion
452 center portion
454 top wall
456 side walls
457 mounting hole
458 arms
459 end portion
461 tabs
462 spring clip
464 tooth
466 bent end
468 opening gap
469 opening gap
470 tab
471 tab
472 tab
473 tab on second window glass 410
475 counter step
477 groove
478 groove
479 groove
480 groove
481 groove
482 groove
483 groove
484 groove
485 groove
486 groove
487 groove
488 groove
489 groove
490 groove
491 groove
492 groove
494 frame border
495 openings (miniature border windows)

FIGS. 9–12

502 frame body
504 outer wall
506 inner partitioning wall
508 frame border
510 frame window
512 top border window
514 side border windows
516 bottom border window
520 frame body
522 outer frame
524 inner frame
526 outer wall
528 outer frame flange
530 studs
532 inner partitioning wall
534 inner frame flange
536 studs
538 frame window
540 border glass
542 holes
550 frame body
552 center display glass
554 border display glass
556 partitioning wall

FIG. 13

600 frame assembly
602 frame body
604 glass
606 border sheet

-continued

REFERENCE NUMERALS IN DRAWINGS 607 border mat
608 back member
610 support base
612 custom picture sheet
614 calendar sheet
616 outer frame
618 inner frame
620 combined window/ border glass
622 holes
624 top outer wall
626 side outer walls
628 stud
630 stud
632 stud
634 stud
636 frame window
638 frame window glass portion
640 border glass portion
642 connection portions
644 tabs
646 mat openings
648 calendar openings
650 perforation line
652 border section
654 calendar picture section
656 perforation lines
660 resilient arm
661 resilient arm
662 resilient arm
663 resilient arm
664 tabs
666 slot openings
668 spring clip
670 tooth
672 bent end
674 slot hole
676 mounting holes
678 sprint leaf
680 easel plate
682 easel arms
684 slots
686 narrow sections
688 horizontal grooves
689 end insert
690 slot
692 holes
694 opening
696 runners
698 opening recess

FIGS. 14–15

700 dried flower
710 frame assembly
712 front window glass
714 back window glass
716 reinforced picture
718 reinforcement board
720 photograph
722 support base
724 slot

FIGS. 16–21

730 support base
731 frame body, not shown
732 toy building block assembly
734 first toy building block
735 second toy building block
736 top wall
738 side walls
740 cylinder studs
742 internal stud
744 cylinder studs
748 top wall
750 side walls
752 cylinder studs
754 internal stud
756 bottom toy building block
760 paper toy figure
762 first half
764 second half
765 crease line
766 attachment member
768 attachment member
770 boy's hand
772 coat
774 holes
776 toy building block
778 cylinder studs
782 cylinder studs
784 block

FIGS. 22–25

800 frame assembly
802 frame body
804 frame border
806 frame window
808 top border window
810 side border window
812 bottom border window
814 corner border windows
816 outer wall, not shown
818 inner partitioning wall, not shown
820 border glass
822 border sheet
824 first window glass
826 second window glass
828 counter step, not shown
830 inner bottom walls, not shown
832 horizontal groove, not shown
834 support base, not shown
836 cylinder studs, not shown
838 support assembly
840 rigid support members
842 support building blocks
844 support building plates
846 miniature table
848 cylinder studs, not shown
850 internal stud, not shown
851 top wall
852 side wall
854 top cylinder studs
856 bottom cylinder stud
858 feed through hole
860 cross slots
862 sea shell
864 sea shell
866 sea shell
868 table legs
870 leg stud
872 sea shell
874 sea horse
876 flexible wire or string -continued

REFERENCE NUMERALS IN DRAWINGS

FIGS. 26–27

900 frame assembly
902 frame body
903 first window glass
904 middle section
906 back casing
908 second window glass
910 back member
912 calendar
914 mounting hole
916 top wall
918 side wall
920 side wall
922 bottom wall
924 bottom wall
926 frame window
928 sixteen grooves
930 tabs
932 horizontal grooves
933 resilient arms
934 support base
935 opening
936 runners
937 opening recess
938 spiral ring
940 lip
942 steps
944 back member walls
946 resilient pad
950 support member
952 molded support piece
954 magnetic plate
956 magnet block
958 marked stop position
960 top calendar sheet
962 bottom calendar sheets

FIG. 28

970 figurine
972 magnetic plate

FIG. 29

980 support member
982 suction cups
984 sea shell

FIGS. 30–34

1010 frame
1012 calendar sheet assembly
1014 frame body
1015 window
1016 back door
1018 spring plate
1020 inner spring leaf
1022 outer spring leaf
1024 calendar sheets
1026 window glass
1028 slot holes
1030 inner frame
1032 L-shaped stud walls
1034 spring clips
1036 calendar picture section
1038 calendar date table section
1040 border section
1042 L-shaped slot holes
1044 border backing plate
1046 picture backing plate
1047 step
1048 opening
1050 bent section
1060 border backing plate
1062 opening
1064 bent section
1066 raised section

FIGS. 35–42

1100 frame system
1102 frame body
1104 backboard
1106 first transparent plate
1108 second transparent plate
1110 backing plate
1112 magnet
1114 magnet
1116 picture
1118 rabbet
1120 frame window
1122 easel
1124 magnetic strip
1126 vinyl tape
1128 magnetic sheet
1130 lamination layer
1132 protective sheet
1140 front body
1142 flat transparent plate
1144 front body window
1150 reinforcement sheet
1152 Mylar sheet
1154 protective sheet
1156 picture
1160 frame system
1162 scenery picture
1164 eagle reinforced picture
1166 animal figurines
1170 frame system
1172 bridal picture
1174 reinforced picture
1180 holder
1182 bolts
1184 stud
1186 channels
1188 transparent sheet
1190 magnetic sheet
1192 holder
1193 vertical portion
1194 horizontal portion
1195 elbow
1196 channels

FIGS. 43–46

1202 pre-curved glass
1204 custom picture
1206 pre-curved backing plate
1208 top edge glass
1210 bottom edge glass
1214 top edge sheet
1216 bottom edge sheet
1222 main picture
1224 3D picture frame
1226 top edge sheet
1228 bottom edge sheet
1230 picture sheet
1231 dancers
1232 floor -continued

REFERENCE NUMERALS IN DRAWINGS 1233 wall
1234 top edge sheet
1235 bottom edge sheet
1236 main picture
1237 picture sheet
1238 top edge sheet
1239 bottom edge sheet
1240 main picture
1241 3-piece mat set
1242 center mat
1244 top edge mat
1246 bottom edge mat

FIGS. 47–49

1250 3D frame system
1252 frame body
1254 flat glass
1256 backing plate, not shown
1258 pre-curved mat plate
1260 center opening
1262 lead glass angel
1264 blue paper sheet
1270 cross stitching fabric art
1272 pre-curved backing plate
1274 double-sided adhesive
1280 mesh screen
1282 pre-curved backing plate
1284 double-sided adhesive

FIG. 50

1290 pre-curved glass
1292 picture sheet
1294 pre-curved backing plate
1296 3D frame body
1298 backboard

FIG. 51

1300 pre-curved glass
1302 picture
1304 pre-curved backing plate
1306 3D frame body
1308 strap
1310 Velcro ribbon male
1312 Velcro ribbon female FIGS. 52a–52b 1320 3D frame body
1322 strap, not shown
1330 card board strip

FIG. 53

1340 pre-view frame
1342 base plate
1344 grooves
1346 grooves
1348 poles
1350 top plate
1352 grooves
1354 grooves

FIG. 54

1360 3D frame
1362 light fixture
1364 fluorescent lamps
1366 pre-curved backing plate

FIG. 55

1370 heat forming unit
1372 convex mold
1374 concave mold
1376 holder
1378 side plate
1380 bottom plate
1382 threaded rods
1384 top plate
1386 compression spring
1388 washers
1390 nuts
1392 glass sheets
1394 backing plates
1396 flexible steel sheets

DESCRIPTION OF THE PREFERRED EMBODIMENTS

FIG. 1

FIG. 1 shows a first embodiment of the frame calendar system of the present invention. It consists of a frame body 50, glass 52, calendar sheets 54, 56, 58 and 60, a back member 62 and an elastic band 64. The frame body 50, glass 52, back member 62 and the elastic band 64 can be grouped together and referred to as a frame assembly 65. Custom picture sheets 66, 68 and 70 are also shown in the figure. These custom picture sheets can be personal photo prints, documents, etc., that do not contain calendar date information. They can be optionally added for display if desired.

The front side of the frame body 50 is not shown but can be of any suitable design. Formed within the frame body 50 is a frame window 72 through which all pictures are to be displayed. The frame body 50 has a back surface 74. Also shown on the frame body 50 is a rabbit 76 in which the glass 52 is to be placed. The depth of the rabbit 76 is about the same as the thickness of the glass 52 so that the glass 52, once place into the rabbit 76, will be flush with the back surface 74 of the frame body 50.

A top wall 80 and two side walls 82 and 84 are provided which are largely perpendicular with respect to the back surface 74. No bottom wall is provided which will be clear from the following description. An eyelet, not shown, can be provided on the top wall 80 for hanging the frame body 50 on a vertical wall.

Also located on the back surface 74 of the frame body 50 are two top studs 86, two side studs 90 and two bottom studs 92. All of these studs are small rods projecting outward from the back surface 74. They are preferably integral part of the frame body 50 and positioned around the frame window 72 largely as shown. The length of each of these studs is approximately the same as or slightly less than the depth of each of the top wall 80 and the side walls 82 and 84.

Four calendar sheets 54, 56, 58, and 60 are shown in FIG. 1, but more sheets can be provided. The front side of each of these calendar sheets contains a calendar picture illustration 96 and a calendar date table illustration 98. These two illustrations are separated by a perforation line 100.

On each calendar sheet there are six holes 102 located near the outer perimeter of the calendar picture illustration 96. These holes 102 have hole diameters slightly larger than the diameters of the studs 86, 90 and 92 and are engageable with these studs for the mounting of the calendar sheets 54, 56, 58 and 60 on the frame body 50.

The back member 62 serves as a backing for the calendar. It has a size similar to that of the calendar picture illustration 96. It also has six hole openings 104 to be engaged with the studs 86, 90 and 92 of the frame body 50.

For mounting the calendar sheets on the frame body 50 the frame body 50 is placed on a table with the back surface 74 facing up. The glass 52 is first loaded into the rabbet 76. The entire stack of the calendar sheets 54, 56, 58 and 60 is then loaded face down into the frame body 50 as guided by the top wall 80 and the side walls 82 and 84. The back member 62 is next loaded on the top of the calendar sheets. After these loading the six studs 86, 90 and 92 of the frame body 50 will be inserted through the holes 102 of the calendar sheets 54, 56, 58 and 60 and the holes 104 of the back member 62.

The elastic band 64 is then installed to secure the assembled calendar assembly. The elastic band 64 is stretched and wrapped around the exposed portion of the six studs 86, 90 and 92. The friction between the elastic band 64 and the studs will firmly retain the elastic band 64 in place. As a result the calendar sheets will be secured by the elastic band 64 and will not slip off the studs during normal use.

There are many ways to wrap the elastic band 64 around the studs 86, 90 and 92. A loop can be formed around one or more studs to further secure the mounting of the calendar sheets on the frame body 50. A cross can also be formed to provide some support to the center portion of the calendar sheets and the back member 62.

The use of the elastic band 64 makes the assembly and disassembly of the frame assembly 65 extremely easy. Such band can be made at low cost and easily replaced when worn out.

After the calendar system is assembled it can be hung on a vertical wall for display. The calendar picture illustration 96 of the calendar sheet 54 is properly framed and displayed through the frame window 72. The calendar date table illustration 98 of the same calendar sheet 54 is also on display, but is exposed below the frame window 72.

It is clear that the calendar system as described provides an important advantage over most conventional calendars in that it allows the picture portion of the calendar sheets to be framed. It greatly enhances the aesthetic value of the calendar picture on display. In the mean time the calendar date table portion of the calendar sheets on display is exposed beyond the frame window. This arrangement will facilitate the calendar date checking and memorandum writing on the calendar sheet without disassembling the frame assembly.

At the end of each calendar date table period the expired calendar sheet is removed. This is done by disassembling the frame calendar in reverse order as the frame assembling procedure described above. The expired calendar sheet can be either discarded or placed on the back of the calendar sheet stack for record keeping.

It is also possible to renew the calendar date table without disassembling the frame assembly 65. In the assembled and hanging position the perforation line 100 of each calendar sheet is positioned nearly at the same level as the bottom edge of the frame body 50. Thus the lower half of the calendar sheet containing the expired calendar date table illustration 98 can be torn off along the perforation line 100. This will expose the calendar date table illustration 98 of the next calendar sheet. Of course in this way the calendar picture illustration 96 of the expired calendar sheet is still to be continuously displayed.

Any time during the calendar year a custom picture sheet 66 can be loaded in front of the calendar sheet 54 and be displayed. For example, the frame body 50 can be designed for framing a photo print of popular size of 8"×10" (203 mm×254 mm). This is achieved by providing the studs 86, 90 and 92 to enclose a rectangular area slightly larger than 8"×10" (203 mm×254 mm).

To mount the custom picture sheet 66 into the frame body 50 the frame calendar system is first disassembled. The custom picture sheet 66 is loaded face down into the area enclosed by the studs 86, 90 and 92. The calendar sheets 54, 56, 58 and 60 and the back member 62 are then loaded into the frame in the manner previously described. This is followed by placing the elastic band 64 as described before.

The custom picture sheets 68 and 70 can also be loaded in the frame body 50 for storage. They can be loaded either in the order as shown in FIG. 1 or be placed anywhere between the calendar sheet 54 and the back member 62.

The ability to display a custom picture in lieu of the calendar picture adds a very important feature to the present calendar system. One is no longer limited by the pictures selected by the calendar manufacturer. A custom picture with proper size can be displayed any time in place of the provided calendar picture. This display can also be changed as frequently as one would wish.

One other important feature to be pointed out is that the calendar system of the present invention provides a convenient way for storing the custom pictures. A stack of varying number of custom picture sheets can be stored in the frame body 50. The maximum number allowable is only limited by the design of the frame body 50 which requires that after all calendar sheets and custom picture sheets are mounted an exposed length of the studs 86, 90 and 92 be available to be engaged by the elastic band 64.

After the calendar year with all the expired calendar sheets removed, the frame assembly 65 can be converted to a picture frame. Here a picture frame is commonly referred to as a frame with a largely centered frame window for removably holding a custom picture and displaying the custom picture through the frame window. For a picture frame made of transparent materials such as glass the frame window is no longer necessary and a glass display area can be provided instead.

Of course the converted picture frame of the present invention also serves as a picture storage device for storing varying number of pictures. With all calendar sheets removed after the conversion even more custom pictures can now be stored in the converted picture frame.

Obviously, after the calendar year it is also possible that only the bottom portion of all calendar sheets containing the calendar date table illustration 98 be torn off along the perforation line 100. Some or all of the upper portion containing the calendar picture illustrations 96 can still be stored and displayed in the frame body 50, just like the custom picture sheets 66, 68 and 70.

The primary function of the frame assembly 65 is to serve as a support and display means for a calendar. Once the frame assembly 65 is converted to a picture frame it is no longer a part of calendar system. In the present embodiment there is no physical change required when the frame assembly 65 is converted to a picture frame. But this may not be the case for frame assemblies to be described in the later section.

One of the critical elements in the present calendar system is a plurality of studs around the frame window. These studs are sheet supporting means for supporting and mounting the calendar sheets and the custom picture sheets on the frame body.

The support of the custom picture sheets and the calendar sheets by the studs with the frame assembly vertically mounted are achieved through two different mechanisms. As is clear from FIG. 1 the support of the custom picture sheets 66, 68 and 70 is achieved by allowing a bottom edge 106 of each of these custom picture sheets rest on the studs 92. The studs 86 and 90 serve to guide the custom pictures in place.

On the other hand the support of the calendar sheets 54, 56, 58 and 60 is achieved due to the presence of the holes 102 which are in hanging engagement with the studs 86, 90 and 92. In this regard the holes 102 can be termed as hanging receiving means while the studs as hanging means. The engagement between the hanging means and the hanging receiving means of the present invention allows the upper half of the calendar sheet containing the calendar picture illustration to be displayed through the frame window and allows the lower half of the calendar sheets containing the calendar date table illustration to be supported by suspension and on display below the frame window.

In FIG. 1 the holes 102 are circular while the studs 86, 90, and 92 are in the form of round rods. Certainly, there are many variations on the shape and form of the hanging means and hanging receiving means of the present invention. In addition to studs, other commonly known hanging devices that can also serve as the hanging means for the present application may include nails, walls, recess and clamps. In addition to holes, other means such as notches, slots, steps can also be provided on the calendar for serving as the hanging receiving means for the present application.

It is clear from the above description a novel calendar system is disclosed. This calendar system consists of a plurality of calendar sheets and a frame assembly with a frame window. One or more custom picture sheets can be optionally added to this calendar system. Each said calendar sheet contains a calendar date table illustration and a calendar picture illustration. The frame assembly has sheet supporting means for removable supporting and mounting each said calendar sheet and custom picture sheet in the frame assembly, and for simultaneously displaying one said calendar picture illustration through said frame window and displaying one said calendar date table illustration below said frame window, and alternatively for simultaneously displaying one said custom picture sheet through said frame window and displaying one said calendar date table illustration below said frame window. After the calendar year the frame assembly can be converted to and continuously used as a picture frame.

FIGS. 2–3

Figure 2:
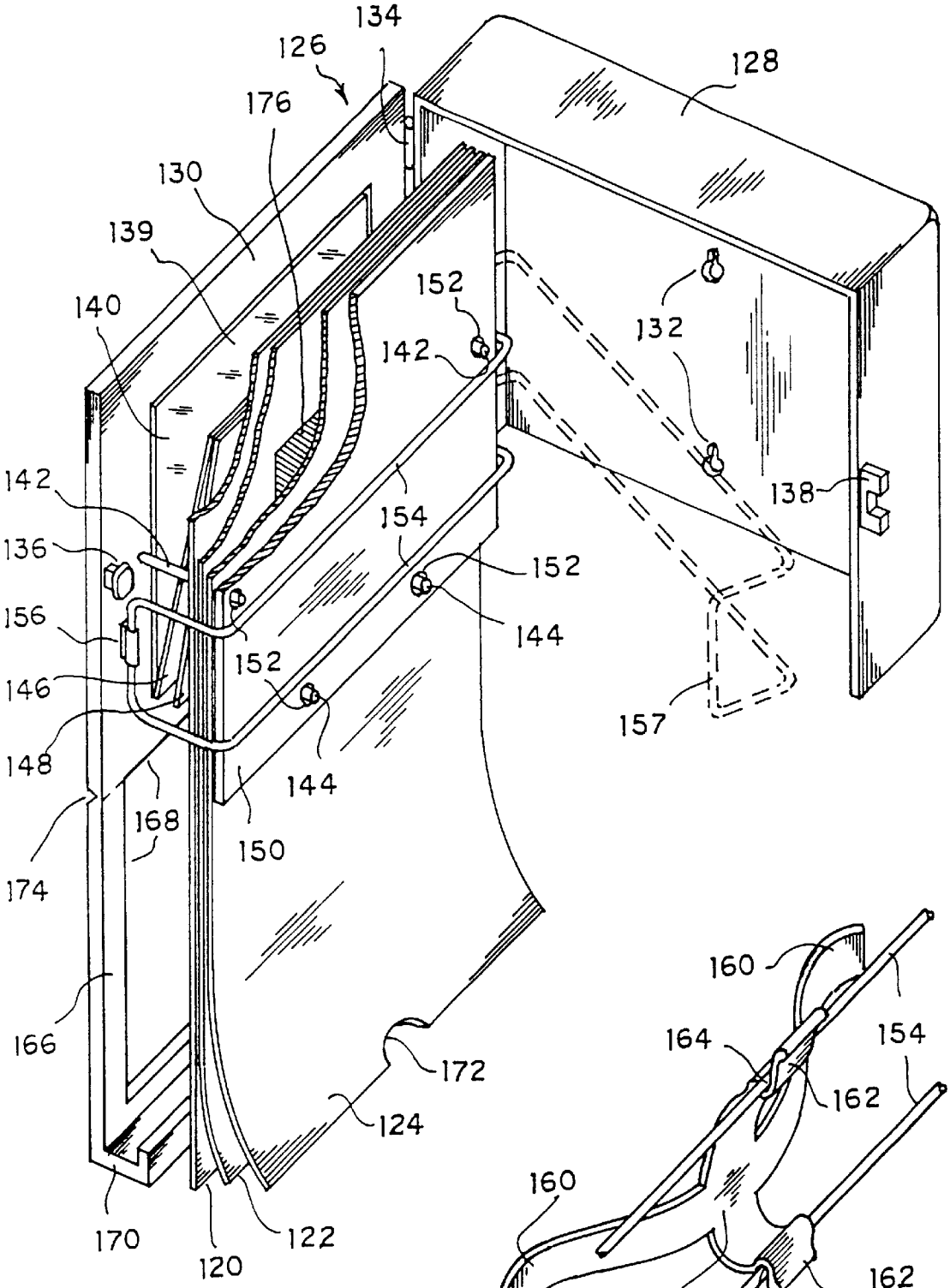
FIG. 2 is a perspective view showing a second embodiment of the frame calendar system of the present invention, with parts broken away.

FIG. 2 shows a second embodiment of the frame calendar system of the present invention. It consists of a plurality of calendar sheets 120, 122 and 124, and a frame assembly 126 which has a back casing 128 and a frame body 130. There are two mounting holes 132 on the back casing 128 for the mounting of the back casing 128 on a vertical wall. The frame body 130 is pivotally mounted with hinges 134 on the back casing 128 for horizontal rotation therewith. Latch 136 and catch 138 are provided for securing the frame body 130 when the frame body 130 is in closed position.

A frame window 139 is located on the frame body 130. Mounted over this frame window 139 is a glass 140. Two side studs 142 and two bottom studs 144 are located on the back side of the frame body 130 as shown. Two custom picture sheets 146 and 148 are optionally included which have bottom edges engageable with the bottom studs 144 for mounting the custom picture sheets 146 and 148 on the frame body 130.

The calendar sheets 120, 122 and 124 are similar to the calendar sheets 54, 56, 58 and 60 shown in FIG. 1. The top half of each calendar sheet has a calendar picture illustration while the lower half has a calendar date table illustration. Four mounting holes, not shown, are provided on each calendar sheet and are engageable with the studs 142 and 144 for mounting the calendar sheets 120, 122 and 124 on the frame body 130.

A back member 150 is also shown which has four holes 152 engageable with the studs 142 and 144.

A wire guard 154 is shown rotatably mounted on the back side of the frame body 130. A catch 156 is provided for removable holding the wire guard 154 in a closed position. This wire guard 154 can be rotated to an open position as illustrated by the dash line 157 for loading or unloading the calendar sheets 120, 122 and 124 and the custom picture sheets 146 and 148.

When the wire guard 154 is in the closed position as shown in the figure, all the calendar sheets 120, 122 and 124 and the back member 150 can be pulled back and stopped by the wire guard 154. This allows ample room immediately in front of the calendar sheet 120 to facilitate mounting, removing or examining the custom picture sheets for display and storage. A new custom picture sheet can be added for display or storage by simply inserting it from the top into the space between the calendar sheet 120 and the glass 140. This is achieved without taking down the calendar sheets 120, 122 and 124 and the back member 150 from the frame body 130.

Figure 3:
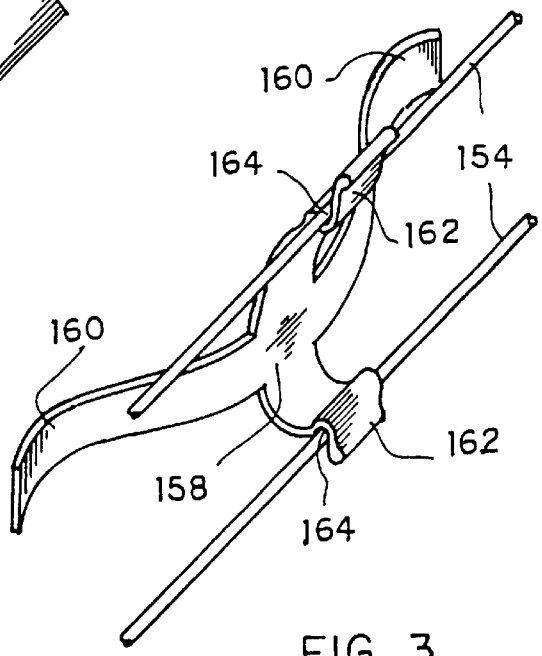
FIG. 3 is a perspective view showing a spring plate used in the frame calendar system of FIG. 2.

Shown in FIG. 3 is a spring plate 158 which is made of resilient materials. It has two horizontal arms 160 and two vertical arms 162 joined together in the shape of a cross. Each of the vertical arms 162 has a groove 164 engageable with the wire guard 154. The spring plate 158 can be snapped onto and firmly retained by the wire guard 154 by momentarily pressing the ends of the vertical arms 162 toward each other while pushing the spring plate 158 toward the wire guard 154. The spring plate 158 can be removed from the wire guard 154 by simply pulling it out while momentarily pressing the ends of the vertical arms 162 toward each other.

To move all the custom picture sheets and calendar sheets from the loosely held position as shown in FIG. 2 into their final mounted position one simply pushes the custom picture sheets and the calendar sheets along with the back member 150 toward the frame window 139. The spring plate 158 is next mounted on the wire guard 154. In this mounted position the horizontal arms 160 of the spring plate 158 will be partially deformed and in contact with the back member 150. The spring force in the horizontal arms 160 will continuously urge the custom picture sheets and the calendar sheets toward the frame window 139 and enable the first sheet in the stack of custom picture sheets and calendar sheets to be properly displayed through the glass 140.

It is also to be noted that the wire guard 154 can be turned to the open or closed position without removing the spring plate 158 from the wire guard 154. The loading and unloading of the calendar sheets and custom picture sheets can all be done with the wire guard 154 in its open position. After loading, the wire guard 154 is simply closed with the mounted spring plate 158 pushing all custom pictures/calendar sheets into their final position for display.

The lower half of the frame body 130 is termed breakaway or removable section 166. This section 166 is engageable with the lower portion of the calendar sheets 120, 122 and 124 that contains the calendar date table illustrations.

The breakaway section 166 has a second window 168 through which the calendar date table illustration is to be displayed. This window 168 elegantly frames the calendar date table illustration display and significantly enhances the aesthetic value of the entire calendar system.

The lower end of the breakaway section 166 is a tray 170. When mounted the lower end of the calendar sheets 120, 122 and 124 are tucked in this tray 170 so that the bottom of the calendar sheets will not be curled with frequent use.

The width of the second window 168 is slightly wider than the width of the calendar sheets 120, 122 and 124. A thumb notch 172 is located on the bottom of each calendar sheet. It is possible to engage the thumb notch 172 of the calendar sheet 120 by a finger and pull out and lift the calendar sheet 120. This allows the calendar date table illustration of the calendar sheet 122 to be revealed for examination without disassembling the calendar. After the examination the calendar sheet 120 can be pushed to the back of the second window 168 and tucked in the tray 170.

As seen in FIG. 2 a notch 174 is provided on each side between the breakaway section 166 and the upper section of the frame body 130. This makes it easy to break away the breakaway section 166 when it is no longer needed.

During the calendar year the frame assembly 126 mainly serves as a component of the calendar system of the present invention. The frame window 139 is located on the upper portion and not in the center of the frame body 130. After the end of the calendar year with all the calendar sheets removed the breakaway section 166 is no longer needed and can be removed as just described. This effectively converts the frame assembly 126 to a picture frame which has a frame window 139 located in the center of this picture frame. From now on this picture frame will be solely used for holding custom picture sheets and displaying a custom picture sheet through the centered frame window 139.

It is to be noted that the principle of the breakaway section 166 is also applicable to the other embodiments of calendar systems of the present invention. For example, a breakaway section, similar to the breakaway section 166 can also be provided and be part of the frame body 50 of FIG. 1.

Also shown in FIG. 2 is a thin layer of light adhesive 176 applied to the back side of the calendar sheet 122. This light adhesive is readily available commercially which when applied as shown, can hold a sheet of calendar or custom picture sheet pressed to it. Further more, due to its low adhesiveness, it allows the attached calendar sheet or custom picture to be easily peeled off without damaging the surface of the removed sheet.

It is preferable that a small area on the back of each calendar sheet be applied with a thin layer of the light adhesive material just described. This allows the calendar sheets to be neatly formed as a pad which greatly eases the mounting and removal of the calendar sheets at the end of each calendar date table period.

After the expiration of the calendar date table period and with the lower half of the calendar sheet torn off, the upper half with the light adhesive can be turned over and serve as a mat for holding and displaying a small custom picture which otherwise is too small to be mounted in the frame assembly 126. With the light adhesive the custom picture to be displayed can be adhered to the back of the upper half of the calendar sheet. This calendar sheet is then loaded in the frame assembly 126 with the adhered custom picture facing the glass 140. Depending on the size of the custom picture and the coated light adhesive area, it is possible that more than one custom picture can be placed on a calendar sheet and displayed. The calendar sheet with light adhesive coating is also suitable for storing such custom pictures when not on display.

Obviously, the calendar sheets 54, 56, 58 and 60 of FIG. 1 can also be applied with a layer of light adhesive in the same manner just described. As a matter of fact, any sheet mountable in the frame body of the present invention can be coated with a layer of light adhesive to serve as a picture mat.

In comparison with the previous embodiment, the present calendar system as illustrated in FIGS. 2 and 3 is most suitable for framing calendar sheets or custom picture sheets of larger size. It enables the change of the display of the calendar sheets or custom picture sheets without taking down the frame from its hanging position. The frame body 130 swings horizontally which does not require holding the frame body 130 during such change. With the present design, the loading and unloading of custom picture sheets are easily achieved without removing the calendar sheets. The use of the spring plate 158 will assure all calendar sheets and/or custom picture sheets properly mounted regardless of the number of sheets mounted up to the capacity of the frame assembly 126. The picture on display will also be properly urged against the glass 140 and the frame window 139.

FIGS. 4–5

Figure 4:
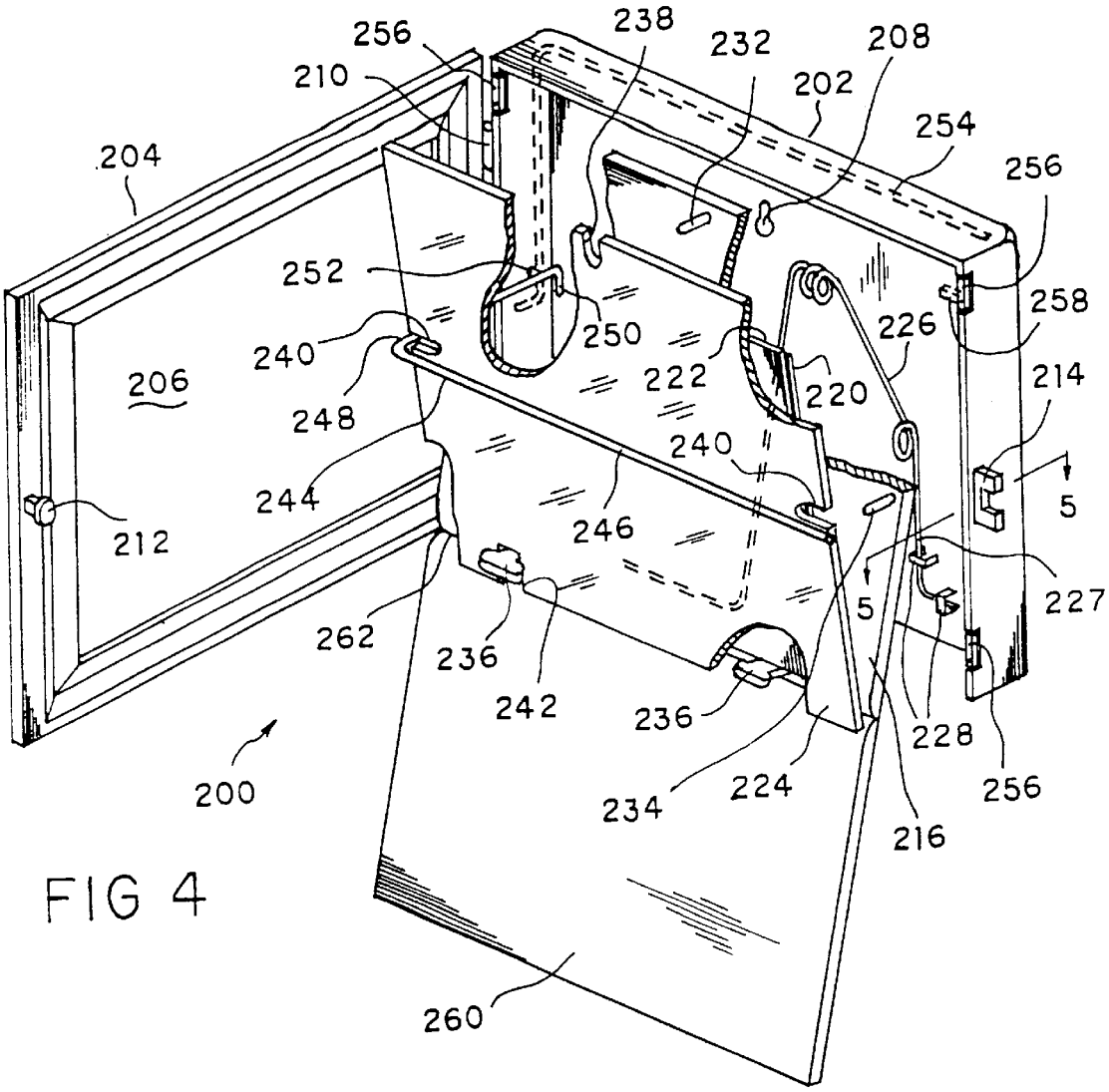
FIG. 4 is a perspective view showing a third embodiment of the frame calendar system of the present invention, with parts broken away.
Figure 5:
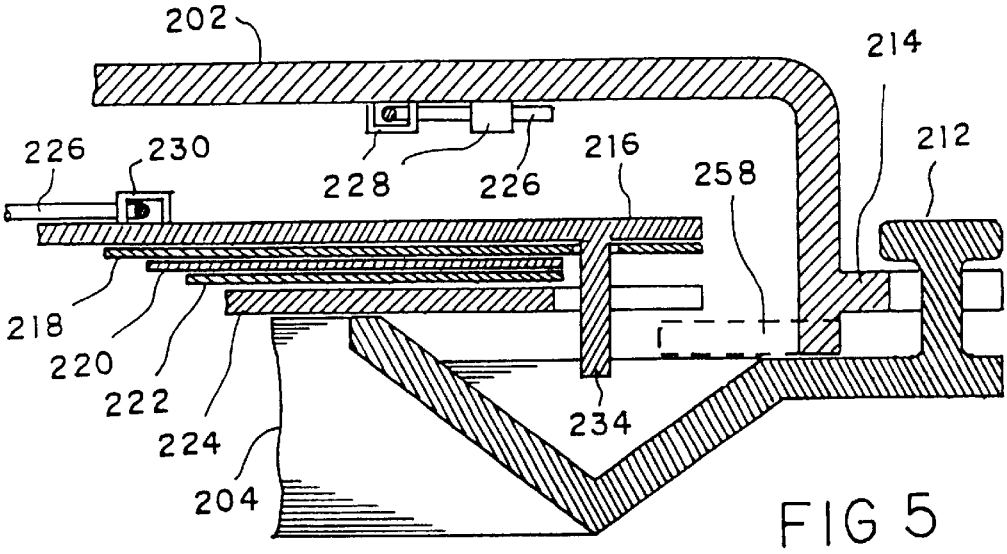
FIG. 5 is a fragmentary sectional view of a portion of the frame calendar system of FIG. 4 after assembling, taken substantially on a horizontal plane containing the line 5—5 of FIG. 4.

FIGS. 4 and 5 show a third embodiment of the frame calendar system of the present invention. This embodiment has the most complicated frame structure among all frames disclosed so far. It is mainly designed for the storage and display of very large calendar sheets and custom picture sheets. The primary goal is to ease the effort in loading and unloading the calendar sheets and custom picture sheets.

Shown in FIG. 4 is a frame assembly 200 for the present calendar system. It has a back casing 202 and a frame body 204 with a frame window 206. One or more mounting holes 208 are provided on the back casing 202 for mounting the back casing 202 on a vertical wall and making the back casing 202 stationary. The frame body 204 is mounted on the back casing 202 with hinges 210 and is horizontally rotatable with respect to the back casing 202. Latch 212 and catch 214 are provided for securing the frame body 204 when in closed position.

A back member 216 serves as the sheet supporting means. A calendar sheet 218 (shown in FIG. 5), custom picture sheets 220, 222 and a glass 224 can all be mounted on and supported by the back member 216. The back member 216 in turn is mounted on the back casing 202 using a long spring wire 226. Only one half of the spring wire is shown in FIG. 4 for the sake of clarity since the other half is merely a mirror image of the first half. The spring wire 226 has two legs 227 which are fastened to the back casing 202 by fasteners 228. The middle section of the spring wire 226 has a shape of a "U" and is attached to the back side of the back member 216 by several fasteners 230.

The spring wire 226 is shaped to support the back member 216 in a bottom tilted position when the frame body 204 is open as shown in FIG. 4. In this bottom tilted position the back member 216 is tilted with the bottom portion of the back member 216 positioned farther away from the back casing 202 than the upper portion of the back member 216. This bottom tilted position is very desirable which greatly facilitates the loading and unloading of the calendar sheets and custom picture sheets.

A top stud 232, two side studs 234, and two bottom studs 236 are located on the upper section of the back member 216. The top stud 232 and the side studs 234 can simply be rods extending outward from the back member 216. However, the bottom studs 236 are preferably in the form of plates with wide base for providing better support of the custom picture sheets 220 and 222.

The glass 224 is preferably made of clear plastics such as acrylics. It is formed with a top slot 238, two side slots 240 and two bottom slots 242 to be engageable with the top stud 232, side studs 234 and the bottom studs 236, respectively, for the support of the glass 224. It is noted that the front end of the bottom stud 236 is wider than the slot 242 and will prevent the glass 224 from slipping off the bottom studs 236 accidentally.

Also shown in FIG. 4 is a rail guard 244. This rail guard 244 can be made of metal rod which is bent to form a horizontal section 246, a side section 248 and a end elbow 250. A leg 252 is also provided, and one end of which is welded to and perpendicular to the side section 248. The other end of the leg 252 is inserted into and rotatably mounted on one side wall of the back casing 202. When the rail guard 244 in not needed it is rotated to a recessed position inside the back casing 202 as indicated by the dash line 254.

The frame body 204 can be rotated horizontally to an open position after the latch 212 is separated from the catch 214 of the back casing 202. Once the frame body 204 is open the back member 216 will be automatically extended forward to the bottom tilted position just described. At this time the glass 224 and the custom pictures 220 and 222 are also tilted and rest on the back member 216.

The rail guard 244 can be next rotated to a horizontal position as shown in FIG. 4 with the end elbow 250 stopped by the back casing 202. After this the glass 224 can be pulled away from the back member 216 and leaned against the horizontal section 246 of the rail guard 244 in a top tilted position as shown in FIG. 4. One can now easily flip through the stack of the custom picture sheets for examining the installed custom picture sheets. A new custom picture sheet can also be inserted into the stack through the clearance between the glass 224 and the back member 216.

For mounting a very large custom picture on the back member 216 it is preferable that the rail guard 244 be remained at the recessed position and not to be used. The loading or unloading of custom pictures is achieved by first taking down the glass 224. A custom picture sheet to be displayed is then simply placed on top of the stack of the custom picture sheets already in place. This mounting method will assure best protection of the custom picture sheets during loading and unloading of the custom picture sheets. After the custom picture sheet is loaded the glass 224 is then reinstalled on the back member 216.

For the sake of clarity the calendar sheet 218 is not shown in FIG. 4 but is shown in FIG. 5. This calendar sheet 218 and more sheets like it can be made similar to the calendar sheet 54 of FIG. 1. Five mounting holes can be provided on the calendar sheet 218 to engage with the studs 232, 234 and 236 for the support of the calendar sheet 218 on the back member 216. Obviously the glass 224 must first be taken down before the loading and unloading of the calendar sheet 218.

Once the glass 224, custom picture sheets 220 and 222, and the calendar sheet 218 are properly mounted on the back member 216, the frame body 204 can be rotated to its closed position as shown in FIG. 5. This is achieved by turning the frame body 204 with the right hand while the left hand goes through the frame window 206 and pushes back the glass 224 to its vertical position. The latch 212 is next latched into the catch 214 which locks the frame body 204 in the closed position.

With the frame body 204 in the closed position the spring wire 226 will be deformed as partially shown in FIG. 5. The stored spring force in the deformed spring wire 226 will constantly urge the back member 216 toward the frame window 206 with the glass 224 in firm contact with the frame body 204.

As shown in FIG. 4 a set of four rotatable stops 256 are mounted on four corners of the back casing 202. These stops 256 can alternatively allow the closing of the frame body 204 to be achieved in two easy steps. In the first step one hand will push the glass 224 to its vertical position and the other hand will rotate each of the four stops 256 into positions as indicated by the dash lines 258. This will allow the glass 224 to be held in the upright position by these stops 256 after the holding hand is removed from the glass 224. In the second step the frame body 204 is closed and latched. As seen in FIG. 5, with the frame body 204 in the latch closed position the glass 224 is further pushed inward slightly and separated from the stops 256.

The lower half of the back member 216 is a breakaway section 260 which is separated from the upper half of the back member 216 by an indentation line 262. The breakaway section 260 is engageable with and in support of the lower half of the calendar sheet 218 containing the calendar date table illustration. At the end of the calendar year the breakaway section 260 can be easily broken away from the upper section of the back member 216 along the indentation line 262 for converting the present frame assembly 200 into a picture frame.

One major difference between the frame calendar system shown is FIGS. 4 and 5 and the first two frame calendar systems shown in FIGS. 1 to 3 is in the design of the sheet supporting means. In the first two frame calendar systems the studs used for the support of the calendar sheets and custom pictures are located on the frame bodies. On the other hand, such studs are instead located on the back member of the frame assembly shown in FIGS. 4 and 5.

FIG. 6

Figure 6:
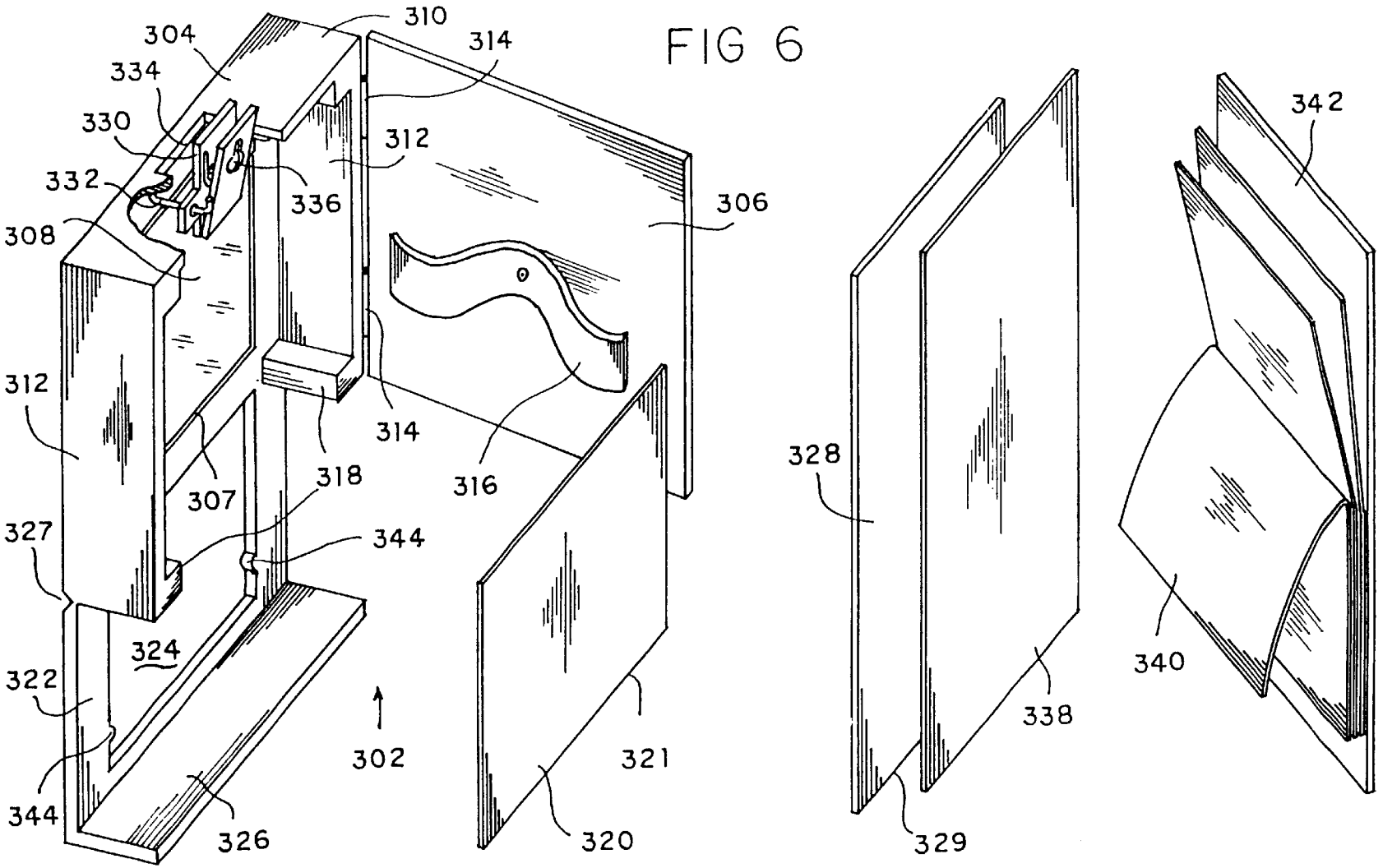
FIG. 6 is a perspective view showing a fourth embodiment of the frame calendar system of the present invention, with parts broken away.

FIG. 6 shows a fourth embodiment of the frame calendar system of the present invention. In this embodiment a frame assembly is disclosed which has two or more distinctively different supporting means. One of these supporting means is exclusively for supporting and mounting the calendar while the second supporting means is exclusively for supporting and mounting the custom picture sheets.

The major component in the present calendar system is a frame assembly 302 which consists of a frame body 304 and a back casing 306. The frame body 304 has a frame window 307 which is covered by a glass 308. A top wall 310 and two side walls 312 are provided in the frame body 304 as shown in the figure.

The back casing 306 is pivotally mounted with hinges 314 on the frame body 304 for rotation thereof. Latch and catch, not shown, are provided on the back casing 306 and frame body 304, respectively, for securing the back casing 306 when it is in the closed position. A spring leaf 316 is attached to the back casing 306 for urging any mounted calendar or custom picture sheets toward the frame window 307 when the back member 306 is secured in the closed position.

As seen in FIG. 6 the bottom of each of the side wall 312 is formed into a step 318. These steps 318 are custom picture supporting means to be described below.

Also shown in FIG. 6 is a custom picture sheet 320 optionally provided for display in the present frame assembly 302. This custom picture sheet 320 has a width slightly narrower than the inside width of the frame body 304 but is wider than the clearance between the two steps 318. This enables the custom picture sheet 320 to be mounted in the frame body 304 by simply resting the bottom edge 321 of the custom picture sheet 320 on the steps 318.

The lower half of the frame body 304 is a breakaway section 322. It has a second window 324 and a bottom plate 326. A notch 327 on each side of the frame body 304 is provided between the breakaway section 322 and the upper section of the frame body 304.

A calendar sheet 328 is shown in FIG. 6. This calendar sheet 328 is made of relatively firm paper materials. It has a calendar picture illustration and a calendar date table illustration on its front side. The width of this calendar sheet 328 is narrower than the clearance between the two steps 318. This will allow the calendar sheet 328 to be mounted in the frame assembly 302 with the bottom edge 329 of the calendar sheet 328 resting on the bottom plate 326, which in this case is a calendar supporting means.

Once the calendar sheet 328 and/or the custom picture sheet 320 are properly mounted the back casing 306 is closed. In this mounted position the calendar picture illustration of the calendar sheet 328 is displayed through the frame window 307 while the calendar date table illustration of the calendar sheet 328 is simultaneously displayed through the second window 324. Obviously, if the custom picture sheet 320 is also mounted in front of the calendar sheet 328, the present calendar system will display the custom picture sheet 320 through the frame window 307 while simultaneously display the calendar date table illustration of the calendar sheet 328 through the second window 324.

A clamp 330 is also shown in FIG. 6. It is slidably mounted on a pair of bars 332 rigidly attached to the underside of the top wall 310. The handle portion of the clamp 330 is extended above the top wall 310 through a clearance openings 334 on the top wall 310. A mounting hole 336 is shown on the clamp 330 for vertically mounting the frame assembly 302.

Instead of the calendar sheet 328 and the likes, a calendar sheet 338 of different design can also be alternatively mounted in the present frame assembly 302. Here the clamp 330 is used to hold the calendar sheet 338 by clamping the top portion of the calendar sheet 338. With the calendar sheet 338 clamped in place, it can be pushed forward until the clamped calendar sheet 338 is stopped at its display position. The back casing 306 is then closed to complete the assembly.

Instead of the calendar sheets 328 and 338 a calendar book 340 can also be alternatively mounted and displayed in the frame assembly 302 of the present invention. This calendar book 340 has a back board 342 which is slightly longer than the individual calendar sheets in the calendar book 340. This calendar book 340 can be mounted in the frame assembly 302 by resting the bottom edge of the back board 342 on the bottom plate 326. Alternatively, the calendar book 340 can also be mounted in suspension by clamping the top portion of the back board 342 by the clamp 330.

It is clear from the above description that the clamp 330 serves as a calendar supporting means for removably supporting the calendar sheet 338 or the calendar book 340 by suspension, and for displaying one calendar picture illustration through the frame window 307 and simultaneously displaying one calendar date table illustration through the second window 324.

The width of the second window 324 is slightly wider than the width of each calendar sheet of the calendar book 340. This will allow the page containing the displayed calendar date table illustration to be lifted for checking the calendar date table on the next page without disassembling the present calendar system. Two tabs 344 are provided for holding down the sheets of the calendar book 340 in it assembled position.

After the end of the calendar year with all the calendar sheets removed the breakaway section 322 can be removed along the notches 328. This effectively converts the frame assembly 302 into a picture frame.

FIGS. 7–12

Figure 7:
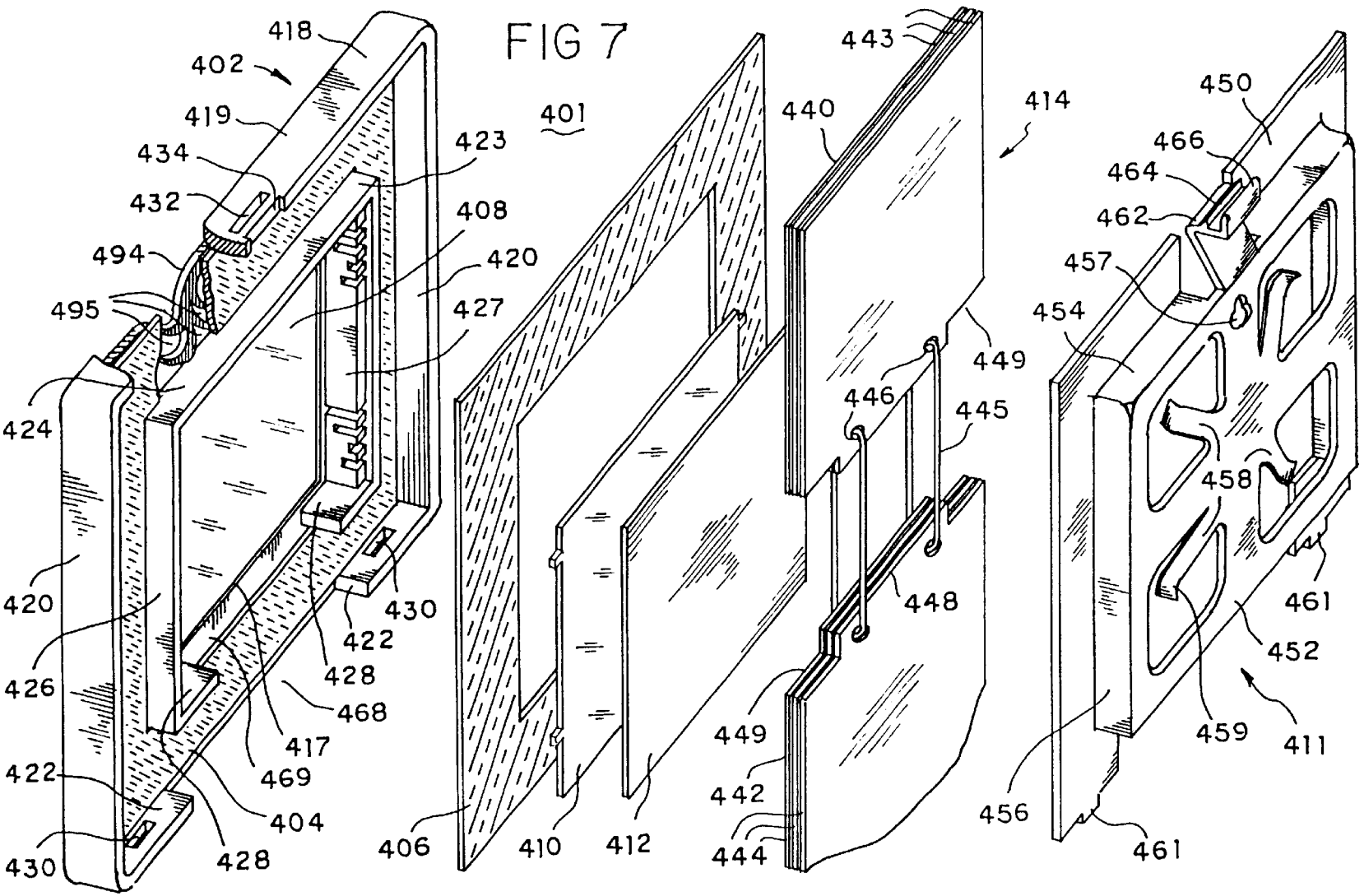
FIG. 7 is a perspective view showing a fifth embodiment of the frame calendar system of the present invention, with parts broken away.

FIG. 7 shows an fifth embodiment of the frame calendar system of the present invention. It consists of a frame assembly 401 which may include a frame body 402, border sheets 404 and 406, first window glass 408, second window glass 410 and a back member 411. One custom picture sheet 412 can be optionally mounted on the present frame calendar system. A calendar 414 which is in a book form is also included in the present system.

The frame body 402 can be made from molded plastics or other moldable materials including metals, glass, etc. It has a frame window 417 on which the first window glass 408 is firmly attached. An outer wall 418 which may include a top wall 419, two side walls 420 and two coplanar bottom walls 422 is provided in the frame body 402. An inner partitioning wall 423 consisting of an inner top wall 424, two inner side walls 426 and 427, and two coplanar inner bottom walls 428 is also provided which surrounds the frame window 417 as shown in the figure.

A slot hole 430 is provided on each of the bottom walls 422. A slot hole 432 is also shown on the top wall 419. A counter recess 434 can be provided if desired. This recess 434 and the slot holes 430 and 432 are to be engaged with the back member 411 to be described below.

The calendar 414 is shown in the form of a book which is openable to expose a page 440 containing a calendar picture illustration and a page 442 containing a calendar date table illustration. In this open position the calendar 414 is divided into an upper stack 443 which includes the page 440 and a lower stack 444 which includes the page 442. Two binding loops 445 are provided which can be simply two ribbons going through two holes 446 of each sheet of the calendar 614.

As seen in the figure each sheet in the calendar book 414 is formed to have a lip 448 and two steps 449 one on each side of the lip 448. This lip 448 provides the space for the binding holes 446 so that when the calendar 414 is mounted on the frame body 402 all these binding holes 446 of the upper stack 443 will be covered and not visible through the frame window 417. The two steps 449 of the upper stack 443 are provided to be rest on the inner bottom walls 428 when the calendar 414 is mounted on the frame body 402.

The back member 411 is preferably made of molded plastics which can be mass produced at low cost. It has an overall shape that fits the back side of the frame body 402. An outer portion 450 of the back member 411 is flat while a center portion 452 is raised which joins the outer portion 450 through a top wall 454 and two side walls 456. A mounting hole 457 is provided on the center portion 452 for mounting the assembled frame calendar on a vertical wall.

As seen in the figure there are four resilient arms 458 integrally formed on the back member 411. These arms 458 are projecting outward from the center of the center portion 452. Each of these arms 458 is formed at an angle away from the plane of the center portion 452. Each arm 458 has an end portion 459 which is slightly curved as shown. When not pressed the end portions 459 of the four resilient arms 459 are preferably located on a plane slightly beyond the plane of the outer portion 450.

A tab 461 is located on the bottom of the back member 411 on each side of the outer portion 450. A spring clip 462 is integrally formed on the top of the center portion 452. It has a shape of an inverted "7" as viewed in the figure. A tooth 464 with a slant surface and a bent end 466 are located on the top of the spring clip 462.

The calendar 414 can be mounted on the frame body 402 by simply placing the top stack 443 of the calendar 414 into the space enclosed by the inner partitioning wall 423 of the frame body 402 against the frame window 417. The back member 411 is subsequently mounted to hold the calendar 414 in place.

The back member 411 is mounted by first inserting the two tabs 461 of the back member 411 into the slot holes 430 of the frame body 402. As the back member 411 is pushed toward the frame window 417 the tooth 464 of the spring clip 462 will be initially stopped at the counter recess 434 of the frame body 402. A further push of the back member 411 toward the frame window 417 will cause the spring clip 462 to yield downward and the slant surface of the tooth 464 to slide along the lower edge of the recess 434 until the upper tip of the tooth 464 clears the recess 434. The tooth 464 will continue move forward under the push force until it drops into the slot hole 432 and locks the back member 411 to the frame body 402. To release this lock one can simply push down the bent end 466 to move the tooth 464 out of the slot hole 432 and at the same time pull back the whole back member 411 away from the frame body 402.

As the back member 411 is installed on the frame body 402 the end portions 459 of the resilient arms 458 are in contact with the calendar 414 and are pushed back against the spring force of each resilient arm 458. This spring force will continuously urge the upper stack 443 against the frame window 417 and allow the upper stack 443 to be properly mounted and the page 440 containing the calendar picture illustration properly displayed regardless of the number of sheets in the stack up to the capacity of the frame body 402.

There are three critical elements in the back member 411 of the present invention. These three elements, namely, the tabs 461, the spring clip 462, and the resilient arms 458, are worked in combination for the mounting of the calendar 414. During the mounting of the calendar 414 the tabs 461 of the back member 411 is first engaged with the frame body 402. The spring clip 462 is next engaged with the frame body 402, during which the resilient arms 458 are deformed against its spring force and thus urging the mounted upper stack 443 of the calendar 414 toward the frame window 417.

The removal of the back member 411 is achieved by first pressing down the bent end 466 of the spring clip 462 to release the tooth 464 from the slot hole 432 of the frame body 402. At this time the stored spring force in the resilient arms 458 will automatically push the back member 411 away from the frame body 402 thus facilitating the disengagement of the spring clip 462 from the frame body 402. The back member 411 is next lifted to remove the tabs 461 away from the slot holes 430.

In comparison with the prior arts, the back member 411 of the present invention provides following three advantages: 1. Both the installation and removal of the back member 411 are achieved in a simple insert-and-push or press-and-lift step; 2. The installed back member 411 will allow a stack of calendar sheets/custom picture sheets to be properly mounted regardless of the number of sheets in the stack up to the capacity of the frame body 402; 3. The one-piece molded back member 411 can be mass production at low cost.

Once the back member 411 is properly mounted on the frame body 402 the frame assembly 401 is ready to be mounted on a vertical wall. In this mounted position the steps 449 of the upper stack 443 of the calendar 414 is rest on the inner bottom walls 428 while the lower stack 444 of the calendar 414 is hung in free suspension. The calendar picture illustration on the page 440 will be displayed through the frame window 417 and the calendar date table illustration on the page 442 will be in full view beneath the frame body 402.

The custom picture sheet 412 can also be loaded in front of the upper stack 443 and be displayed through the frame window 417 if desired. More custom pictures, not shown, can also be stored in the frame body 402.

After the end of the calendar year the calendar 414 can be removed and the frame assembly 401 is converted to a picture frame/storage device. Obviously more custom pictures can be stored at this time.

Upon closer examination, it can be seen that the inner partitioning wall 423 virtually performs the same function as the studs 86, 90 and 92 of the frame body 50 shown in FIG. 1. The inner bottom walls 428 are engageable with the bottom edge of the custom picture sheet 412 for the support of the custom picture sheet 412 in a manner similar to the engagement between the studs 92 and the custom picture sheets 66, 68 and 70 shown in FIG. 1.

At the same time, these inner bottom walls 428 are also engageable with the calendar 414 for the hanging support of the calendar 414. In this case the steps 449 of the upper stack 443 can be viewed as hanging receiving means while the inner bottom walls 428 as the hanging means. The engagement between the hanging means and the hanging receiving means allows the upper stack 443 to be supported and mounted in the frame body 402 and the page 440 containing a calendar picture illustration to be displayed through the frame window 417. This same engagement also allows the lower stack 444 to be supported by suspension with the page 442 containing a calendar date table illustration to be displayed below the frame window 417.

It is also to be noted that an opening gap 468 exists between the two coplanar bottom walls 422 and another opening gap 469 exists between the two coplanar inner bottom walls 428. These gaps are provided to accommodate for the lips 448 and the binding loops 445 of the calendar 414. Obviously the size of these gaps will vary depending on the design of the lips and/or the book binding means.

The first window glass 408 is preferably mounted on the frame body 402 by friction or other suitable means so that the glass 408 can be made self supporting in place. On the other hand, the second window glass 410 is structured to be mountable on the frame body 402 at various positions depending on the orientation of the entry of the second window glass 410 into the frame body 402.

Figure 8:
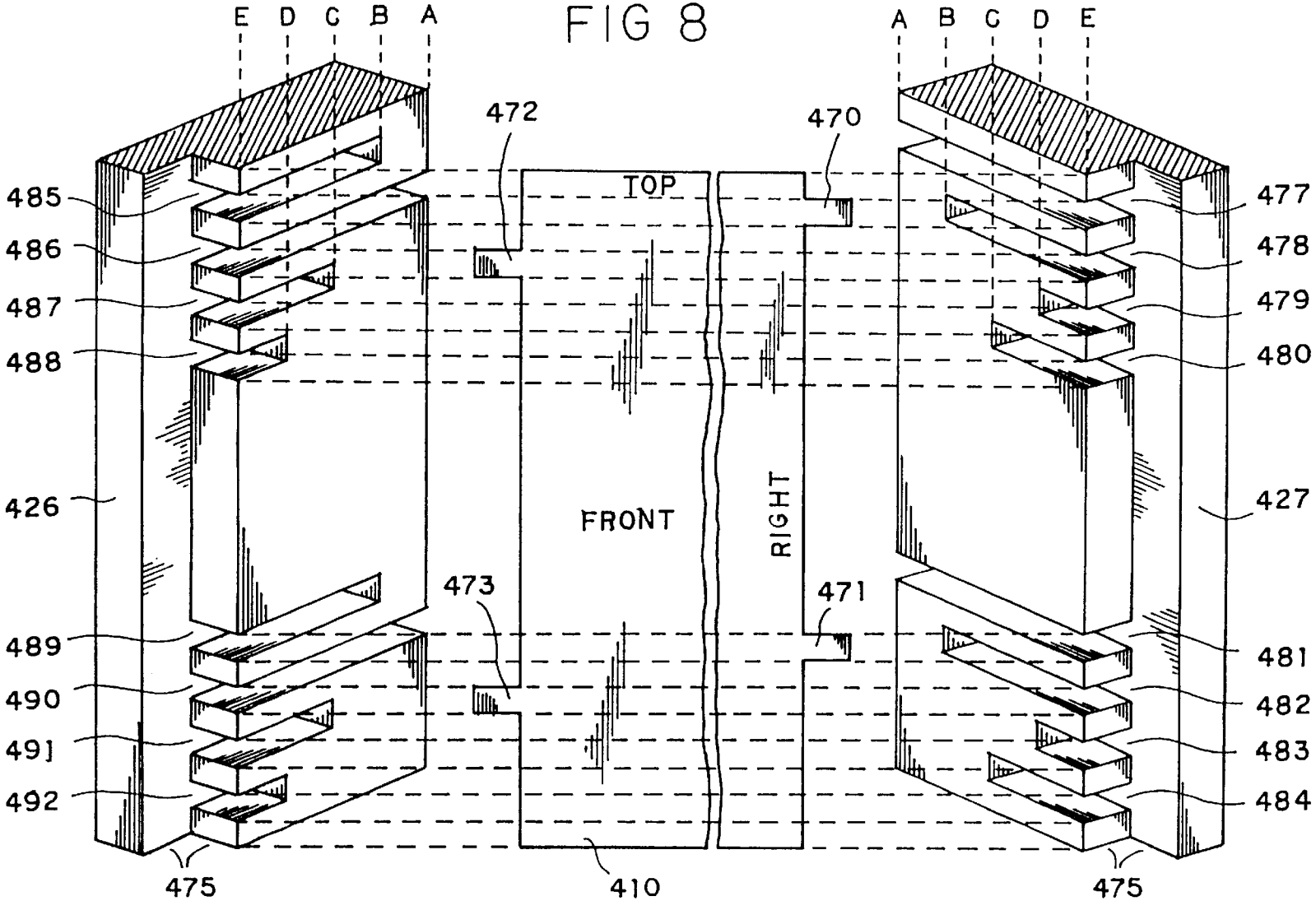
FIG. 8 is a perspective view showing an inner side wall of the frame calendar system of FIG. 7, shown in section and drawn on a larger scale than FIG. 7. This view shows the engagement of a second window glass with the inner side wall of the frame body of FIG. 7.

Shown in FIG. 8 is the enlarged elevational view showing a portion of the second window glass 410 as viewed in FIG. 7. This glass 410 is preferably molded from transparent materials such as acrylics. There are two tabs 470 and 471 on the right side of the glass 410 and two tables 472 and 473 on the left side of the glass 410 as viewed in FIG. 8. It is noted that these four tabs are unsymmetrically located on the sides of the glass 410.

Also shown in FIG. 8 is the enlarged perspective view of the inner side walls 426 and 427 as they are cut off from the rest of the frame body 402. Each wall is truncated to form a counter step 475 as shown in the figure. These counter steps can be used for holding a custom relief picture as to be described below.

There are a total of sixteen grooves molded on the inner side walls 426 and 427. As seen in the figure grooves 477, 478, 479 and 480 are located on the upper portion of the wall 427 while grooves 481, 482, 483 and 484 are located on the lower portion of the wall 427. Similarly, grooves 485, 486, 487 and 488 are located on the upper portion of the wall 426 while grooves 489, 490, 491 and 492 are located on the lower portion of the wall 426. All these grooves are of the same size except for their depths. The grooves 477, 481, 486 and 490 extend throughout the inner side walls 426 and 427 to a depth marked by "A". The grooves 478, 482, 485 and 489 extend to a depth marked by "B". The grooves 480, 484, 487 and 491 extend to a depth marked by "C". The grooves 479, 483, 488 and 492 have the shortest depth as they extend only to a depth marked by "D". The position marked by "E" is the depth of the counter step 475 and is also the starting point of all the grooves.

The width of the second window glass 410 is designed such that when the glass 410 is mounted in the frame body 402 the tabs 470, 471, 472 and 473 of the glass 410 must be seated within the grooves of the inner side walls 426 and 427. When the glass 410 enters the frame body 402 in the orientation as shown in FIG. 8, the tabs 470, 471, 472 and 473 will be seated within the grooves 477, 481, 486 and 490, respectively. Since these four grooves extend throughout the inner side walls 426 and 427 to the depth "A", the glass 610 can enter all the way until it is stopped and in contact with the first window glass 408.

The loading of the second window glass 610 in the frame body 602 to the depth "A" above-described is suitable for a two-layer display application. For example, a transparent sheet with graphic pattern can be mounted between the first window glass 408 and the second window glass 410 while a custom picture or calendar picture is mounted behind the second window glass 410. In this case the mounted custom picture or calendar picture is still largely visible except for the portion covered by the graphic pattern on the transparent sheet. The graphic pattern serves to complement and enhance the aesthetical value of the custom picture or calendar picture on display.

On the other hand, if the glass 410 is rotated to a new orientation different from that shown in FIG. 8 before it enters the frame body 402 the glass 410 will be stopped at different depths depending on the exact orientation of the glass 410 during its entry. For example, the glass 410 can be rotated horizontally by 180 degree from its original orientation as shown in FIG. 8. Referring to the figure, after this rotation the right side of the glass 610 will go to the left, the front side will go to the back and the top side still stays at the top. When the glass enters the frame body 402 after this horizontal rotation the tabs 470, 471, 472 and 473 will be seated in the grooves 485, 489, 478 and 482, respectively. In this orientation the glass 410 will be stopped at the depth marked by "B". This creates a space between the first window glass 408 and the second window glass 410 when the glass 410 is properly mounted. This created space between the point "A" and the point "B" is useful for the mounting and display of a three dimensional object as will be further described below.

The window glass 410 can also be rotated 180 degree vertically from its FIG. 8 orientation before its entry. Again referring to FIG. 8, after this rotation the top side of the glass 410 will go to the bottom, the front side goes to the back, and the right side still stays at the right. In this case the tabs 470, 471, 472 and 473 will be seated in the grooves 484, 480, 491 and 487, respectively. The glass 410, once properly mounted, will be stopped at the depth marked by "C".

The last possible 180 degree rotation of the glass 410 is a rotation of 180 degree within the plane of the glass 410. With this rotation the top side of the glass goes to the bottom, the right side goes to the left, and the front side still stays at the front. In this orientation, the tabs 470, 471, 472 and 473 will be seated within the grooves 492, 488, 483 and 479, respectively, during the entry of the glass 410. After mounting, the glass will be stopped at the depth marked by "D" which creates a large space between the point "A" and the point "D".

In the above three orientations a space of varying depth is created between the first window glass 408 and the second window glass 410 when the second window glass is mounted on the frame body 402. This allows the frame assembly 401 to serve as a display case for displaying one or several three-dimensional objects within the created space. At the same time, a custom picture or calendar picture is also displayed behind the second window glass 410. The displayed custom picture may contain a narrative describing the object on display or a background picture complementing the displayed objects. Objects of different size can be accommodated by varying the depth of the space between the glasses 408 and 410.

In the present embodiment, all the grooves are located on the inner side walls 426 and 427. It is also possible to provide grooves on the inner top wall 424 and the inner bottom walls 428 to support the mounting of a glass with different tab design at four different depths. Furthermore, if the inner wall 423 and the matching window glass 410 can be made circular instead of rectangular as shown in FIG. 8, more variations in the mounting depth can be achieved with proper design of the grooves and the matching tabs.

In FIG. 7 the part of the frame body 402 surrounding the frame window 417 and joined the outer wall 418 and the inner partitioning wall 423 is termed frame border 494. This frame border 494 can be molded to form some carved art pattern. A small portion of the frame border 494 with such a carved art pattern is shown in FIG. 7. In addition to the aesthetic value contributed by this carved pattern, the frame border with this pattern is also required to achieve two additional purposes. First, there must be adequate solid branches joining the outer wall 418 and the inner partitioning wall 423 to provide adequate strength to the frame body 402. Secondary, it is desirable that many openings 495 be formed in this frame border 494. These openings 495 can have different sizes and shapes. They are essentially many miniature border windows 495, the purpose of which will be clear from the description below.

The border sheet 404 is shown placed behind the frame border 494 and between the outer wall 418 and the inner partitioning wall 423. The color of this border sheet 404 can be in sharp contrast with that of the frame border 494. When placed behind the frame border 494, a portion of this border sheet 404 is visible through the many openings or miniature border windows 495 of the frame border 494.

FIG. 7 also shows the second border sheet 406 which has the same size as that of the border sheet 404 but of different color. As a matter of fact, even more border sheets are desirable so that one border sheet with a desirable color can be chosen for display to complement the calendar picture illustration or the custom picture on display. As the calendar sheet or custom picture sheet on display is replaced by a new one the border sheet on display can also be replaced if desired. This is an interesting and convenient way to change the appearance of the frame assembly 401 to complement the picture on display.

A stack of border sheets including the border sheets 404 and 406 can be easily loaded in the frame body 402 and held in place by the back member 411. It can also be removed by first taking down the back member 411. The calendar 414 must also be removed before the loading and unloading of the border sheets.

Figures 9, 10, 11, 12:
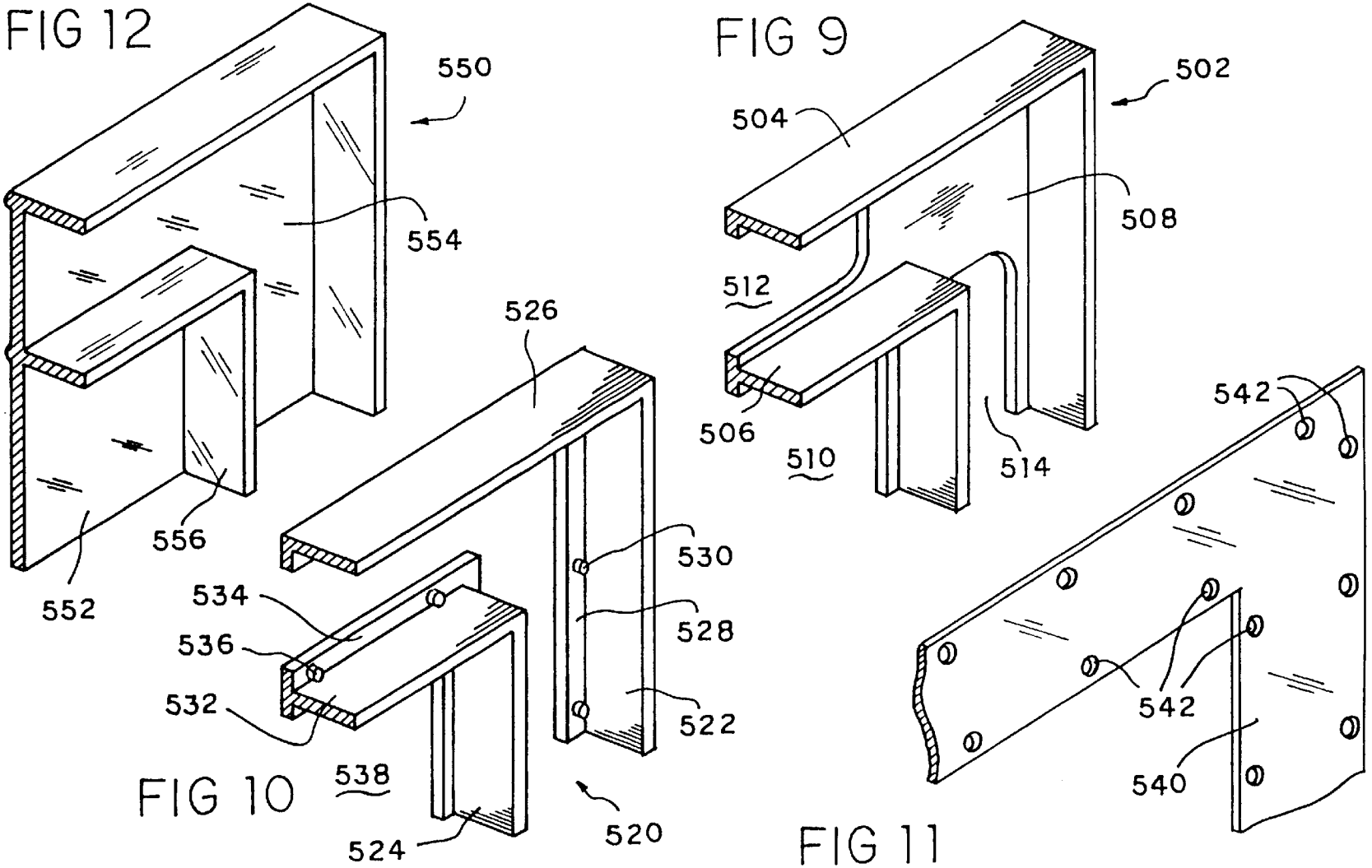
FIG. 9 is a fragmentary perspective view showing one variation of the frame body of FIG. 7.
FIG. 10 is a fragmentary perspective view showing another variation of the frame body of FIG. 7.
FIG. 11 is a fragmentary perspective view showing a border glass of the frame body of FIG. 10.
FIG. 12 is a fragmentary perspective view showing yet another variation of the frame body of FIG. 7.

FIGS. 9 to 12 show some variations on the design of the frame body for providing different border appearance. FIG. 9 shows one corner of a frame body 502 which can be similar to the frame body 402 and can be used for the mounting and displaying of the calendar 414 and/or custom picture sheet 412. This frame body 502 can be formed by molding. It consists of an outer wall 504, an inner partitioning wall 506 and a frame border 508. A frame window 510 is formed within the inner partitioning wall 506 for the display of the calendar 414 and the custom picture sheet 412. Formed in the frame border 508 are one top border window 512, two side border windows 514, and one bottom border window 516, not shown. A border sheet similar to the border sheets 404 and 406 can be mounted behind the frame border 508 and be displayed through the border windows 512, 514 and 516. This border sheet can be printed with graphic pattern to enhance the appearance of the frame body 502. Of course more border sheets can be provided to quickly and easily change the appearance of the frame body 502 by changing the border sheet on display.

FIG. 10 shows one corner of a frame body 520 which consists of an outer frame 522 and an inner frame 524 individually formed. The outer frame 522 has an outer wall 526 and an outer frame flange 528 on which a series of studs 530 are located. Similarly, the inner frame 524 has an inner partitioning wall 532 and an inner frame flange 524 on which a series of studs 536 are located. Formed within the inner frame 524 is a frame window 538 through which a calendar picture or a custom picture can be displayed.

FIG. 11 shows one portion of a border glass 540 of the frame body 520. This border glass 540 is preferably molded from a transparent plastics such as acrylics. It has a series of holes 542 of identical sizes located near its outer edge and inner edge.

The frame body 520 is assembled by placing the border glass 540 on the outer frame flange 528 and the inner frame flange 534 and pressing all studs 530 and 536 into the holes 442 of the border glass 540. The press fitting between the studs 530 and 536 and the holes 542 will hold the three pieces into an assembled unit.

Once assembled, one or more border sheets, such as the border sheets 404 and 406 shown in FIG. 7, but printed with graphic pattern, can be mounted on the frame body 520. Again, the appearance of the frame body 520 can be quickly changed by changing the border sheet on display.

FIG. 12 shows one corner of a frame body 550 which is molded entirely from transparent materials such as glass. This frame body 550 has a center display glass 552 and a border display glass 554 separated by a partitioning wall 556. In spite of the fact that no window is provided in this frame body 550, it can be used for displaying custom picture or calendar picture through the center display glass 552 and displaying a border sheet through the border display glass 554 in a similar manner as the frame body 402 of FIG. 7.

FIG. 13

Figure 13:
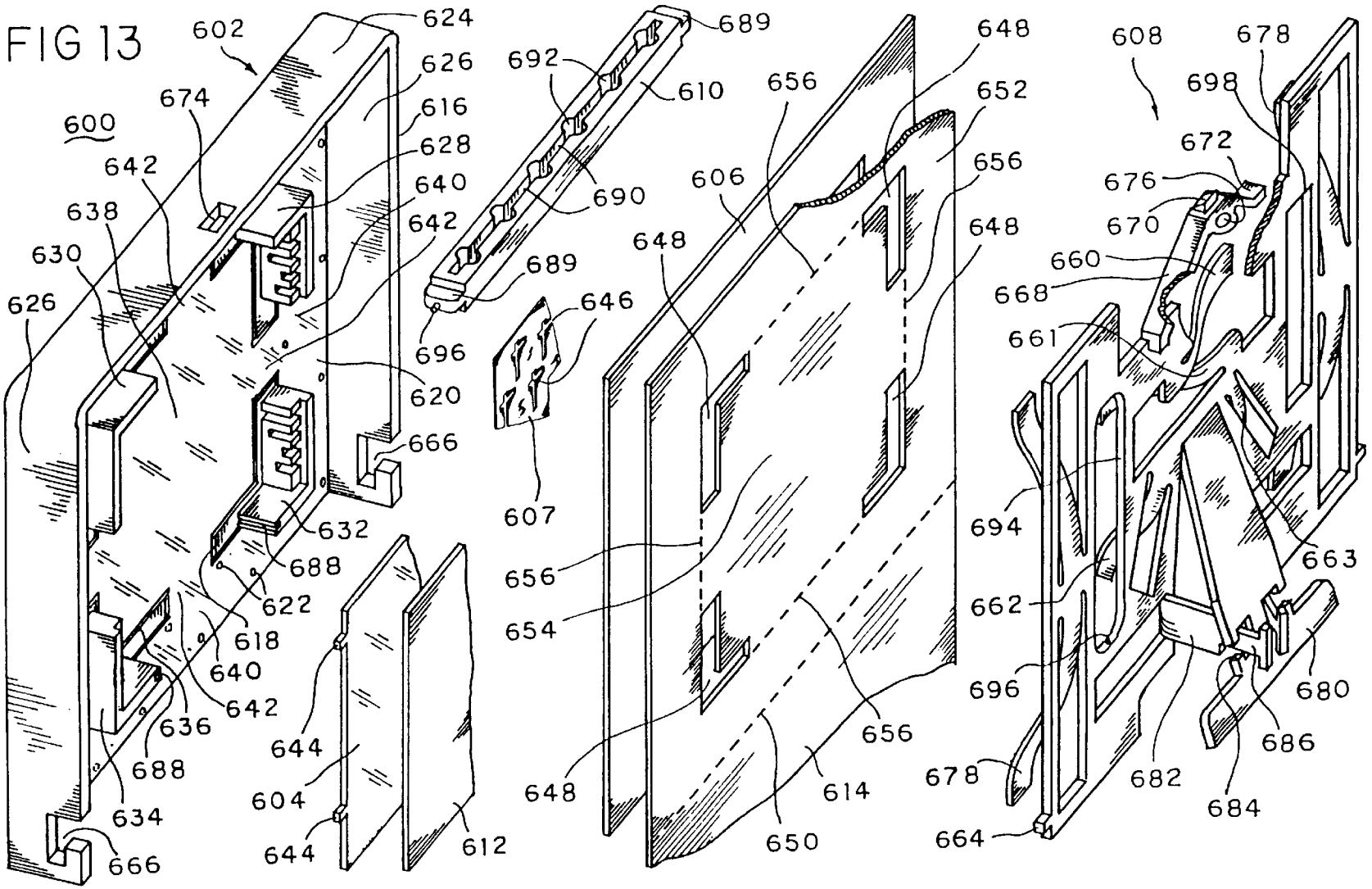
FIG. 13 is a perspective view showing a sixth embodiment of the frame calendar system of the present invention, with parts broken away. A support base shown in this figure is drawn on a larger scale than the rest of the frame calendar system.

FIG. 13 shows a sixth embodiment of the frame calendar system of the present invention. It consists of a frame assembly 600 which may include a frame body 602, glass 604, border sheet 606, border mat 607, back member 608, and support base 610. One custom picture sheet 612 can be optionally mounted. A calendar sheet 614 is also shown as part of the present frame calendar system.

In construction the frame body 602 is similar to the frame body 520 shown in FIGS. 10 and 11. It is assembled by joining an outer frame 616 and an inner frame 618 by a combined window/border glass 620. Small holes 622 are shown on the combined window/border glass 620 into which studs of the outer frame 616 and inner frame 618, not shown, but similar to the studs 530 in FIG. 10, are inserted for the assembly of the frame body 602.

The outer frame 616 consists of a top outer wall 624 and two side outer wall 626. The inner frame 618 has four L-shaped studs 628, 630, 632, and 634 at four corners on the back side of the inner frame 618. Enclosed within these four studs is a frame window 636 through which a custom picture or calendar picture can be displayed. There are four grooves of different depths on each of these studs. These grooves are similar to and serve the same function as the grooves 477 to 492 shown in FIGS. 7 and 8.

The combined window/border glass 620 is a one-piece plate molded from transparent plastics. It consists of a frame window glass portion 638 and a border glass portion 640 interconnected by four connection portions 642. The frame window glass portion 638 is mounted over the frame window 636. Since the border glass portion 640 is firmly attached to the outer frame 616 and the inner frame 618, the frame window glass portion 638 will always remain mounted over the frame window 636.

The mounting of the glass 604 with four unsymmetrical tabs 644 on the frame body 602 at four possible depths is virtually identical to the mounting of the second window glass 410 on the frame body 402 as shown in FIGS. 7 and 8. The supporting of the custom picture sheet 612 on the frame body 602 is achieved simply by resting the bottom edge of the custom picture sheet 612 on the studs 632 and 634.

The border sheet 606 is basically similar to the border sheets 404 and 406 shown in FIG. 7. The border mat 607 is also a kind of border sheet with its size same as that of the border sheet 606. The border mat 607 is made of non-transparent sheets but with many openings 646. These openings 646 are shown in the shape of cross randomly located on the border mat 607. These openings are preferably achieved by laser cutting which is known to make very intricate cut patterns on frame mats.

The border mat 607 and border sheet 606 are mounted together on the frame body 602 and supported by the studs 628, 630, 632 and 634. The border mat 607 is readily visible through the border glass portion 640 of the combined window/border glass 620. The border sheet 606 is mounted behind the border mat 607 and is partially visible through the openings 646 of the border mat 607.

The frame assembly 600 of the present invention may have several border mats with a variety of cut patterns and many border sheets with different contrasting colors. The appearance of the frame assembly 600 can thus be easily changed by the judicious choice of one border mat-border sheet pair to be displayed in complementing the displayed custom picture or calendar picture.

The calendar sheet 614, which is partially shown, has four L-shaped openings 648. It can be mounted on the frame body 602 by inserting the studs 628, 630, 632 and 634 through these openings 648 for the hanging support of the calendar sheet 614. Located on the middle section of the calendar sheet 614 is a perforation line 650. A calendar date table illustration is printed on the calendar sheet 614 beneath this perforation line 650 and is displayed below the frame body 602 when the calendar sheet 614 is properly mounted on the vertically positioned frame body 602.

The calendar sheet 614 above the perforation line 650 is further divided into a border section 652 and a calendar picture section 654 which two are separated by the four openings 648 and four perforation lines 656. A calendar picture illustration is printed on the calendar picture section 654 and can be displayed through the frame window 636 and the frame window glass portion 638 when the calendar sheet 614 is mounted on the frame body 602.

The border section 652 of the calendar sheet 614 is mounted directly behind the border glass portion 640. This border section 652 can have a printed border art pattern which can be displayed to complement the calendar picture on display. After the end of each calendar date table period with a new calendar sheet displayed, not only the calendar picture illustration is changed, the appearance of the frame body 602 will also be changed due to the change of the order section 652 on display.

At the end of the calendar year all the border sections 652 can be saved by tearing it apart from the rest of the calendar sheet 614 along the perforation lines 650 and 656. The saved border sections 652 can be continuously used for display to enhance the appearance of the picture frame and complement the custom picture on display.

The back member 608 is similar to the back member 411 shown in FIG. 7 but with several improvements. It is preferably made of a one-piece molded plastics for reasons to be disclosed below.

Located near the center of the back member 608 are four resilient arms 660, 661, 662 and 663. These resilient arms serve the same purpose as the resilient arms 458 shown in FIG. 7, although somewhat different in their shape.

A tab 664 is located near the bottom of each side of the back member 608. These two tabs 664 are to be engaged with two slot openings 666 on the two side outer walls 626 of the frame body 602.

A spring clip 668 is integrally formed as part of the back member 608. A tooth 670 and a bent end 672 are located on the top of the spring clip 668. This tooth is to be engaged with a slot hole 674 located on the top outer wall 624 of the frame boy 602. A mounting hole 676 is also provided for hanging support of the assembled frame assembly 600.

The spring clip 668 will yield against its spring force when a outside force is applied on the back member 608 during the mounting of the back member 608. It is to be noted that in the present embodiment the yield movement of the spring clip 668 is within a plane in parallel with the plane of the back member 608. In this way, the spring clip 668 will not cause the overall thickness of the back member 608 to be significantly increased.

Also integrally formed on the back member 608 are two spring leaves 678. The centers of these spring leaves 678 are anchored near the sides of the back member 608. Each arm of the spring leaves 678 is projecting away from the front side of the back member 608. The end of each arm is curved backward to form a smooth contacting surface.

After placing all the calendar sheets 614, custom pictures sheet 612 and the associated components the back member 608 can then be installed on the frame body 602. This is achieved by first inserting the two tabs 664 of the back member 608 into the two slot openings 666 of the frame body 602. As the back member 608 is pushed toward the frame window 636 the tooth 676 of the spring clip 668 will be initially stopped at the top outer wall 624. A further push of the back member 608 will cause the spring clip 668 to yield downward and the slant surface of the tooth 670 to slide along the lower back edge of the top outer wall 624 until the upper edge of the tooth 670 clears this edge. The tooth 670 will continue move forward until it drops into the slot hole 674 and locks the back member 608 to the frame body 602.

As the back member 608 is installed in the frame body 602 the resilient arms 660, 661, 662 and 663 will be in contact with the custom picture sheet 612 or the calendar sheet 614. The spring leaves 678 will also be in contact with either the border section 652 of the calendar sheet 614 or the border sheet 606. Depending on the number of sheets installed in the frame body 602 both the resilient arms 660, 661, 662, 663 and the spring leaves 678 will be deformed to a various degree. The spring force in the deformed resilient arms 660, 661, 662 and 663 will continuously urge the custom picture sheet 612 and/or the calendar picture section 654 of the calendar sheet 614 against the frame window 636. At the same time the spring force in the deformed spring leaves 678 will continuously urge the border mat 607, border sheet 606 and/or border section 652 against the border glass portion 640 of the combined window/border glass 620. All the calendar sheets 614 and custom picture sheet 612 will be properly mounted regardless of the number of sheets installed up to the capacity of the frame body 602.

It is interesting to point out that the resilient arms 660, 661, 662 and 663 are operated independent from the spring leaves 678. This is important since the four resilient arms must be able to yield in responses to the changing position of the glass 604 without affecting the operation of the spring leaves 678.

The removal of the back member 608 is achieved by first pressing down the bent end 672 of the spring clip 668 to release the tooth 670 from the slot hole 674 of the frame body 602. At this time the stored spring force in the resilient arms 660, 661, 662, 663 and the spring leaves 678 will automatically push back the back member 602 away from the frame body 602 thus facilitating the disengagement of the spring clip 668. The back member 608 is next lifted to remove the tabs 664 away from the slot holes 666.

Also molded on the back member 608 are a easel plate 680 and two easel arms 682. One end of each of the easel plate 680 and the easel arms 682 is pivotally connected to the rest of the back member 608. When the frame assembly 600 is supported in a vertical hanging position the casel plate 680 and the easel arms 682 are not needed and remain in its natural position within the plane of the back member 608.

After the calendar year when the frame assembly 600 is converted to a picture frame it is sometimes desirable to position the picture frame on a table in an upright position supported by the easel plate 680. This can be easily achieved by pulling one end of the easel plate 680 away from the plane of the back member 608 thus forming one additional leg for the support of the picture frame in a upright and somewhat tilted position.

The easel arms 682 can also be optionally used to lock the easel plate 680 in an extended position. As seen in FIG. 13 the easel plate 680 has two slots 684 with their shape as shown in the figure. Each of the easel arms 682 has a narrow section 686 which can be momentarily twisted to make entry into the slots 684. After both narrow sections 686 of the easel arms 682 become engaged with the slots 684 the easel plate 680 will be held in the extended position indefinitely.

When the easel plate 680 is not needed for the support of the frame assembly 600 the easel arms 682 can be disengaged from the easel plate 680 by removing the narrow sections 686 out of the slots 684. The easel plate 680 and the easel arms 682 are then restored to their original positions with the plane of the back member 608.

For most conventional picture frames the easel is a piece attached to the back of the back member. This makes the overall thickness of the combined back member/easel uneven. When a picture frame with such combined back member/easel is hung on a vertical wall the frame very often can not be evenly positioned.

On the other hand, in the present invention in which the easel is made part of the back member as a one-piece molded plastics, no such unevenness due to the presence of the easel plate 680 and the easel arms 682. The frame assembly 600 will always be hung evenly without the interference of the easel. Of course, by making the back member-easel a one-piece molded plastics considerable cost saving can also be achieved over the conventional approach.

Also shown in FIG. 13 is the support base 610 which is drawn in enlarged scale to show its details. It can be mounted on the frame body 602 for the support and display of a three dimensional object in the space between the frame window glass portion 638 and the glass 604 when the glass 604 is mounted in a spaced apart position.

As shown in FIG. 13 a horizontal groove 688 is provided at the bottom edge of each of the studs 632 and 634. An end insert 689 is shown on each end of the support base 610. The support base 610 can be mounted by sliding the end inserts 689 into the horizontal grooves 688 and be positioned between the frame window glass portion 638 and the glass 604.

A slot 690 nearly running the entire length of the support base 610 is provided on the support base 610. A total of six holes 692 are also shown in the support base 610. Both the slot 690 and the holes 692 can be used for the support of a three-dimensional article to be displayed.

The ability of spaced apart mounting of the glass 604 and the provision of the support base 610 opens up a new use for the frame assembly 600 of the present invention. It allows a three-dimensional article to be displayed along with the display of a custom picture or calendar picture. The custom picture or calendar picture can be a narrative or background picture complementary of the three-dimensional article on display. Several example illustrating the use of the support base 610 will be described below.

In the present invention the support base 610 is made part of the back member 608. In the plastic molding process the support base 610 is molded within an opening 694 and separated from the rest of the back member 608 except for two runners 696 located on the two opposite ends of the opening 694. The support base 610 is carried by the back member 608 when not in use.

The support base 610 can be easily broken away from the rest of the back member 608 by breaking the two runners 696. Once removed the support base 610 can be readily slid into the horizontal grooves 688 and be used for the support of a three-dimensional article to be displayed in the frame assembly 600.

As shown in FIG. 13 an opening recess 698 is also formed in the back member 608. This opening recess 698 is an rectangular opening. The width of this rectangular opening is slightly wider than the width of the support base 610. The length of this rectangular opening is about the same as that of the support base 610 not including the two end inserts 689.

At a later date when the support base 610 is no longer needed and is removed from the horizontal groves 688 the support base 610 can be stored in the back member 608. This is achieved by pushing the support base 610 into the opening recess 698. The upper part of the support base 610 will be lodged into the opening recess 698 and held in place by friction between the support base 610 and the 698.

By making the support base 610 part of back member 608 and providing a storage place in the back member 608 achieve one important advantage. The support base 610 is always securely stored when not in need and is readily available when needed. Of course by making it part of the back member 608 will also greatly reduce the production cost over making one support base separately.

FIGS. 14–15

Figure 14:
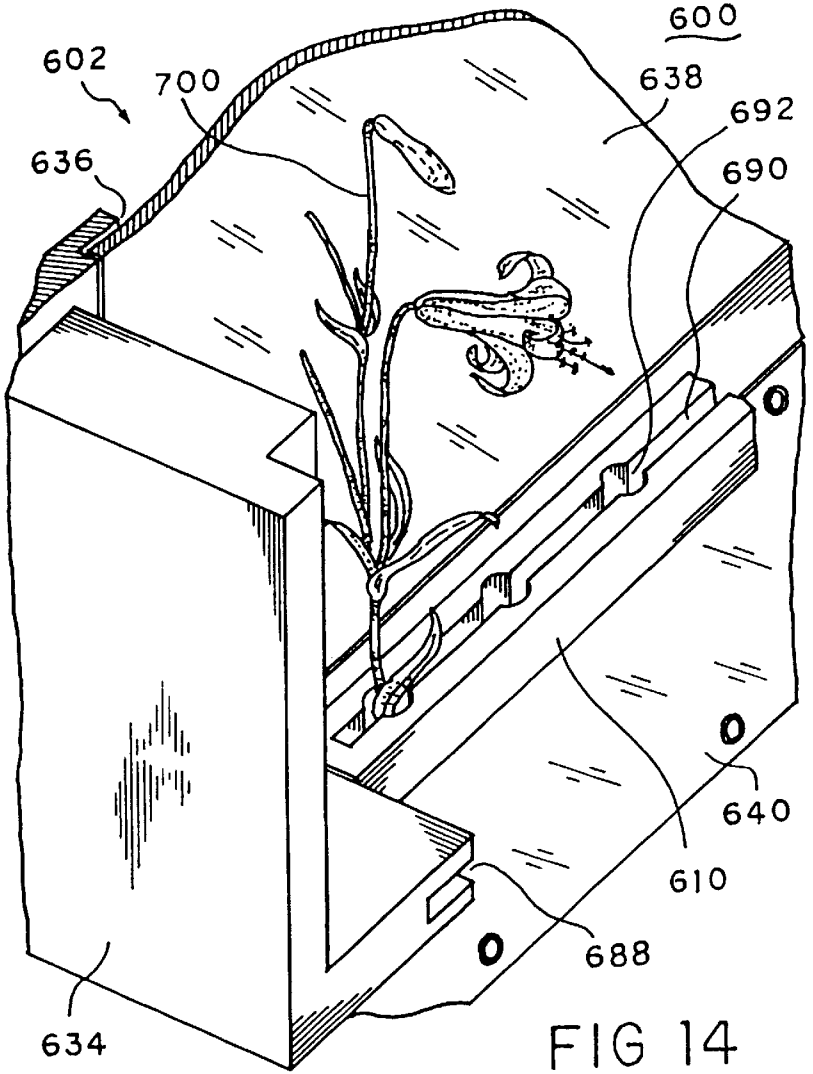
FIG. 14 is a perspective view showing a portion of a frame assembly of FIG. 13, drawn on a larger scale than FIG. 13, illustrating the use of a support base for supporting a dried flower for display in the frame assembly.

FIG. 14 shows, in enlarged scale, a portion of the frame assembly 600 of FIG. 13 for illustrating the use of the support base 610 for supporting a three-dimensional article to be displayed in the frame assembly 600 along with a custom picture or calendar picture. It is seen in FIG. 14 that the support base 610 is removably mounted on the stud 634 of the frame body 602. Its position in the frame body 602 can be adjusted by sliding the base insert 610 along the horizontal grooves 688 of the studs 634 and 632.

Also shown in FIG. 14 is a dried flower 700 with its stem inserted into one hole 692 of the support base 610. A custom picture sheet or calendar picture sheet portraying a garden scene, not shown, can be mounted in a manner previously described. This picture of garden will then be displayed along with the dried flower 700 through the frame window 630 and the frame window glass portion 638 of the combined window/border glass 620.

Figure 15:
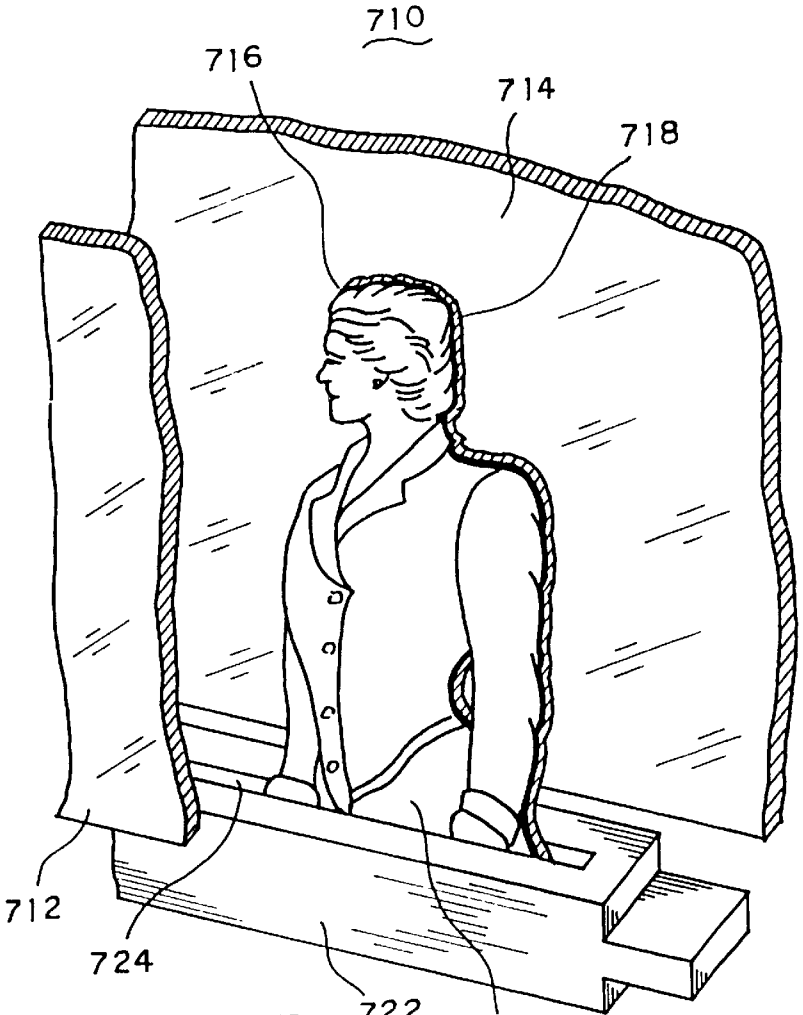
FIG. 15 is a perspective view showing a portion of a frame assembly of the present invention, illustrating the use of a support base for supporting a reinforced laser-cut picture mounted in the frame assembly.

FIG. 15 shows a portion of a frame assembly 710 which may be similar to the frame assembly 401 of FIG. 7 or the frame assembly 600 of FIG. 13. This frame assembly 710 may include a front window glass 712 and a back window glass 714 mounted in a spaced apart relationship.

Also shown in FIG. 15 is a reinforced picture 716 which is placed in the space between the front window glass 712 and the back window glass 714. This reinforced picture 716 is made by adhering a reinforcement board 718 to a photograph 720 or any other suitable means. The cutting of the reinforced picture 716 to an intricate shape is typically achieved by laser cutting known in the prior art.

The next item to be described is a support base 722 which is similar to the support base 610 of FIG. 13 and is removably mounted as part of the assembled frame assembly 710. This support base 722 has a slot 724 which is specially designed for holding the reinforced picture 716 in an upright position as shown by firmly inserting the reinforced picture 716 into the slot 724.

A calendar sheet containing a scenery calendar picture illustration, not shown, may be removably mounted behind the back window glass 714 in a manner previously described. In the present arrangement the scenery calendar picture suddenly becomes the background scene to the reinforced picture 716 which is also on display. This is an interesting way to add a personal touch to a commodity calendar supplied by the manufacturer.

It is noted that the reinforced picture 716 is displayed in front of the scenery calendar picture and separated from it by the back window glass 714. This creates a three-dimensional effect which considerably enhances the aesthetic value of the calendar presentation.

At the end of the calendar date table period when a new calendar sheet is displayed, the scenery calendar picture illustration on this new calendar sheet again becomes the background scene to the same reinforced picture 716.

Many interesting three-dimensional picture frame presentation can also be made by displaying a custom picture behind the back window glass 714 along with a reinforced picture displayed on the foreground. For example, the reinforced picture may show a father playing ball with his little boy while the custom picture shows a home backyard with mother sitting and watching.

In the presentation shown in FIGS. 14 and 15 a three-dimensional article is displayed along with a calendar sheet or custom picture sheet which is placed behind and separated from the article by the glass 604 or 714. With the frame assembly of the present invention it is also possible to display a three-dimensional article and a custom picture in a new way described below. In this way the three-dimensional article is "blended" in the custom picture thus producing an interesting three-dimensional effect.

Before installing the three-dimensional article and the custom picture in the frame assembly 600, the first step to be taken is to decide the depth of the field desired. Here the depth of the field is defined as the distance between the combined window/border glass 620 and the glass 604. The desired depth of the field can be chosen by properly orienting the glass 604 during its entry into the frame body 602 as discussed above and shown in FIG. 8.

The picture to be displayed is cut to a size with its width and height larger than the width and height of the frame window 636 by approximately twice the depth of the field, respectively. A square is cut off from each of the four corners of the picture. The length of each side of this square approximately equals to the depth of the field. This will produce a picture with four flaps. These four flaps can be folded up loosely while allowing the printing on the picture including all four flaps visible.

A three dimensional article can be glued to the bottom flap. Now the custom picture with the article can be installed in the frame body 602. The glass 604 is next installed. This is followed by the installation of the calendar sheet 614, if needed, and the back member 608.

After the installation, the custom picture and the article are firmly held between the combined window/border glass 620 and the glass 604 in the frame body 602. Both the article and the custom picture are displayed through the frame window 636. Since the article is glued to the bottom flap which is also part of the custom picture a three-dimensional effect is thus created.

For article not readily supportable by the custom picture the support base 610 can also be used for the support of such article. Obviously, a feed through hole or clearance is required on the bottom flap for such installation.

FIGS. 16–21

FIGS. 16 to 19 disclose another type of support base for supporting a toy building block assembly and for displaying the toy building block assembly along with a custom picture or calendar picture.

Toy building blocks are widely known prior arts. Once the assembling of the toy building blocks is completed it is often desirable that the toy building block assembly be placed in a display case for later viewing. It is also desirable that the display of the toy building block assembly be accompanied by the display of a picture complementary to the toy building block assembly. The frame calendar system of the present invention along with the support base shown in FIGS. 16 and 17 elegantly accomplishes all these goals at low cost.

Shown in FIGS. 16 and 17 is a support base 730 which can be removably installed in a frame body 731, not shown, but can be similar to the frame body 602 of FIG. 13. Also shown in FIG. 16 is a toy building block assembly 732 resembling a horse.

Shown in FIGS. 17, 18, and 19 are two commonly known toy building blocks 734 and 735. The first toy building block 734 generally has a shape of a rectangular block with a top wall 736 and four side walls 738. Two cylinder studs 740 are integrally formed on the outside surface of the top wall 736. An internal stud 742 is integrally formed on the inside surface of the top wall 736.

As seen in FIG. 17 numerous cylinder studs 744 are integrally formed on the top side of the support base 730. The size of each cylinder stud 744 are the same as that of the cylinder studs 740. The spacing between any two adjacent cylinder studs 744 are the same and equal to the spacing between the two cylinder studs 740 of the block 734.

The second toy building block 735 is twice as large as the first building block 734. It has a square top wall 748 and four identical side walls 750. Four cylinder studs 752 are integrally formed on the outside surface of the top wall 748. One internal stud 754 is integrally formed on the inside surface of the top wall 748.

As shown in FIG. 17 the first toy building block 734 can be mounted on the support base 730 with two adjacent cylinder studs 744 of the support base 730 inserted into the cavity formed by the side walls 738 and the internal stud 742 of the toy building block 734. Similarly, the second toy building block 735 can be mounted on the support base 730 with four adjacent cylinder studs 744 of the support base 730 inserted into the cavity formed by the side walls 750 and the internal stud 754 of the toy building block 735.

Toy building blocks with sizes multiples of that of the toy building block 735 can also be similarly constructed as known in the prior arts. These blocks and the toy building blocks 734 and 735 can be assembled into a toy building block assembly 732 as shown in FIG. 16 or many other interesting figures.

The mounting of the toy building block assembly 732 on the support base 730 is achieved by simply engaging all toy building blocks 756 at the bottom of the toy building block assembly 732 with the corresponding cylinder studs 744 of the support base 730.

Once mounted, the support base 730 with the installed toy building block assembly 732 can be placed in the frame body 731 in a manner similar to the placement of the support base 610 in the frame body 602 of FIG. 13. A glass similar to the glass 604 of FIG. 13 can then be loaded. This is followed by the mounting of a complementary custom picture sheet or calendar sheet.

For a frame calendar having 12 monthly calendar picture illustration, one unique toy is building block assembly can be designed for each calendar sheet. For example, in one month an instruction is given for making an toy building block assembly resembling a sport car, the calendar picture to be displayed can be a computer graphics-generated scene showing a desert road loading the toy sport car to a distant magic kingdom. In another month when the assembled toy building block is to be a dinosaur the accompanied background calendar picture can show a jungle with many contemporary animals.

In the above description, a novel frame calendar system with support base is disclosed for serving as a display case for a well-known toy, toy building block assembly. Furthermore, this frame calendar system allows a calendar picture complementary to the toy building block assembly to be displayed each month along with the toy building block assembly. Both the calendar picture and the toy building block assembly are displayed simultaneously through a frame window of the frame calendar system. At the same time a calendar date table illustration is exposed outside the frame window to facilitate calendar date checking and memorandum writing.

After the calendar year with all the calendar sheets removed, the frame body 731 can be converted for storing and displaying custom picture sheets. A new toy building block assembly can be constructed and displayed along with a custom picture sheet. As taught in the present disclosure this custom picture sheet can also be displayed during the calendar year if desired.

FIG. 20 shows the same toy building block assembly (toy horse) 732 mounted on the support base 730 as in FIG. 16. This figure also shows a paper figure toy 760 resembling a boy riding on the toy horse 732. The addition of this paper figure toy 760 will undoubtedly make the overall display much more interesting.

The paper figure toy 760 can be made of paper or any suitable sheet materials printed with desired image. It is folded into two halves 762 and 764, not shown, along a crease line 765. Each of these halves bears an image of a boy riding on the toy horse 732.

There are two attachment members 766 and 768 on each of the halves 762 and 764. These attachment members are engageable with the toy building block assembly 732 to allow the paper figure toy 760 to be firmly mounted on the toy horse 732.

The two attachment members 766 and 768 of the first half 762 are located near the boy's hand 770 and the lower corner of the boy's coat 772, respectively. The two attachment members 766 and 768 of the second half 764 are also similarly located.

The details of the attachment member 768 is shown in FIG. 21. This attachment member 768 is a flap adjacent the coat 772. It is folded at right angle to the coat 772 as shown. There are two holes 774 on this attachment member 768.

It is assumed that the construction of the toy horse 732 starts at the bottom. The mounting of the attachment member 768 will take place after a toy building block 776, which is to be placed with the attachment member 768, is just assembled. As shown in FIG. 21 the mounting of the attachment member 768 is done simply by inserting two cylinder studs 778 of the block 776 through the holes 774 of the attachment member 768. The attachment member 768 of the second half 764 is also similarly mounted at this time by engaging it with two cylinder studs 782 of the block 776. Another block 784 to be assembled on the top of the block 776 is then mounted. This will firmly hold the two attachment members in place between the two adjacent blocks 776 and 784.

The two attachment members 766 are later mounted similarly as the assembling of the toy horse 734 progresses. Once the entire assembling is completed the paper figure toy 760 will be solidly built into the toy horse 732 and not separable until the toy horse 732 is disassembled.

In order to enhance the appearance of an toy building block assembly some plastic figures can be made and added to the assembled toy building block as known in the prior arts. In these prior arts, such plastic figures normally can only be added to the assembled toy building blocks after the assembling process is completed. It do not have attachment members of the present invention which can be sandwiched between two adjacent toy building blocks during the assembling of the toy building blocks.

The incorporation of one or more attachment members of the present invention in a paper figure toy or any paper ornaments allows a paper ornament to be easily assembled into the toy building block assemblies. Such paper ornaments can be mass produced at low cost. The use of paper ornaments with attachment members is most beneficial when the final assembly is to be installed in the frame assembly of the present invention. In this case the paper ornament, in spite of its fragile nature, is well protected and less prone to damage during the display.

FIGS. 22–25

FIGS. 22 to 25 disclose a novel support assembly that can be installed in a frame assembly of the present invention for the support and display of small articles such as rare coins, sea shells, jewelry, etc. This support assembly is assembled by linking three or more rigid support members. Each of these rigid support members has at least one insertion element and one receiver element. The insertion element of a first rigid support member is removably engageable with the receiver element of a second rigid support member. At the same time the receiver element of the first rigid support member is also removably engageable with the insertion element of a third rigid support member. In this way the three rigid support member are joined together to form a rigid support assembly.

Each rigid support member also has support surface for the support and display of small articles. It is also desirable that specially designed support means be provided on the rigid support members for securing the small articles in place.

When three or more rigid support members are joined together to form the support assembly this support assembly will be capable of supporting and displaying many small articles in the frame assembly in which a calendar picture or custom picture is also to be displayed. The size and shape of the support assembly can be varied at will to allow each displayed article to be positioned at any chosen location adjacent the scene or narrative in the displayed calendar picture or custom picture that complements the article.

Figure 22:
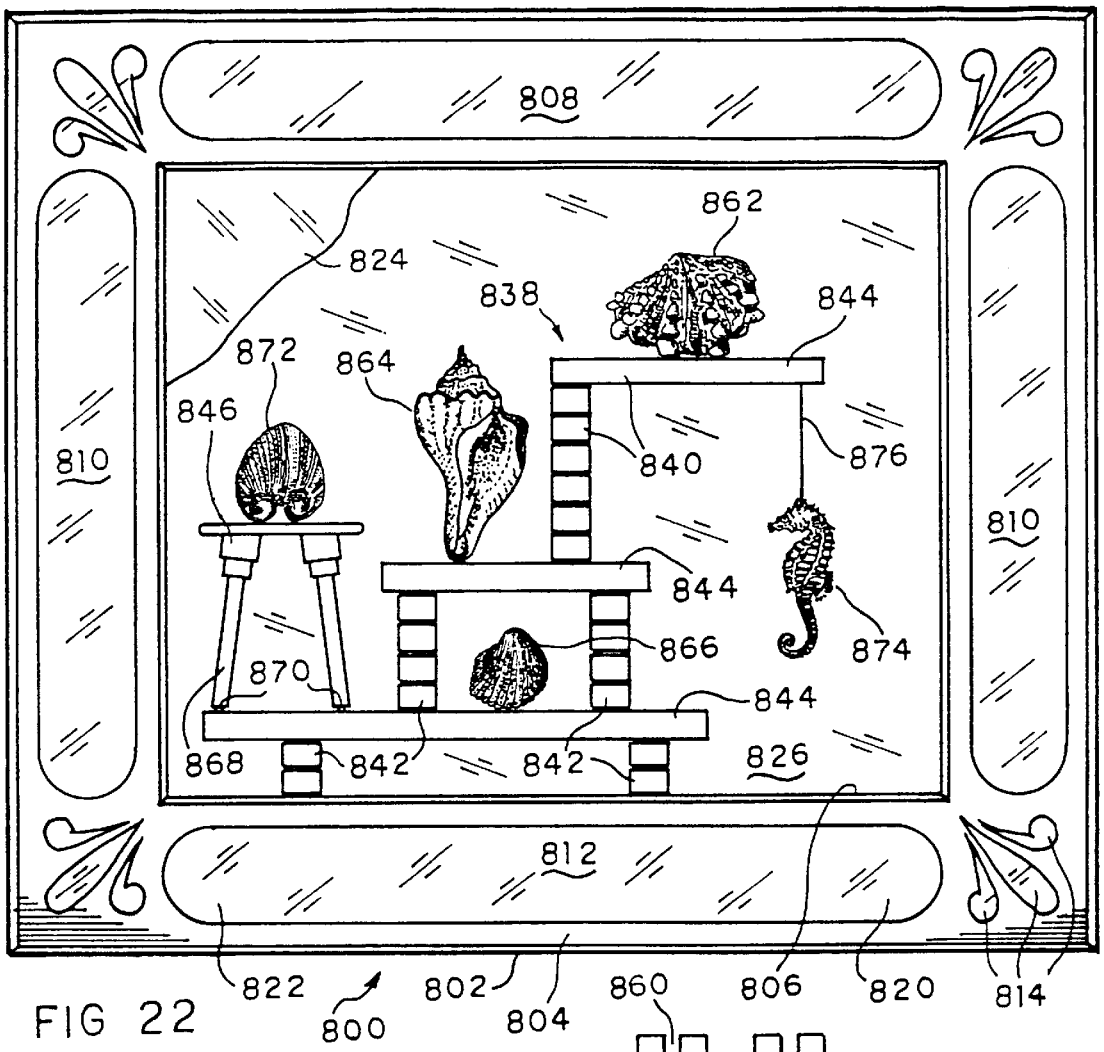
FIG. 22 is an elevational view showing a seventh embodiment of the frame calendar system of the present invention. Also shown in this figure is a support assembly of the present invention for the support of small articles in the frame assembly of the present frame calendar system.

For purpose of illustration FIG. 22 shows a seventh embodiment of the frame calendar system of the present invention. It includes a frame assembly 800 which initially serves to support a calendar of the present invention. After the calendar year this frame assembly 800 can be converted to a picture frame and picture storage device. Furthermore, this frame assembly 800 will also serve as a display case for the mounting of the support assembly of the present invention.

The first element of the frame assembly 800 is a frame body 802. The front portion of this frame body 802 is similar to the frame body 502 of FIG. 9. It has a frame border 804 which encloses a frame window 806. A top border window 808, two side border windows 810 and a bottom border window 812 are formed in the frame border 804. Four corner border windows 814 are also provided on the four corners of the frame border 804 to further enhance the appearance of the frame body 802.

The back side of the frame boy 802 can be constructed largely similar to that of the frame body 402 shown in FIG. 7. This frame body 802 may have an outer wall 816 and an inner partitioning wall 818, both not shown, but can be similar to the outer wall 418 and inner partitioning wall 423, respectively, of the frame body 402 as shown in FIG. 7.

A border glass 820 is provided and placed behind the frame body 802 and between the outer wall 816 and the inner partitioning wall 818. One or more border sheets 822 similar to the border sheets 404 and 406 of FIG. 7 are also provided which can be loaded behind the border glass 820 and be visible through all border windows 808, 810, 812 and corner border windows 814.

A first window glass 824 is partially shown in FIG. 22. It is firmly mounted on the frame window 806 by friction or other suitable means. A second window glass 826 is mounted behind and spaced apart from the first window glass 824. This can be achieved by resting the second window glass 826 against a counter step 828, not shown, which can be similar to the counter step 475 of the frame body 402 shown in FIGS. 7 and 8. Of course, the space between the first window glass 824 and the second window glass 826 can also be made adjustable by providing a plurality of grooves on the inner partitioning wall 818 in a manner similar to what described above. The provided space will serve to accommodate the support assembly to be described below.

The inner partitioning wall 818 may have two coplanar inner bottom walls 830, not shown, which may be similar to the inner bottom walls 428 of the frame body 402 shown in FIG. 7. A horizontal groove 832, not shown, is provided on the edge of each inner bottom wall 830, in the same manner as the horizontal grooves 688 on the studs 632 and 634 shown in FIG. 13.

A support base 834, not shown, is also provided as part of the frame assembly 800. Numerous cylinder studs 836, not shown, are integrally formed on the top side of the support base 834 in the same manner as the cylinder studs 744 on the support base 730 shown in FIG. 17. The support base 834 can be slid into the horizontal grooves 832 and be supported similar to the mounting of the support base 610 in the horizontal grooves 688 of the frame body 602 as shown in FIG. 14.

Also shown in FIG. 22 is a support assembly 838. This support assembly 838 is assembled from numerous rigid support members 840 which may include support building blocks 842, support building plates 844 , and a miniature table 846, all of which are shown in FIG. 22.

As shown in FIG. 22 the support building blocks 842 serve as the foundation to the present support assembly 838. Each of these support building blocks 842 may have four cylinder studs 848, not shown, and one internal stud 850, also not shown, similar to the cylinder studs 752 and the internal stud 754, respectively, provided in the toy building block 735 shown in FIGS. 17 and 19. This will allow the support building blocks 842 to be anchored to the support base 834 in the same manner as the mounting of the toy building block 735 on the support base 730 shown in FIG. 17. Several such support building blocks 842 can be assembled into a stack of any desired height as shown in FIG. 22.

In the present invention each of the four cylinder studs 848 is considered as an insertion element. These insertion elements are removably engageable with a second support building block above it by inserting the cylinder studs 848 into the cavity around the internal stud 850 of the second support building block. In this case the cavity is considered as a receiver element.

Figure 23:
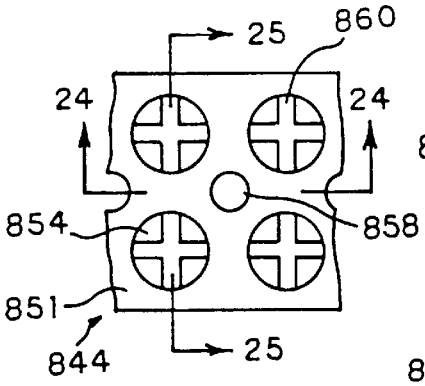
FIG. 23 is a top view showing a portion of a support building plate of the support assembly of FIG. 22.
Figure 24:
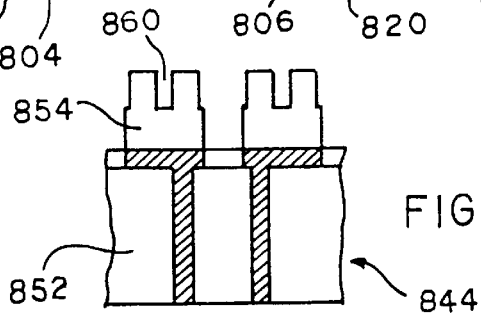
FIGS. 24 and 25 are sectional views of the support building plate of FIG. 23, taken substantially on lines 24—24 and 25—25 of FIG. 23, respectively.
Figure 25:
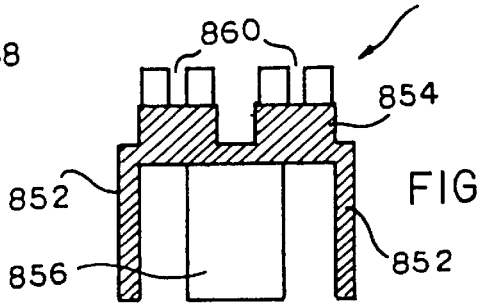

FIGS. 23, 24, and 25 show in detail, a portion of the support building plate 844. This portion is shown consisting of a top wall 851, two side walls 852, four top cylinder studs 854 and one bottom cylinder stud 856, integrally formed together.

In addition to the above-mentioned components, several more provisions are provided on the support building plate 854. One such provision is a feed through hole 858 located on the top wall 851. The other provision is a cross slot 860 on the top of each top cylinder stud 854.

The mounting of a support building plate 844 on a support building block 842 is achieved by inserting the cylinder studs 848 of the support building block 842 into the space between the side walls 852 and the bottom cylinder stud 856 of the support building plate 844. In this case the cylinder studs 848 are insertion elements while the space between the side walls 852 and the bottom cylinder stud 856 is the receiver element. Once mounted on the support building block 842, the support building plate 844 will serve two important functions. The first function is to allow for the mounting of other rigid support members 840. The second function is for the placement of small articles to be displayed.

As shown in FIG. 22 three sea shells 862, 864 and 866 are placed on the three support building plates 844. For simplicity, these sea shells can be simply laid on the top surface of the support building plates 844. However, for the sake of security, it is recommended that each sea shell be placed by inserting a portion of the sea shell into the space between two or more adjacent top cylinder studs 854.

The support building plate 844 of the present invention is also suitable for the support and display of many other collectible articles. A collectible coin can be inserted into a slot of the cross slot 860 of the top cylinder stud 854 and be displayed. A plate type item can be inserted into several such slots on adjacent top cylinder studs 854. A collectible pen can be inserted into one feed through hole 858 of the support building plate 844. A pearl can be placed on the center cavity of the cross slot 860. A gold chain can be hung around one top cylinder stud 854 and displayed.

The cross slot 860 and the feed through hole 858 of the support building plate 844 are specially designed support means for securing the small articles in place. Similar support means can also be provided on the support building blocks 842 and the miniature table 846.

The miniature table 846 is a one-piece molded plastics or ceramics. It has two or more legs 868. Integrally formed at the bottom end of each leg 868 is a small stud 870. These studs 870 can be inserted into the center cavity of the cross slot 860 for the support of the miniature table 846 on the support building plate 844.

Receiver elements, not shown, can be formed on the top of the miniature table 846. These receiver elements can be used to receive insertion elements of more support building blocks 842 to expand the present support assembly 838, if desired. A sea shell 872 is shown rest on the miniature table 846.

The miniature table 846 is very functional in serving its purpose of supporting a small article for display. But such a support structure can be made into any artistic shape for enhancing the overall appearance of the frame display. For example, a miniature figurine can be made showing a person holding a tray. This figurine can then be installed on the support building plate 984 with the tray holding a small article for display. Of course insertion elements and receiver elements can also be provided on the figurine to make it part of the support assembly.

Also shown in FIG. 22 is a sea horse 874 which is held in suspension by a flexible wire or string 876. The string 876 is shown tied to the support building plate 844. This string 876 is not considered as a rigid support member of the present support assembly 838.

One great virtue of the support assembly 838 of the present invention is its versatility. It can be assembled from only a few pieces of rigid support members 840 for holding just one or two articles. It can also be assembled by as many pieces of rigid support members 840 as possible within the frame body 802. Its shape can also be varied to adapt to the articles on display.

In summary, a novel support assembly is disclosed which is assembled from several rigid support members for the support and display of small collectible articles. This support assembly is removably mountable in a frame assembly of a frame calendar system. A complementary custom picture or calendar picture can also be mounted in the frame assembly behind the support assembly. This allows both the collectible articles and the complementary custom/calendar picture to be displayed simultaneously through the frame window of the frame assembly.

FIGS. 26–29

FIGS. 26 to 29 disclose several other types of novel support members of the resent invention. Each of these support members is not intended to form a support assembly as discussed above, but is individually mountable in a frame assembly of the present invention for the support and display of a small article. This article is also displayed along with a complementary custom picture or calendar picture mounted in the same frame assembly.

Figure 26:
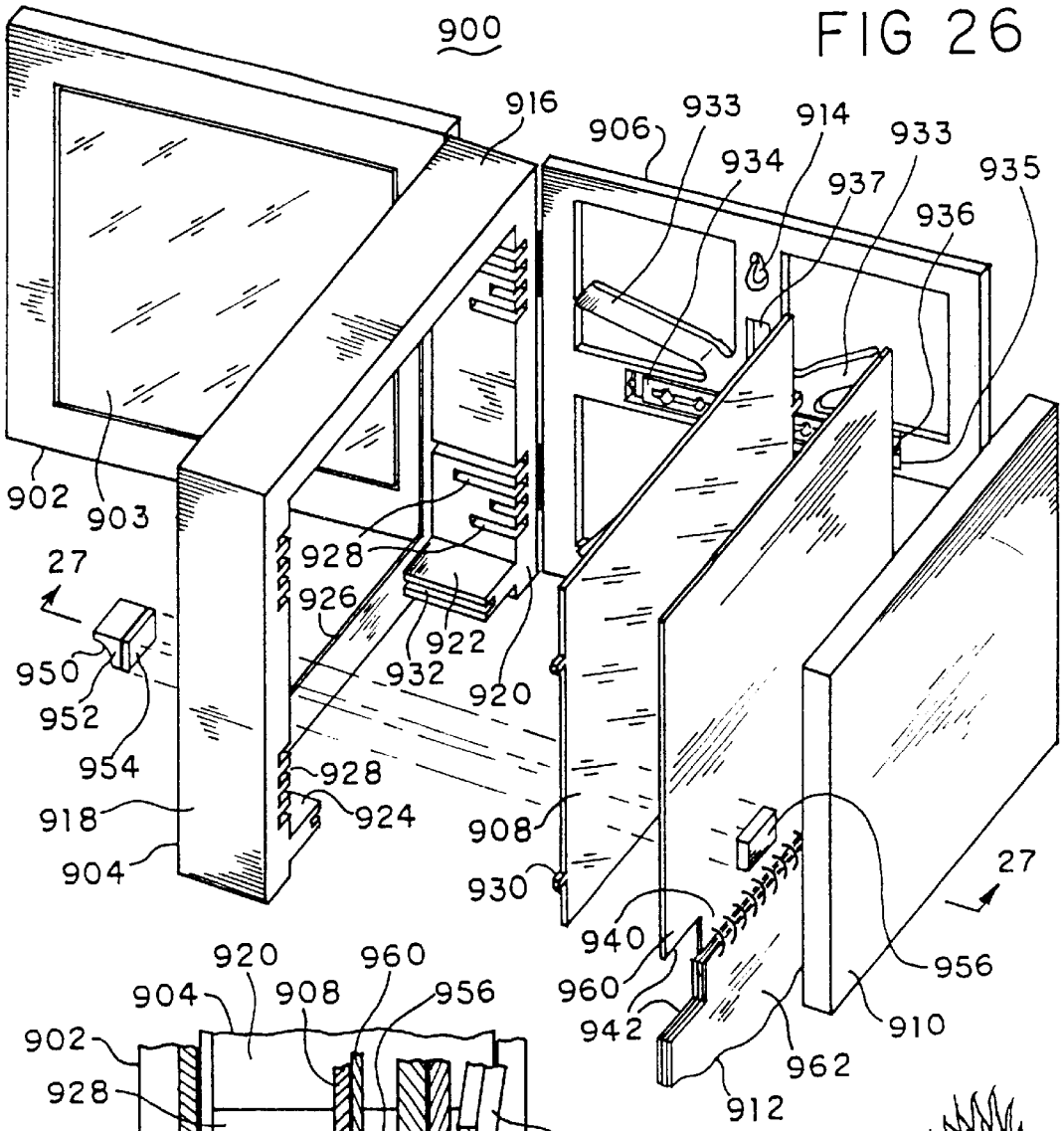
FIG. 26 is a perspective view showing an eighth embodiment of the frame calendar system of the present invention.
Figure 27:
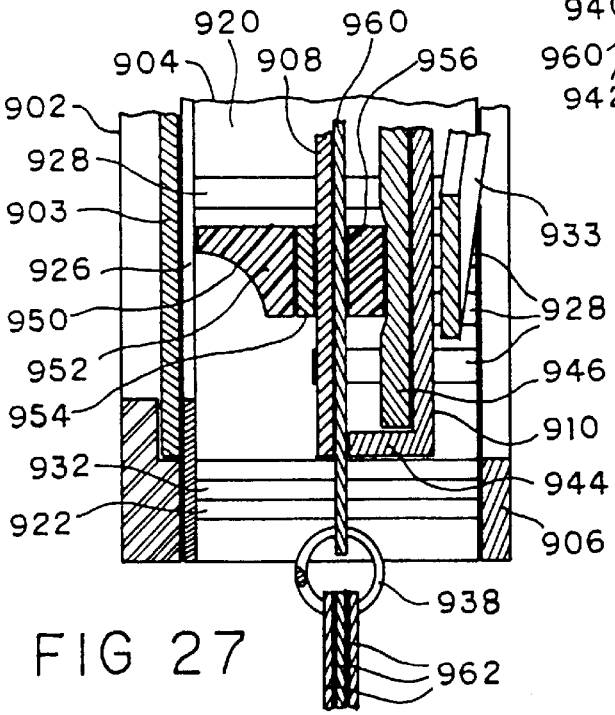
FIG. 27 is an enlarged fragmentary sectional view of a portion of the frame calendar system of FIG. 26 after assembling, taken substantially on a vertical plane containing the line 27—27 of FIG. 26.

FIGS. 26 and 27 show an eighth embodiment of the frame calendar system of the present invention. It consists of a frame assembly 900 which may include a frame body 902, first window glass 903, middle section 904, back casing 906, second window glass 908 and back member 910. A calendar 912 which is in the book from is also included in the present system.

The frame body 902 can be made of any conventional frame materials. The middle section 904 and the back casing 906 are preferably made of molded plastics. As seen in FIG. 26 the frame body 902 and back casing 906 are hinged on and rotatable with respect to the middle section 904. Latches and catches, not shown, but can be similar to the latch 136 and catch 138 shown in FIG. 2, are provided for individually locking the frame body 902 and back casing 906 to the middle section 904 in closed positions as shown in FIG. 27.

One or more mounting holes 914 are provided on the back casing 906 for mounting the back casing 906 on a vertical wall. When so mounted both the middle section 904 and frame body 902 are each rotatable with respect to the back casing 906.

The front side of the frame body 902 is not shown but can be of any conventional design as desired. The first window glass 903 is permanently mounted over the frame window of the frame body 902.

The middle section 904 is similar to the portion of the frame body 402 bounded within the inner partitioning wall 423 as shown in FIG. 7. This middle section 904 consists of a top wall 916, two side walls 918 and 920, and two coplanar bottom walls 922 and 924. Surrounded by all these walls is a frame window 926.

Just as what shown in FIGS. 7 and 8 and described above, there are a total of sixteen grooves 928 of different depths carved on the inside surface of the side walls 918 and 920. These grooves allow the second window glass 908 with four unsymmetrical tabs 930 to be positioned at four different depths depending on the orientation of the entry of the second window glass 908. Each of the two coplanar bottom walls 922 and 924 has a horizontal groove 932 which is similar to the horizontal grooves 688 shown in FIG. 13.

There are four resilient arms 933 integrally formed on the back casing 906. These resilient arms 933 are similar to the resilient arms 458 shown in FIG. 7 and serve to urge the mounted calendar 912 against the frame window 926 when the back casing 906 is locked to the middle section 904 in the closed position.

As shown in FIG. 26, a support base 934 is molded as part of the back casing 906. This support base 934 is housed within an opening 935 and separated from the rest of the back casing 906 except for two runners 936 located on the two opposite ends of the opening 935. An opening recess 937 is also shown on the back casing 906 for storing the support base 934 once it is removed from the opening 935 and not in use.

The calendar 912 is bonded into a book with the use of a spiral ring 938. Except for the covers each calendar sheet is presented with a calendar data table illustration on one side and a calendar picture illustration on the other side. Similar to the calendar book 414 of FIG. 7 each calendar sheet of the calendar 912 is also formed to have a lip 940 to accommodate the spiral ring 938 and two steps 942 for engagement with the bottom walls 922 and 924 when the calendar 912 is mounted on the middle section 904.

The back member 910 is a molded plastic rectangular plate with four shallow walls 944 on its four sides. A resilient pad 946 is glued to the inside surface of the back member 910 as shown in FIG. 27. This resilient pad 946 can be made of rubber or soft resilient foam that can yield under pressure and restore to its original shape once the pressure is removed.

The frame assembly 900, in addition to being a calendar frame, picture frame and picture storage device, will also serve as a display case for the support members of the present invention. A support member 950 is shown in FIGS. 26 and 27. This support member 950 includes a molded support piece 952 and a magnetic plate 954. The molded support piece 952 is preferably molded from plastics. It has a flat top for holding any suitable article to be displayed in the frame assembly 900. Any support means such as holes, slots, etc. can also be molded on the support piece 952 for securing the article in place.

The magnetic plate 954 is attached to the back of the molded support piece 952. This magnetic plate 954 can be an iron plate, which is strongly magnetic, or can even be a magnet by itself. A thin coating can be applied to this plate 954 to prevent corrosion of the plate and to reduce scratch on the second window glass 908 during the contact between the glass 908 and the plate 954.

Also shown in FIGS. 26 and 27 is a small magnet block 956. This magnet block 956 is to be used for holding the support member 950 as described below.

The frame assembly 900, calendar 912 and the support member 950 can be assembled by first opening the frame body 902 and the middle section 904 to the position shown in FIG. 26 with the back casing 906 mounted on a vertical wall. The first item to be installed is the second window glass 908. Prior to installation, this glass 908 needs to be oriented to the position shown in FIG. 26 so that after entry the second window glass 908 will be stopped at the position marked as 958 shown in FIG. 27. In this position a tab 930 of the second window glass 908 is engaged with the lowest grooves 928 of the side wall 920 as partially seen in FIG. 27.

The next item to be installed is the calendar 912. Prior to installation the calendar 912 is open to expose the calendar date table to be displayed and the calendar picture opposite to this table. The calendar sheet 960 containing this picture shall be the one and the only one calendar sheet to be mounted within the middle section 904. This calendar sheet 960 is mounted simply by resting the steps 942 of this sheet on the bottom walls 922 and 924 and pushing the sheet 960 to right behind the second window glass 908. All the other calendar sheets 962 are simply hung in suspension below the middle section 904.

While temporarily holding the top calendar sheet 960 against the second window glass 908 by the left hand, the right hand can pick up one magnet block 956 and holds it against the calendar sheet 960 at any point on the sheet 960. The left hand is now free which will go ahead pick up a matching support member 950 and place it in front of the second window glass 908 near the magnet block 956 in the back of the second window glass 908. The magnet block 956 will exert a strong magnetic force across the calendar sheet 960 and the second window glass 908 and hold the support member 950 in place. This magnetic force will also maintain the calendar sheet in position next to the second window glass 908.

While still holding the support member 950 and magnet block 956 by the left hand and right hand, respectively, slowly move the support member 950 and magnet block 956 in pair until the support member 950 is rest on the desired location in relation to the scene on the exposed calendar picture. During the above movement the support member 950 and the magnet block 956 should be pulled apart slightly in order to avoid scratching the second window glass 908 or the calendar sheet 960.

After the placement of the above support member 950 and magnet block 956 pair, move such pairs can be placed in the same manner. Once all placements are completed, the back member 910 is placed behind and next to the calendar sheet 960. Now the middle section 904 can be rotated toward the back casing 906 and locked together.

FIG. 27 shows what happened when the middle section 904 and the back casing 906 are locked together. Under the pressure from the four resilient arms 933 the back member walls 944 will be firmly pressed against the calendar sheet 960 on its four sides. This will ensure the calendar sheet 960 be firmly mounted with its calendar picture illustration properly displayed through the frame window 926.

The thickness of the magnet block 956 and the resilient pad 946 are such that when the back member walls 944 are in contact with the calendar sheet 960 as above described, the portion of the resilient pad 946 in contact with the magnet block 956 will be deformed slightly. This deformation of the resilient pad 946 will help trap the magnet block 956 in place against the calendar sheet 960. Consequently, the support member 950 will also be positioned firmly and will not easily slide down at a later time.

It has been suggested that only one calendar sheet 960 be installed within the middle section 904. This is to minimize the decrease of the magnetic force across the second window glass 908. Obviously, more calendar sheets can be allowed as long as the magnetic force applied across the second window glass 908 is still adequate in holding the support member 950 and its load in place.

At this point the frame body 902 is still open and all the installed support members 950 are still exposed. All the articles to be displayed can now be placed on the support members 950. The frame body 902 is then shut close and locked to the middle section. This completes the entire assembling procedure.

After the assembling described above, the frame assembly 900 becomes a display case displaying the articles placed on the support members 950. At the same time the calendar 912 is mounted in the frame assembly 900 with one calendar picture illustration complementary to the articles displayed through the frame window 926. One calendar date table is also displayed but is exposed below the frame assembly 900 to facilitate date checking and memorandum writing.

After the calendar year the calendar 912 can be removed, but any one calendar sheet can still be mounted on the frame assembly 900 to provide a background scenery complementing the articles on display. Obviously any custom picture with proper size can also be mounted to serve the same purpose.

If the frame assembly 900 is not used as a display case it can simply be a picture frame and picture storage device with large storage capacity. In this case the second window glass 908 can be reoriented to enter through the deepest horizontal grooves 928. Furthermore, the back member 910 may even by temporarily removed to further increase the picture storage capacity.

Instead of the support member 950 the support base 934 can also be used for supporting and displaying three dimensional articles in the frame assembly 900. The support base 934 is easily broken off from the two runners 936 and can be slid into the horizontal grooves 932. Articles such as the dried flower 700 and reinforced picture 716 shown in FIGS. 14 and 15, respectively, can all be installed in the support base 934 for display in the frame assembly 900 along with the calendar 912 or a custom picture.

It is interesting to note that when the support base 934 is used, the change of articles for display can be achieved without unlocking the middle section 904 from the back casing 906. All that is needed is to open the frame body 902 away from the middle section 904 to get access to the front side of the middle section 904 and the support base 934.

On the other hand, the change of the calendar sheet or custom picture alone for display can be achieved by just opening the middle section 904 away from the back casing 906 without unlocking the frame body 902. This is desirable in certain situations. For example, a reinforced picture installed on the support base 934 showing a person on the foreground will remain the same when the calendar picture bearing background scenery is changed from month to month.

The frame assembly 900 also provides ample space for installing other type of support bases such as the support base 730 shown in FIG. 16. This support base 730 can be readily slid into the horizontal grooves 932. It may be necessary that the second window glass 908 be reoriented for its entry in order to provide maximum space for accommodating the support base 730. A toy building block assembly such as the toy horse 732 shown in FIG. 16 can then be mounted on this support base 730 and displayed in the frame assembly 900 along with a calendar picture or custom picture.

With a support base similar to the support base 730 installed in the frame assembly 900 a support assembly such as the support assembly 838 shown in FIG. 22 can also be mounted. Small articles such as sea shells, pearls, collectable stones, etc. can then be supported on the support assembly and be displayed in the frame assembly 900 along with the complementary custom picture or narrative sheet.

Figure 28:
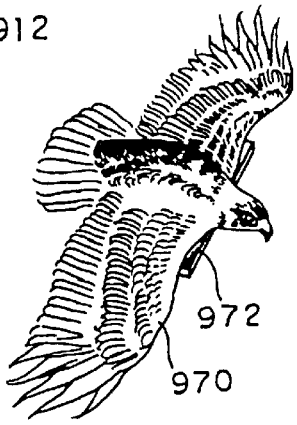
FIG. 28 is a perspective view showing a small figurine, drawn on enlarged scale, resembling an eagle.

FIG. 28 shows a small figurine 970 resembling an eagle. It is preferably made by molding process. Attached to the back of the figurine 970 is a magnetic plate 97 in size similar to the magnetic plate 954 shown in FIG. 26. This figurine 970, with the help of the magnet block 956, will then be able to be mounted on the second window glass 908 in exactly the same manner as the mounting of the support member 950.

Imagine a picture of American wild west displayed in the frame assembly 900. Mounted near the top of the picture is the eagle 970 looming in the sky. Near the bottom is a reinforced picture mounted on the support base 934 showing a rodent trying to find a place to hide from the attacking eagle. The choice of combined display involving a calendar picture or custom picture and one or more articles as taught in the present invention is indeed limitless.

Shown in FIG. 29 is a support member 980 having six suction cups 982 on its back side. This support member 980 can be mounted on the second window glass 908 by firmly pressing the support member 980 against the second window glass 908 until most of the air within the cups 982 is expelled. Once the pressing force is removed the vacuum created within the cups 982 will firmly attach the support member 980 to the second window glass 908.

An article such as a sea shell 984 to be displayed is next placed on the supports member 980. A custom picture or calendar picture is also mountable in the frame assembly 900 and can be displayed along with the sea shell 984.

In comparison with the support member 950, the support member 980 is even easier to install in the frame assembly 900. However, any slight defect in the suction cups 982 will cause air to leak in after a long display period. Therefore, such support member 980 is best suited for short term display or for articles less likely to break if fall.

FIGS. 30–34

Figure 30:
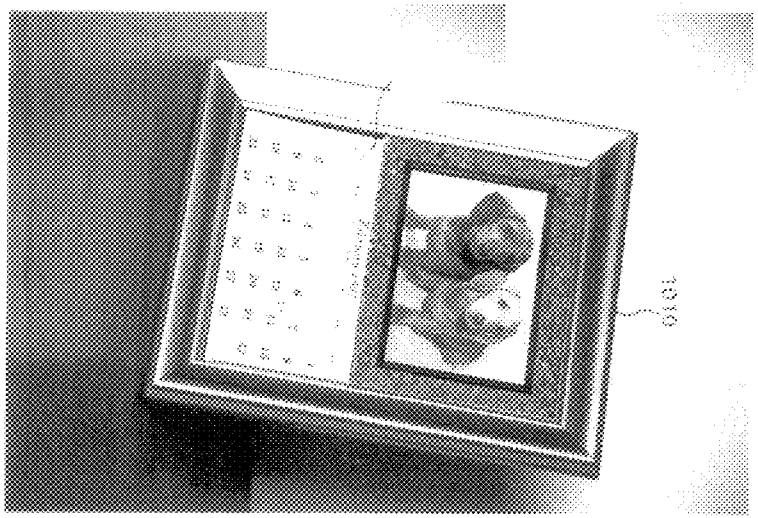
FIG. 30 is a perspective view showing a ninth embodiment of the frame calendar system of the present invention.
Figure 31:
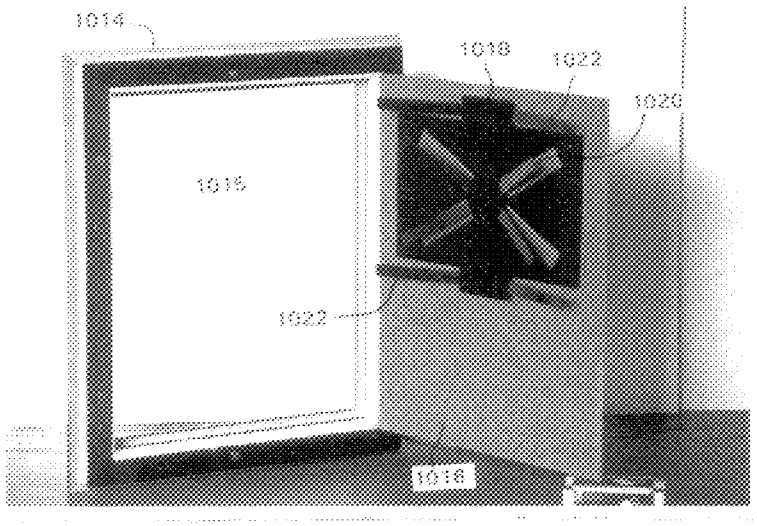
FIG. 31 is a perspective view showing the back side of a frame of the frame calendar system of FIG. 30, in the open position.

FIGS. 30–34 show a ninth embodiment of the frame calendar system of the present invention. It comprises a frame 1010 and a calendar sheet assembly 1012. As seen in FIG. 31, the frame 1010 has a frame body 1014 with a window 1015 and a swing type back door 1016. Attached to the back door 1016 is a spring plate 1018 which includes four inner spring leaf 1020 and four outer spring leaf 1022.

Figure 32:
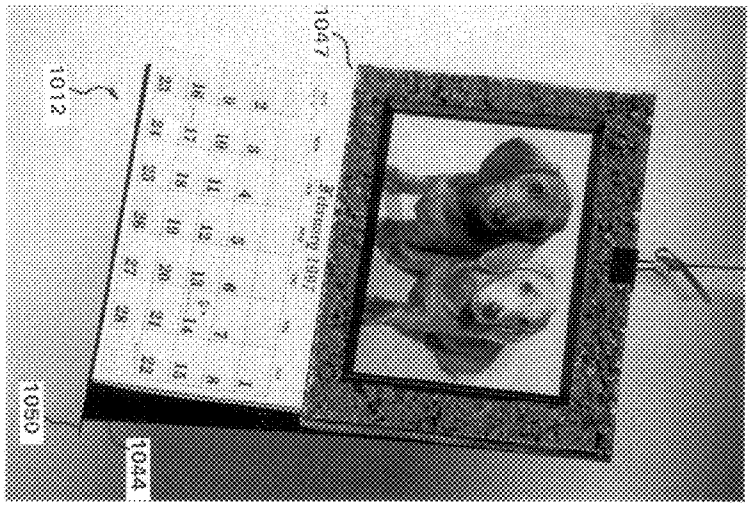
FIG. 32 is a perspective view showing a calendar sheet assembly of the frame calendar system of FIG. 30.
Figure 33:
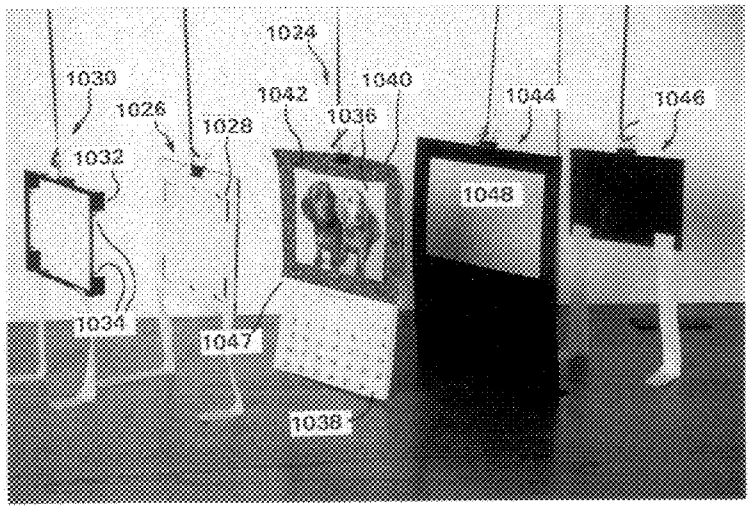
FIG. 33 is a perspective view showing the calendar sheet assembly of FIG. 32, disassembled to show its details.

FIG. 32 shows the calendar sheet assembly 1012 which is assembled and ready to be mounted in the frame 1010. FIG. 33 also shows the same calendar sheet assembly, but which is disassembled to illustrate the details of a stack of calendar sheets 1024 and other components.

Referring to FIG. 33, a window glass 1026 with four slot holes 1028 is shown. Also shown is an inner frame 1030 with four L-shaped stud walls 1032 and four spring clips 1034. This inner frame 1030 can be mounted on the window glass 1026 with the four stud walls 1032 extended through the four slot holes 1028. The four spring clips 1034 will also engage with the four slot holes and lock the inner frame onto the window glass 1026.

Placed behind the window glass 1026 is a stack of calendar sheets 1024. Each of these sheets 1024 has a calendar picture section 1036, a calendar date table section 1038 and border section 1040. A perforation line is located between the border section 1040 and the calendar date table section 1038. Perforation lines are also located between the calendar picture section 1036 and the border section 1040. All these perforation lines are provided to facilitate the separation of all these sections similar to the perforation lines 656 and 650 shown in FIG. 13.

Each of the calendar sheets 1024 has four L-shaped slot holes 1042. All these calendar sheets 1024 can be mounted behind the window glass 1026 with the slot holes 1042 engaged with the stud walls 1032 of the frame 1030 for hanging the calendar sheets 1024.

Placed behind the calendar sheets 1024 are one border backing plate 1044 and one picture backing plate 1046. It is preferable that these two plates be cut out of a elastic plastic sheet such as polycarbonate.

The first thing to be noticed in the border backing plate 1044 is a large opening 1048 cut out of the border backing plate 1044. This opening 1048 allows the border backing plate 1044 to clear the four stud walls 1032 of the inner frame 1030 when the border backing plate 1044 is mounted behind the calendar sheets 1024, as seen in FIG. 32.

As implied by its name, this border backing plate 1044 serves as a backing to the border section 1040 of the calendar sheets 1024. It will prevent the appearance of unevenness or wrinkle in the border section 1040 when it is mounted behind the window glass 1026 and placed in the frame 1010.

It is seen in FIG. 32 that the border backing plate 1044 has a length slightly longer than that of the calendar sheets 1024. Also notice that it has a bent section 1050 at its bottom. More details will be disclosed below in connection with the operation of the border backing plate 1044.

The picture backing plate 1046 is simply a rectangular plate made of plastic sheet or cardboard. It should have a size slightly smaller than the calendar picture section 1036 and can be fit inside the four studs 1032 of the inner frame 1030 when placed behind the calendar sheets 1024.

After all the components shown in FIG. 33 are assembled into a calendar sheet assembly 1012 as shown in FIG. 32, they can be placed in the frame body 1014 shown in FIG. 31. The border backing plate 1044 is loosely fit within the rabbet of the frame body 1014. The back door 1016 can now be closed and locked which produces a assembled frame calendar as shown in FIG. 30.

It is to be noticed that when assembled the four stud walls 1032 of the inner frame 1030 are inserted into the opening 1048 of the border backing plate 1044. As long as the border backing plate 1044 is held in place in the frame 1010, the inner frame 1030 is also secured in position. Further more, since the inner frame 1030 is locked into the window glass 1026, the window glass 1026 will also be held by the border backing plate 1044 when mounted in the frame 1010 vertically. At this point, the calendar sheets 1024 are also properly hung on display due to the engagement between the slot holes 1042 and the stud walls 1032.

It is clear from the above disclosure that the border backing plate 1044 of the present invention will serve a new function in addition to being a backing to the border section 1040. When assembled and placed in the frame 1010 the border backing plate 1044 will hold the window glass 1026 and the inner frame 1030 in place without falling. It will also support the calendar sheets 1024 for display in the frame 1010.

When the back door 1016 is closed the four outer spring leaf 1022 will be in contact with the border backing plate 1044, while the inner spring leaf 1020 will be in contact with the picture backing plate 1046. This will allow the border section 1040 and calendar picture section 1036 to be urged toward the window glass 1026, independent of each other, regardless of the number of sheets in each section, up to the capacity of the frame 1010.

It is seen in FIG. 32 that the width of the calendar date table section 1038 is narrower than that of the border section 1040. This is achieved by providing a step 1047 on each side of the calendar sheet 1024. The width of the calendar date table section should also be slightly narrower than that of the window 1015 of the frame body 1014. This is to assure that when mounted in the frame 1010 the calendar date table section 1038 can be freely turned without opening the frame 1010. Obviously, the length of the calendar date table section must also be short enough to clear the bottom rabbet of the frame body 1014.

The depth of the bent section 1050 of the border backing plate 1044 is about the same as that of the rabbet of the frame body 1014. When the back door 1016 is closed and locked it will be in contact with this bent section 1050 and force the bottom of the border backing plate 1044 forward toward the rabbet of the frame body 1014. This will allow the lower half of the border backing plate 1044 to support writing memo on the calendar date table section 1038.

Figure 34:
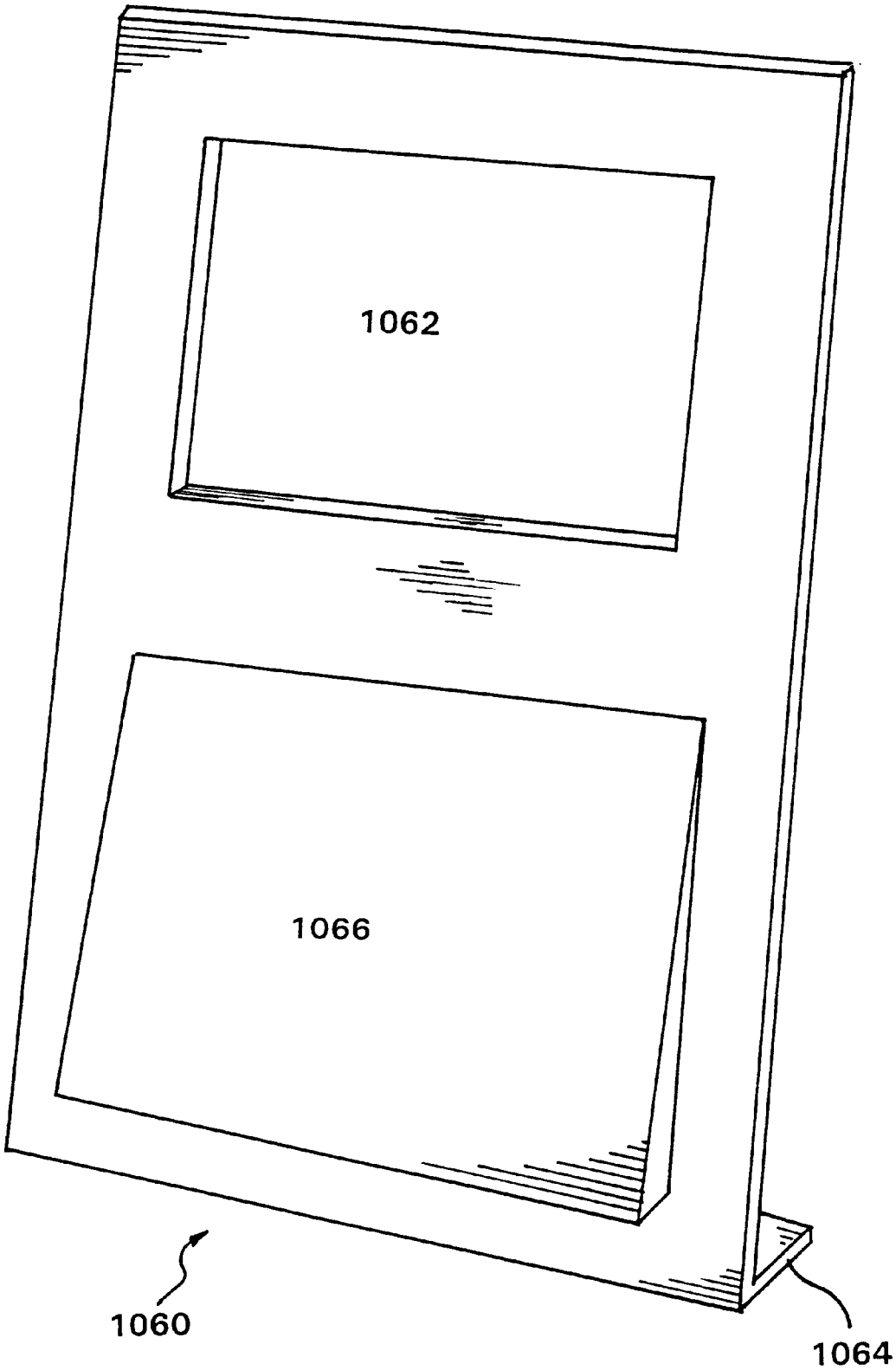
FIG. 34 is a perspective view showing a border backing plate of the present invention.

In FIG. 34, a different border backing plate 1060 is disclosed. Similar to the previous version, this border backing plate 1060 also has a top opening 1062 and a bent section 1064. The difference is that the lower half of the border backing plate 1060 has a raised section 1066 which is achieved by typical sheet forming process.

As seen in FIG. 34, this raised section 1066 has a raised surface which is more raised toward the bottom of the plate 1060. It is important that the raised section 1066 must clear the rabbet of the frame body 1014 when the border backing plate 1060 is mounted in the frame 1010.

There are several new advantages provided by this improved border backing plate 1060. First of all, the raised section 1066 will add some structure rigidity and thus allow thinner sheet at lower cost to be used. This raised structure will render more support to the writing on the calendar date table section, and will not cave in easily under the pressure exerted during writing.

When mounted the calendar date table section should extend slightly below the bottom of the raised section 1066. It is to be noticed that this raised section 1066 will push the mounted calendar date table section forward and away from the frame body 1014. This will facilitate the grabbing of the top calendar sheet by its bottom edge, for turning the page for date checking.

The frame calendar system of the present invention as embodied by FIGS. 30–34 allows both the calendar picture 1036 and the date table 1038 to be displayed through the frame window 1015. The calendar picture 1036 is elegantly frame and protected behind the window glass 1026. The date table 1038 is also framed but exposed to facilitate memo writing and page turning.

At the end of the month, the expired calendar sheet can be removed after opening the frame 1010. Alternatively, the date table 1038 can also be torn off along the perforation line to expose the next month's date table without opening the frame 1010. In this case, the current calendar picture will be continuously displayed for the new month.

With the present frame calendar system any calendar picture 1036 can be displayed at any time by simply removing the calendar picture 1036 from the calendar sheet along the perforation lines and placing it immediately behind the window glass 1026. Of course, a custom picture of appropriate size can also be similarly displayed as taught previously.

Upon the expiration of the calendar sheet the border section 1040 can also be separated from the calendar picture 1036 and date table 1038 and stored in the frame 1010. This allows any one border among the stored borders to be chosen for display to complement the displayed calendar picture or custom picture.

FIGS. 35–42

FIGS. 35–42 disclose a tenth embodiment of the frame system of the present invention. It embodies a frame system for holding a normally flat picture sheet and bending it into a one dimensional concavo-convex shape for adding a three dimensional effect to its display. It also creates an arch-shaped void space in front of the displayed picture for housing and displaying a three dimensional articles and/or reinforced pictures complementary to said first picture. Magnetic means are also employed for magnetically supporting these three dimensional articles and/or reinforced pictures in the frame system.

Figure 35:
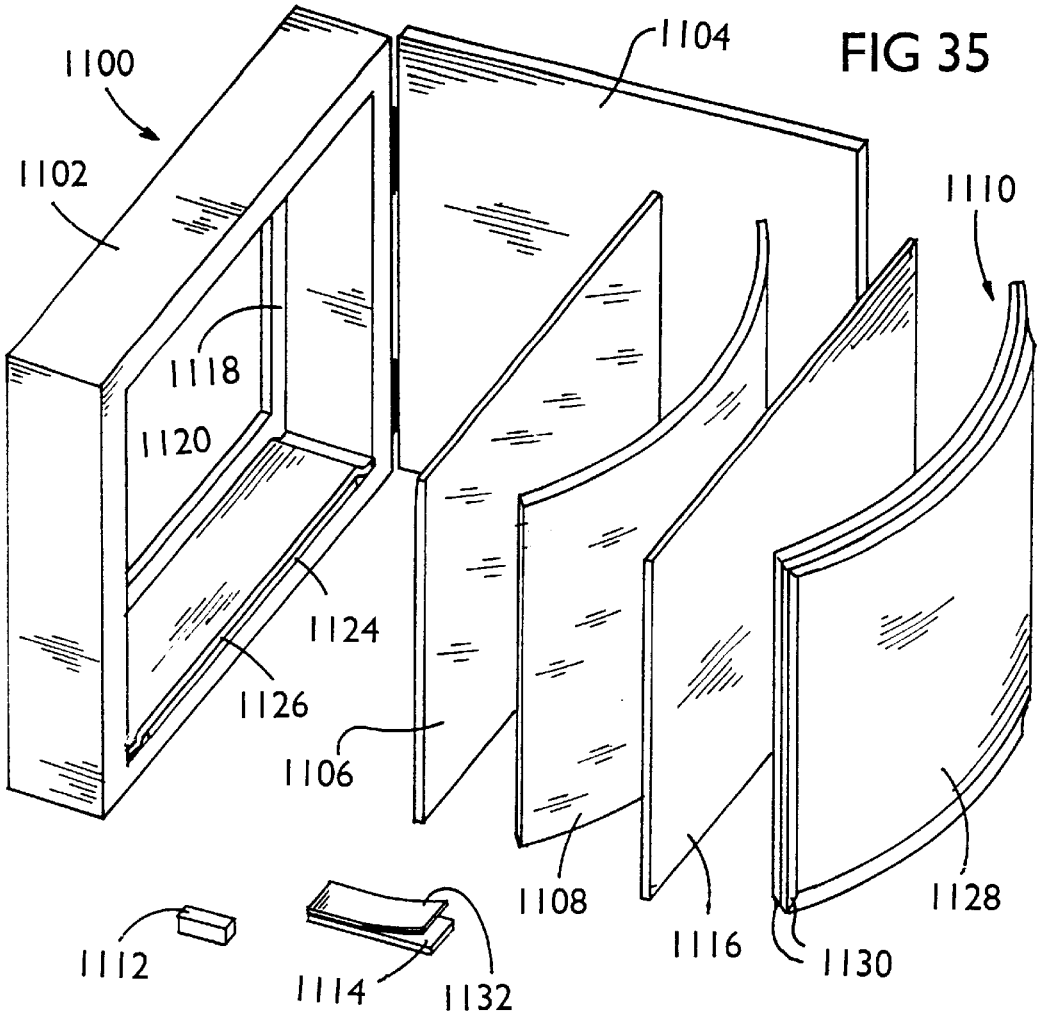
FIG. 35 is a perspective view showing a tenth embodiment of the frame system of the present invention.

The frame system 1100 shown in FIG. 35 includes a frame body 1102, backboard 1104, first transparent plate 1106, second transparent plate 1108, and a backing plate 1110. It may also include one or more magnets 1112 and 1114. Also shown in FIG. 35 is a flat custom picture 1116 to be mounted in the frame system 1100.

The frame body 1102 has a rabbet 1118 and a largely flat frame window 1120 through which all pictures are to be displayed. The backboard 1104 is hinged on the frame body 1102. It is horizontally rotatable between an open position as shown in the figure and a closed position. It can be locked in its closed position using means such as latch 136 and catch 138 of FIG. 2 or any conventional clip means. Located on the back side of the backboard 1104 is an easel 1122 for placing the frame system 1100 on a table in a tilted position. This easel 1122 is not shown but can be similar to the easel 680 in FIG. 13.

The first transparent plate 1106 is a flat rectangular plate. The second transparent plate 1108 has a width and height same as that of the first transparent plate 1106 but is curved. It can be made of plastics through conventional molding or plastic thermal curving process. As seen in the figure it has a curvature in the horizontal axis in the shape of an arc and can thus be termed one-dimensional concavo-convex. The backing plate 1110 has a size and curvature largely same as that of the second transparent plate 1108.

It is a simple matter to mount the picture 1116 in the frame system 1100. One simply holds the first transparent plate 1106, the second transparent plate 1108, the picture 1116 and the backing plate 1110 as a stack in the order and orientation as shown in FIG. 35. The stack is then placed in the frame body 1102. The backboard 1104 is next closed and locked which completes the picture mounting process.

Once in the closed position the backboard 1104 will press the backing plate 1110 forward which in turn will bend the picture 1116 until the picture 1116 is bent to the same curvature as that of the second transparent plate 1108. This curvature will add a three dimensional effect to the illustration on the picture 1116. This is true regardless whether the illustration is a scenery or a close up item such as a bowl of fruits.

In the above discussion it is required that (1) the picture 1116 is a flexible sheet such as a photographic paper; and (2) the thickness of the stack with the picture bent is about the same as the depth of the rabbet 1118 in the frame body 1102. The second transparent plate 1108 and the backing plate 1110 are normally rigid, but also can be somewhat flexible as long as the final thickness of the stack can be made to meet the above criteria.

One other interesting effect from the closure of the backboard 1104 is the formation of an arch-shaped void space between the flat first transparent plate 1106 and the curved second transparent plate 1108. This void space is usable for housing a three dimensional article such as a small figurine complementary to the picture on display. Further discussed in the following is a novel magnetic means for holding such a three dimensional article in the void space.

Referring to FIG. 35, the bottom surface of the rabbet 1118 is covered by a magnetic strip 1124 which in turn covered by a black vinyl adhesive tape 1126. This magnetic strip 1124 is preferably made of ferromagnetic material such as iron or steel. The adhesive tape 1126 serves to attach the magnetic strip 1124 to the rabbet 1118 and to protect it from rust and to provide a natural black background.

The backing plate 1110 is shown made of a curved magnetic sheet 1128 which is covered on each side by a lamination layer 1130. The magnetic sheet is preferably a steel sheet with a thickness of 0.010" (0.25 mm) or less. The lamination layer 1130 can be a conventional adhesive-coated plastic sheet of 0.003" (0.076 mm) in thickness. The lamination layers 1130 serve to protect the magnetic sheet 1128 from rust. The size of the lamination layer 1130 should be slightly larger than that of the magnetic sheet 1128 so that all edges of the magnetic sheet 1128 are covered by the soft lamination sheets 1130 for easy handling.

As stated above, the magnetic sheet 1128 needs to be made curved. Alternatively, if the magnetic sheet 1128 is a full hard cold rolled low carbon steel of 0.007" (0.18 mm) or less in thickness it is quite flexible. In this case a curved sheet such as a duplicate second transparent plate 1108 can be placed behind the magnetic sheet 1128 to force such curvature on the backing plate 1110 when mounted.

The magnet 1114 is a commercially available magnet strip typically coated with an adhesive on one side which is covered by a easily removable protective sheet 1132. This strip can be cut to any length desired with a scissors. The ceramic magnet block 1112 or magnet disc, not shown, are generally stronger magnet for its size and are widely used for craft.

A three dimensional article such as a figurine of suitable size can be displayed in the frame system 1100 by first attaching one or more magnets 1112 or 1114 to the bottom or back of the article. This article can then be placed either on the adhesive tape 1126 or the second transparent plate 1108 and be magnetically held by the magnetic strip 1124 or the magnetic sheet 1128.

In the frame system of the present invention the first transparent plate 1106 mainly serves to shield and protect the three dimensional article placed behind the first transparent plate 1106. But on the other hand, there are advantage by not having this first transparent plate 1106 at all. In this case, the second transparent plate 1108, the picture 1116 and the backing plate 1110 can just be assembled in one stack and placed in the frame body 1102. The backboard 1104 is next closed and locked. This will bend the picture 1116 and rest the second transparent plate 1108 against the rabbet 1118. Consequently an arch-shaped void space is again formed between the flat frame window 1120 and the curved transparent plate 1108. In this way one can access this void space any time through the frame window 1120 for placing and rearranging the three dimensional articles for display along with the displayed picture 1116.

Figure 36:
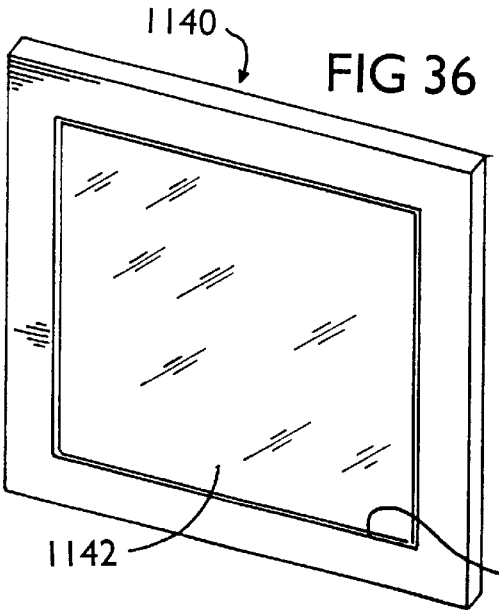
FIG. 36 is a perspective view showing a front body that can be hinged on the frame system in FIG. 35.

FIG. 36 discloses a front body 1140 which can be hinged on the frame body 1102 in FIG. 35 and be rotatable horizontally with respect to the frame body 1102 between an open position and a closed position. Carried on this front body 1140 is a flat transparent plate 1142 mounted over a front body window 1144 of the front body 1140. This flat transparent plate 1142 serves as a substitute for the first transparent plate 1106 shown in FIG. 35. Just as the first transparent plate 1106, this flat transparent plate 1142 serves to shield and protect the three dimensional article placed in the frame system 1100. Furthermore, one can also open the front body 1140 any time to place and rearrange the display of the three dimensional articles without disassembling the frame system 1100. This operation can be achieved even without taking down the frame system 1100 if it is hung on a wall.

Figure 37:
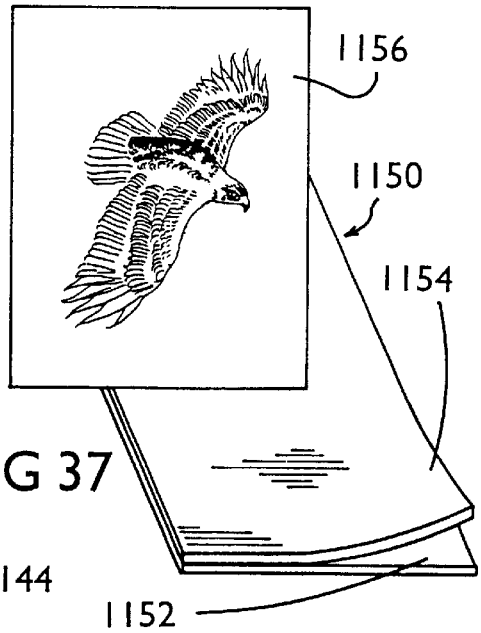
FIG. 37 is a perspective view showing a new reinforcement sheet.

Disclosed in FIG. 37 is a new type of reinforced picture that can be easily made for display in the frame system 1100. In this figure a new reinforcement sheet 1150 is shown which can also be supplied as part of the frame system 1100. It is a Mylar sheet 1152 with one side coated with a layer of adhesive which is covered by a removable protective sheet 1154. The Mylar sheet 1152 is chosen for its tough, durable, lay-flat characteristics. Most importantly, it can be easily cut to any intricate shape with a simple household scissors when its thickness is less than 0.015" (0.38 mm).

Also shown in FIG. 37 is a picture 1156 showing an illustration of an eagle. A reinforced picture of this eagle can be made by first lifting and cutting off one portion of the protective sheet 1154 to expose enough area of the adhesive on the Mylar sheet 1152 for the picture 1156. The picture sheet 1156 is then laid on the exposed adhesive. The reinforced picture of the eagle can now be made by simply cutting along the outline of the eagle using a scissors. The above-described eagle reinforced picture is ideally mountable on the second transparent plate 1108 of the frame system 1100 with the use of one magnet block 1112 applied with a layer of adhesive. This magnet block 1112 can be attached to the back of the reinforced picture and be oriented vertically for mounting on the curved second transparent plate 1108. The eagle reinforced picture is now magnetically held and displayed in front of the picture 1116. Because of the reinforcement sheet 1150 an eagle illustration is shown firmly flat and spaced apart from the picture 1116 which further enhances the three dimensional effect of the presentation.

Figure 38:
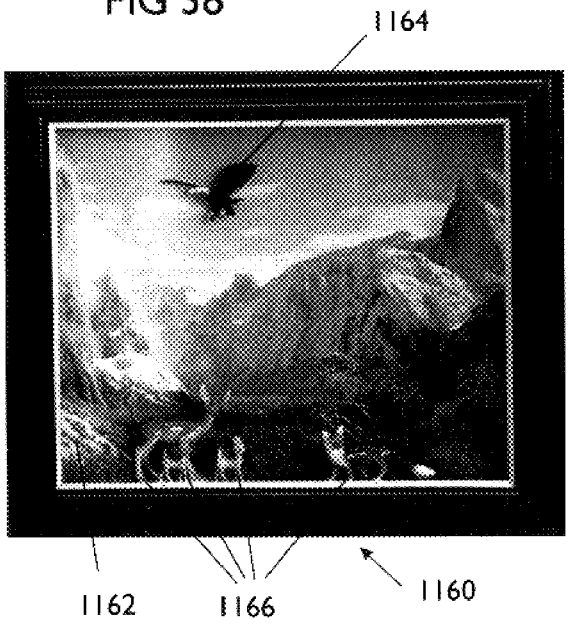
FIG. 38 shows an assembled frame system of the present invention.

FIG. 38 shows the first example of an assembled frame system of the present invention. This frame system 1160 includes all components shown in FIG. 35 and described above. Mounted in this frame system 1160 is a scenery picture 1162 which would appear three dimensional if viewed in the actual frame. Also mounted in front of the picture 1162 are an eagle reinforced picture 1164 and several animal figurines 1166. All animal figurines 1166 are attached with the magnets 1114 and mounted on the vinyl tape 1126 and magnetically held by the magnetic strip 1124. The eagle reinforced picture 1164 is made exactly as described above and is mounted on the second transparent plate 1108 and magnetically held by the backing plate 1110.

The frame system 1100 of the present invention as demonstrated in the example shown in FIG. 38 discloses a new three dimensional picture frame display. It allows a user turn an ordinary flat picture into a curved three dimensional display. In the mean time an arch-shaped void space in front of the picture is created for housing one or more figurines and photo sculptures complementary to the picture. The result is an interesting three dimensional show. More importantly, the reinforced picture of the present invention can be easily made. The mounting of such reinforced pictures and three dimensional articles can also be easily achieved.

Figure 39:
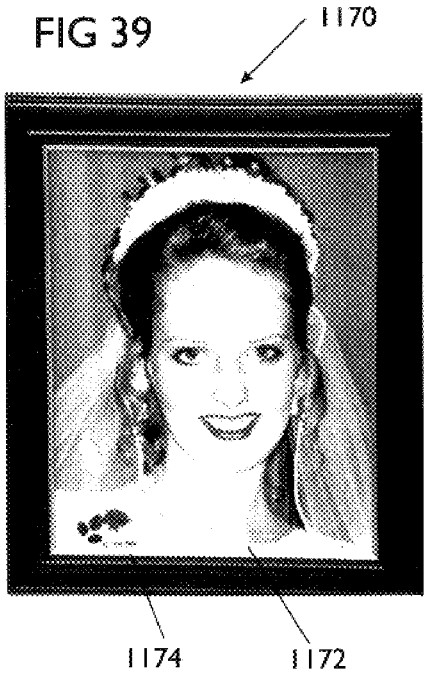
FIG. 39 shows another assembled frame system of the present invention.

FIG. 39 shows another example of the assembled system of the present invention. Displayed in this frame system 1170 is a bridal picture which would appear three dimensional if viewed in the actual frame. Also displayed is a reinforced picture 1174 commemorating such an important day in her life. This reinforced picture 1174 is attached with a magnet 1112 on its back. It is mounted on the Vinyl tape 1126 and is magnetically held by the magnetic strip 1124.

One other interesting effect when the frame assembly is used to display a facial portrait is that the eyes on the portrait appear to follow the viewer as the viewer moves in front of the frame. This effect is explained in FIG. 40. Furthermore, due to the curved display, the image of the person will appear slightly slimmer.

One point needs to be made is that for best eye movement effect the frame should be placed in such a way so that the line of sight between the frame and the viewer's eyes is perpendicular to the plane of the frame. Since this frame is usually placed on a table at a level lower than that of the viewer's eyes, it is highly recommended that the frame be tilted which makes the easel 1122 of the frame system 1100 very desirable.

FIG. 41 discloses an improvement on the frame system 1100 of FIG. 35 by providing a novel holder 1180 which can be joined to the backboard 1104 of the frame system 1100 using a pair of bolts 1182 or other suitable means. This holder 1180 is made of a flexible plastic sheet which is curved horizontally to an one dimensional concavo-convex shape as shown in the figure. A small stud 1184 extends downward from the holder 1180 and is bent to a right angle at the end. The ends of two sides of the holder 1180 are curved back to form two vertical and parallel channels 1186.

Also shown in FIG. 41 are a thin flat and flexible transparent sheet 1188, picture 1116, and a flat and flexible magnetic sheet 1190. All these three sheets are of the same width and length as seen in the figure. The transparent sheet 1188 will replace the second transparent plate 1108 of FIG. 35. The magnetic sheet 1190 can be a low carbon steel sheet and can replace the backing plate 1128 of FIG. 35.

Prior to the mounting of the picture 1116 the backboard 1104 is open to the position as shown in FIG. 35. The first transparent plate 1106 is mounted in the frame body 1102 held against the frame window 1120. The transparent sheet 1188, the picture 1116 and the magnetic sheet 1190 are next gathered as a stack in the order as shown in the figure. This stack is slid into the two channels 1186 until it is stopped at the stud 1184. At this time the picture 1116, as well as the transparent sheet 1188 and the magnetic sheet 1190 will be bent to a curvature same as that of the holder 1180.

At this point any three dimensional articles or reinforced picture to be displayed can now be placed either on the vinyl tape 1126 to be magnetically held by the magnetic strip 1124 or on the transparent sheet 1188 to be magnetically held by the magnetic sheet 1190. After this the backboard 1104 can be closed and locked which completes the mounting process.

Just before the backboard 1104 is fully closed one side of the holder 1180 will first touch and be stopped by the first transparent plate 1106. Further closing of the backboard 1104 will force the holder 1180 to swivel slightly. The holder 1180 and the installed stack will also be flatten slightly. This will bring both channels 1186 in contact with the transparent plate 1106 after which the backboard 1104 will be completely closed.

After the completion of the mounting process the assembled frame system is ready for display. It will be seen that the installed picture 1116 is curved which imparts a three dimensional effect to the illustration in the picture 1116. The installed three dimensional articles or reinforced pictures are also displayed in front of the picture 1116.

FIG. 42 discloses another version of the holder of present invention. This holder 1192 is made of ferromagnetic metal sheet such as iron or steel and is formed by stamping or other suitable means. It has a vertical portion 1193 and a horizontal portion 1194. A small elbow 1195 integrally joins above two portions. The vertical portion 1193 is structurally similar to the holder 1180 of FIG. 41. It is curved horizontally to an one dimensional concavo-convex shape with two vertical channels 1196 on the two sides. The horizontal portion 1194 is a flat rectangular plate which allows the holder 1192 to stand on a table.

The transparent sheet 1188 and picture 1116 of FIG. 41 are also shown in FIG. 42. The magnetic sheet 1190 of FIG. 41 is no longer needed for the holder 1192 which is itself magnetic.

The picture 1116 is mounted by simply inserting the picture 1116, together with the transparent sheet 1188, down the two channels 1196 until they are rest on the horizontal plate 1194. After installation, both the picture 1116 and the transparent sheet 1188 will be bent to a curvature same as that of the holder 1192.

At this point any three dimensional articles or reinforced pictures to be displayed can now be placed on the horizontal plate 1194 or the transparent sheet 1188 and be magnetically held by the holder 1192. The assembled holder 1192 can then be placed in the frame body 1102 after which the backboard 1104 is closed and locked. The finished frame system 1100 shall then be ready for display.

Unlike the holder 1180 which is flexible, the holder 1192 is rigid and fixed in its dimension. In order to fit the holder 1192 snugly in the frame system 1100 the depth of the holder 1192, plus the thickness of the first transparent plate 1106 if present, shall be equal to the available depth of the rabbet 1118. The width and height of the holder 1192 should also match that of the rabbet 1118 to assure a good fit.

One other point needs to be made is that the width of the transparent sheet 1188 is also very critical for it to be properly bent into a curvature same as that of the holder 1192. The horizontal width of the transparent sheet 1188 should be equal to the length of the arc in the holder 1192, as viewed from the top, extending to the ends of two channels 1196. Too wide the width will cause the transparent sheet 1188 to bend out of shape, while too short the width will prevent two ends of the transparent sheet 1188 to touch the channels for proper bending.

Naturally, the width of the picture 1116 should not be too wide to fit into the two channels 1196. However, a narrower picture will still fit and be properly curved as long as it is sandwiched between the curved holder 1192 and the curved transparent sheet 1188.

FIGS. 43–46

Figure 43:
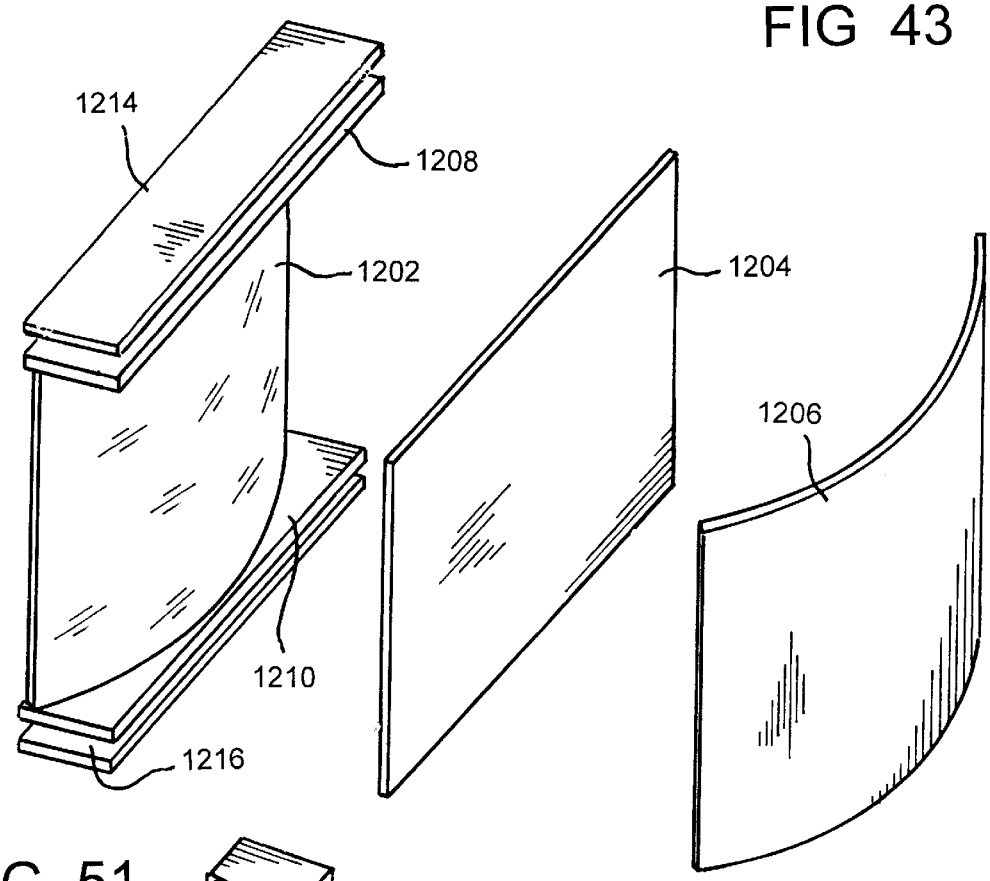
FIG. 43 is a perspective view showing edge glasses and edge sheets of the present invention.

FIGS. 43–46 disclose one more innovative feature in the 3D picture frame of the present invention. This feature is schematically shown in FIG. 43. In this figure, a pre-curved glass 1202, a custom picture 1204, and a pre-curved backing plate 1206 are intended to be mountable in the frame body 1102 of the frame system 1100 of FIG. 35, in the same manner as the second transparent plate 1108, picture 1116, and the backing plate 1110, respectively.

In addition to the pre-curved glass 1202, there are also two rectangular transparent glass 1208 and 1210 shown in FIG. 43. The glass 1208, termed top edge glass 1208, is positioned between the top edge of the pre-curved glass 1202 and the top member of the frame body 1102. Similarly, the glass 1210, termed bottom edge glass 1210, is positioned between the bottom edge of the pre-curved glass 1202 and the bottom member of the frame body 1102 in the mounted position.

The remaining two items in FIG. 43 to be described are a top edge sheet 1214 and a bottom edge sheet 1216. The top edge sheet 1214 can be inserted between the top edge glass 1208 and the top member of the frame body 1102. Similarly, the bottom edge sheet 1216 can be inserted between the bottom edge glass 1210 and the bottom member of the frame body 1102.

It is clear from FIG. 43 and the above description that, once mounted in the frame body 1102, the top edge sheet 1214 and the bottom edge sheet 1216 are positioned perpendicular with respect to the custom picture 1204. It is also clear that the top edge sheet 1214, bottom edge sheet 1216 and the custom picture 1204 are all visible through the glasses 1208, 1210 and 1202, respectively. The significance of these two facts will be clear by the three examples shown in FIGS. 44–46 and described in the following discussion.

Figure 44:
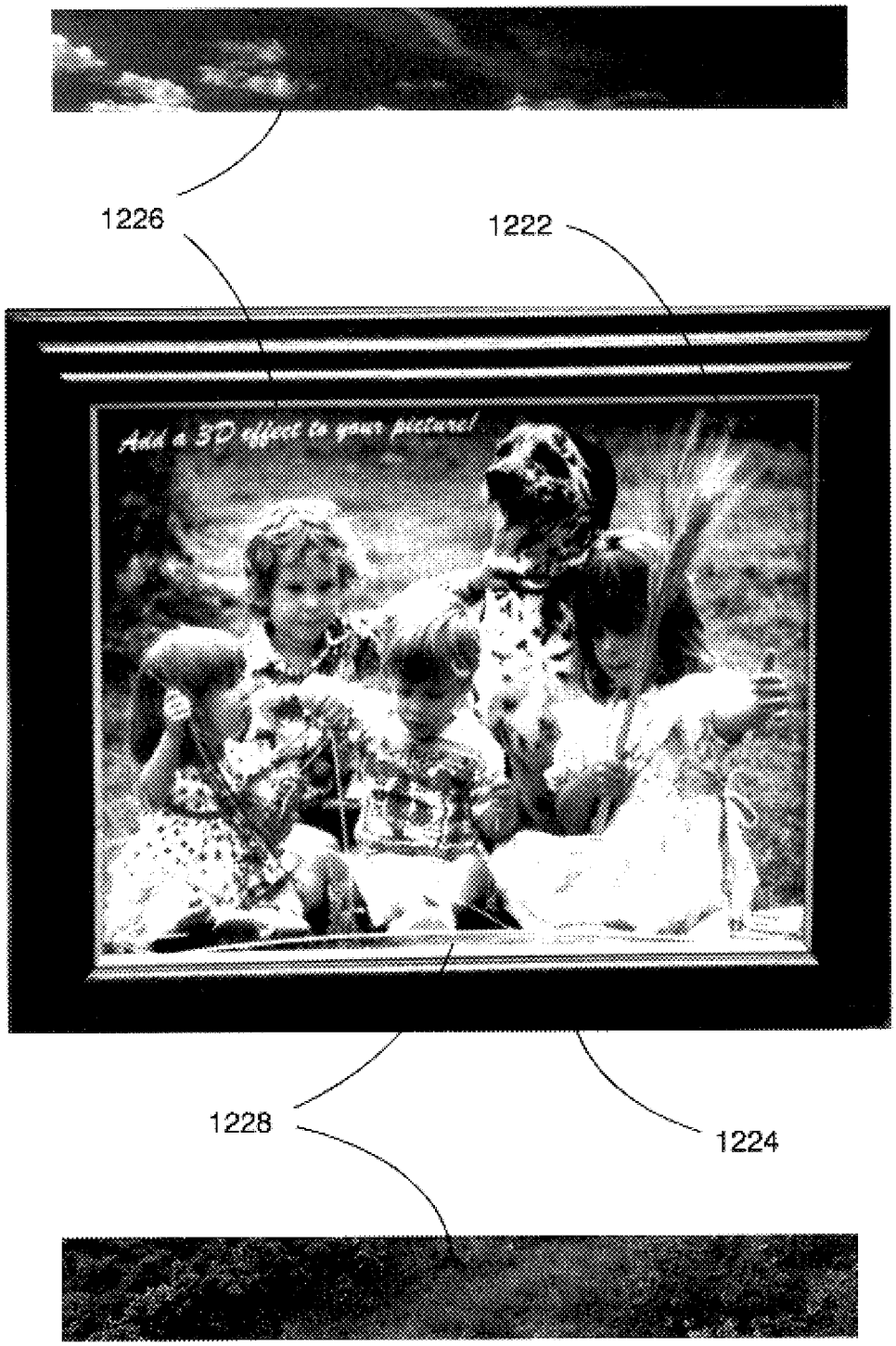
FIG. 44 shows a picture sheet and two edge sheets for display in the 3D frame of the present invention.

In FIG. 44 a picture 1222 of a group of children is displayed in a 3D picture frame 1224. This picture frame 1224 is structurally similar to the frame system 1100 of FIG. 35 and includes the pre-curved glass 1202, pre-curved backing plate 1206, and the edge glasses 1208 and 1210 as shown in FIG. 43.

The picture 1222 will be curved when it is sandwiched between the curved glass 1202 and the backing plate 1206. The very nature of this curvature will impart a 3D effect to the picture 1222 mounted in this frame 1224.

Composition in a picture may also be employed to enhance its 3D effect. One good way to achieve this 3D effect is to take a picture of a large group of people packed together against a structureless background such as wall, lawn, sky, etc. The image of these people, when curved up in this 3D frame, will appear to "float" above the background—an interesting 3D effect.

Also shown in FIG. 44 are a top edge sheet 1226 and a bottom edge sheet 1228. The top edge sheet is not visible in the frame 1224. The "sky" in the top edge sheet 1226 and the "grass" on the bottom edge sheet 1228, plus the green lawn in the picture 1222 curved around the children, create a natural 3D effect.

Since this grass foreground on the bottom edge sheet 1228 is perpendicular to the children's image in the picture 1222, a sense of depth is created which further enhances the 3D feeling in the mind of the viewer.

The contribution of the edge sheets 1226 and 1228 to the overall aesthetic appearance of the picture presentation is also obvious. A foreground covered by natural "grass" is certainly more appealing than the bare frame rabbet.

The concept of the edge sheet opens up a totally new dimension in the concept of picture frame. Users will have total freedom in choosing the two edge sheets to complement the main picture on display.

Figure 45A:
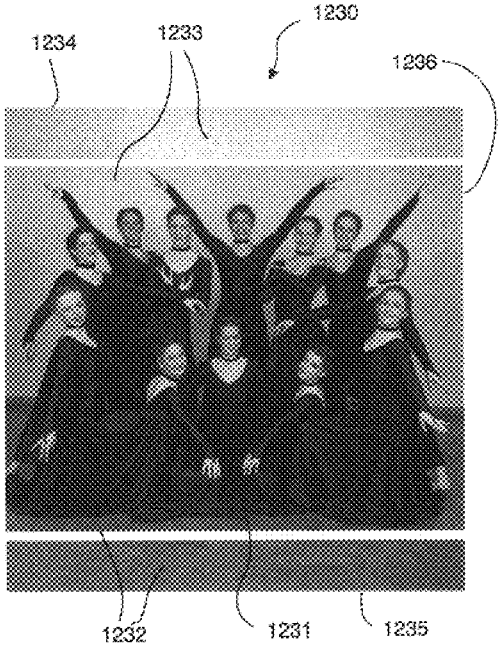
FIGS. 45*a* and 45*b* show two examples indicating that both edge sheets and the main picture can be taken from a single original picture to produce a wrap-around effect.
Figure 45B:
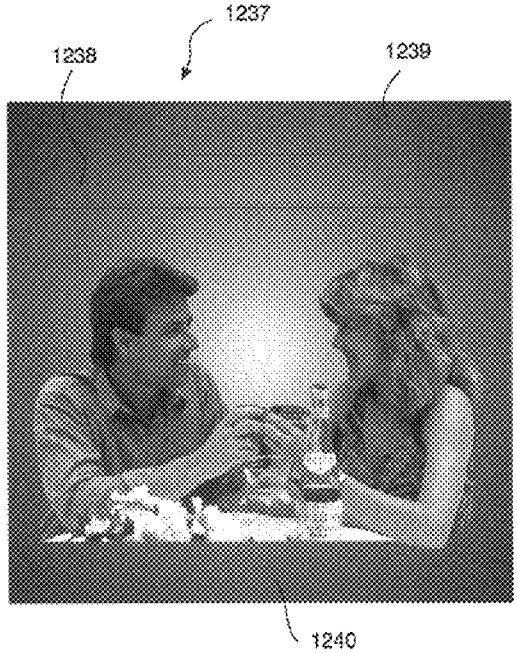

FIGS. 45*a* and 45*b* disclose another novel concept in the making of the edge sheets. In FIG. 44 the top edge sheet 1226 and the bottom edge sheet 1228 are chosen separately from the main picture 1222. But in FIGS. 45*a* and 45*b* the edge sheets and the main picture can be taken from a single original picture sheet.

The picture sheet 1230 in FIG. 45*a* shows a group of dancers 1231, a floor 1232, and a wall 1233. A portion of the picture sheet 1230 is shown trimmed off to form a top edge sheet 1234 and a bottom edge sheet 1235. The remaining portion of the picture sheet 1230 constitutes the main picture 1236. These edge sheets 1234 and 1235, as well as the main picture 1236 can be mounted in the 3D picture frame 1224 in the same manner as the top edge sheet 1226, bottom edge sheet 1228, and the main picture 1222, respectively, as shown in FIG. 44.

There are several advantages in the use of one single picture sheet to satisfy all the picture needs in the present 3D frame. The first one is the cost economy and convenience. But most importantly, it will be assured that the obtained edge sheets will more likely match the main picture in color and pattern since they are all obtained from a single picture sheet.

There is one other unique advantage associated with the single sheet concept in the 3D frame of the present invention. Once mounted in the 3D frame 1224, the dancers 1231 are literally surrounded in three dimension by the same floor 1232 and the same wall 1233 appeared in the edge sheets 1234, 1235 and the main picture 1236. It achieve a wrap-around effect which further strengthens the 3D feeling in the mind of the viewer.

It should be noted that the concepts of the wrap-around effect and depth of the field have been illustrated before in this Application in one embodiment in connection with FIGS. 14–15 (p.41, line 19 to p. 42, line 3). But the present approach as shown in FIGS. 45*a* represents a drastic and unobvious improvement over this earlier version. It is clearly more superior in two important aspects. The first one is the curved image which extends to the entire width of the picture and will achieve more pronounced 3D effect. Obviously, a separate edge sheet is more easier to make and install. It also enables an edge glass to be placed between the main picture and the edge sheet and to separate the two from each other. Better protection to the edge sheet by the edge glass is also achieved.

The picture sheet 1237 shown in FIG. 45*b* can also be similarly trimmed to form a top edge sheet 1238, a bottom edge sheet 1239 and a main picture 1240. They can also be mounted in the 3D frame 1224 for achieving wrap-around effect and superb 3D effect.

Because of the needs for professional lighting and back drop set up, the picture sheet 1237 is more likely obtained in a studio. Many professional cameras generally yield photographs with square or near square formats. Such photographs will be excellent candidates for making such 3D presentation in a frame of rectangular shape.

Figures 46, 53, 54:
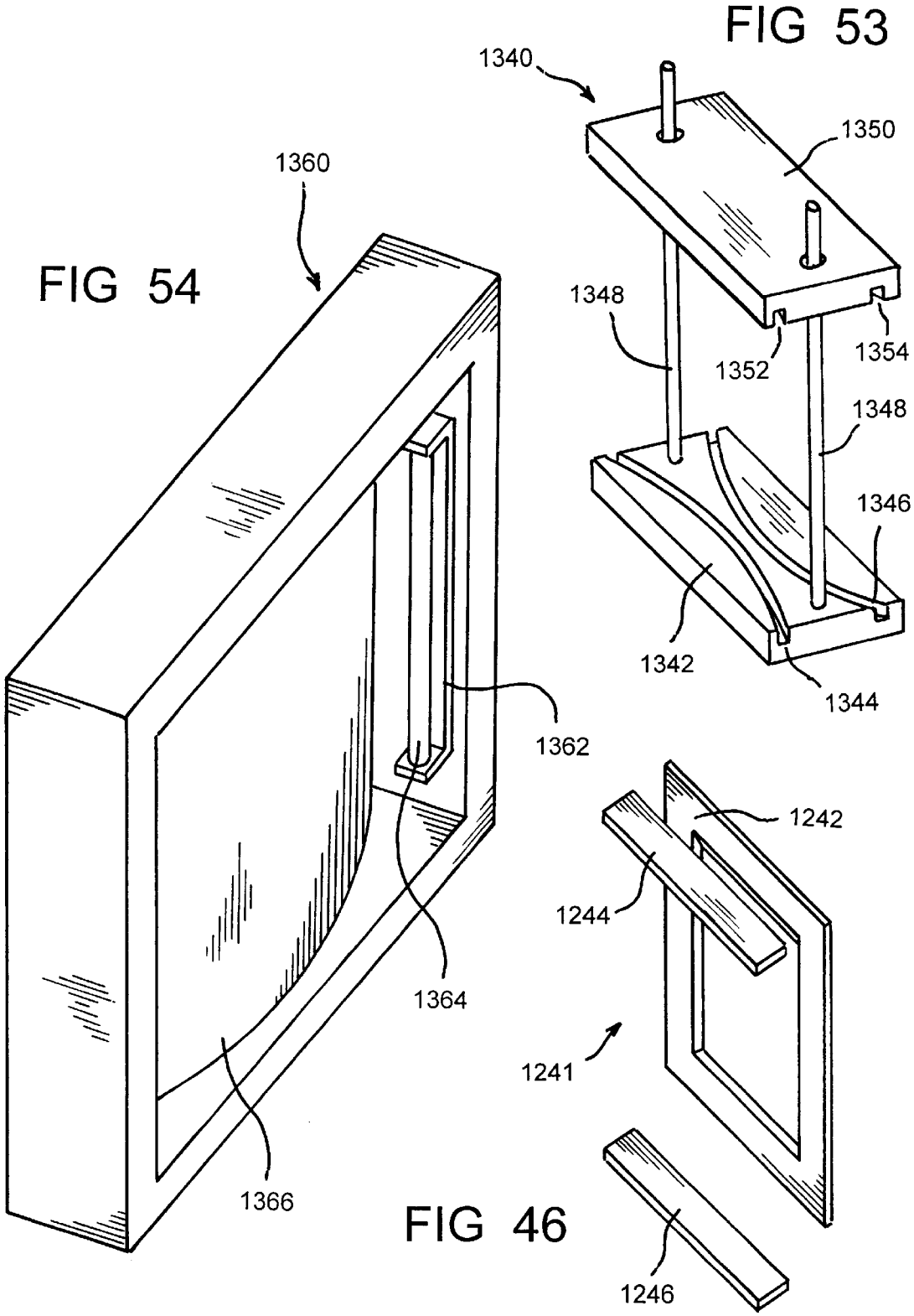
FIG. 46 shows a 3-piece mat set mountable in the 3D frame of the present invention.
FIG. 53 is a perspective view, showing a preview frame which allows a picture to be viewed for its eye movement effect and 3D effect.
FIG. 54 is a perspective view, showing the back side of a 3D frame with internal lighting system.

Photo matting is widely used in picture framing. A mat with bevel cut opening will enhance the aesthetic appearance of the framed picture. It will also allow a small picture to be mounted in an otherwise large frame. FIG. 46 discloses a novel 3-piece mat set 1241 that are mountable in the 3D frame of the present invention.

The present mat set 1241 includes a center mat 1242 which is just like a conventional mat with a bevel cut opening. It can be sandwiched between a curved glass and backing plate of proper size and be curved when mounted in a 3D frame of the present invention. A picture can be attached to the backside of the center mat 1242 and also be curved to exhibit the desired 3D effect and eye movement effect.

The mat set 1241 in FIG. 46 also includes a top edge mat 1244 and a bottom edge mat 1246. These two edge mats can be mounted in a 3D frame of present invention in the same manner as the edge sheets 1214 and 1216 of FIG. 43 mounted in the frame body 1102 of FIG. 35. The edge mats 1244 and 1246 are preferably cut from the same mat sheet from which the center mat 1242 is also cut. In this way, the two edge mats 1244 and 1246 will have the same color and texture as that of the center mat 1242. Once mounted, these two edge mats will blend nicely with the center mat to enhance the overall appearance of the 3D frame system.

FIGS. 47–49

One of the major features in the 3D frame of the present invention is the creation of 3D space in the shape of an arch. A three dimensional article such as reinforced pictures 1164 and 1174 and figurines 1166 can be magnetically held in this 3D space and be displayed. In this section several other novel means for holding three dimensional articles of various kind in this 3D space will be disclosed.

Figure 47:
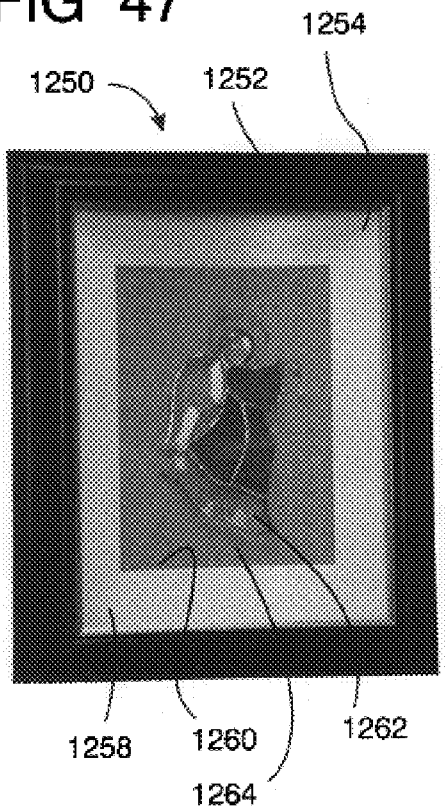
FIG. 47 shows a 3D frame with a pre-curved mat plate for holding a three dimensional article.

FIG. 47 discloses a novel 3D frame system 1250 which is basically the same as the 3D frame system 1100 in FIG. 35 except with some changes for the purpose of holding a three dimensional article. This 3D frame system 1250 comprises a frame body 1252, flat glass 1254 and pre-curved backing plate 1256, very much like the frame body 1102, first transparent plate 1106 and backing plate 1110, respectively, in FIG. 35.

Also seen in FIG. 47 is a pre-curved mat plate 1258. This mat plate 1258 has a center opening 1260 similar to the center mat 1242 shown in FIG. 46. But there are two important differences separating the mat plate 1258 and the center mat 1242. First, the mat plate 1258 is typically made of plastics such as Acrylic which can be pre-curved by thermal forming process. On the other hand, the center mat 1242 is cut from conventional paper mat which can not be pre-curved easily. The second difference is in term of their functions. The center mat 1242 is to be sandwiched between a pre-curved glass and a pre-curved backing plate for displaying a flat sheet held behind the center mat 1242. On the other hand, the mat plate 1258 does not require a pre-curved glass on its front because the mat plate 1258 is pre-curved by itself for holding a three dimensional article, the details of which is to be described in the following discussion.

Held behind the mat plate 1258 is a three dimensional article which in this case is a lead glass angel 1262 mounted on a blue paper sheet 1264. Since the blue paper sheet 1264 is pressed between the pre-curved mat plate 1258 and the pre-curved backing plate 1256, it will also be curved and form a curvature same as that of the mat plate 1258. The mounted lead glass angel 1262, because of its physical dimension, will clear and extend beyond the center opening 1260 toward the frame window of the frame body 1252. In this way, the lead glass angel 1262 will be largely held within the arch-shaped 3D space between the flat glass 1254 and the mat plate 1258.

The mat plate of the present invention will have broad application for holding sheets with relief arts or supported three dimensional objects. However, in order to operate this mat plate 1258 successfully, several criteria must be observed. First, the sheet held by the mat plate 1258 must be flexible in order to be pushed back for creating the needed 3D space. Obviously, the size of the relief art or three dimensional objects must be small enough to clear the center opening of the mat plate. The depth of the relief art or objects must not exceed that of the created 3D space.

For the present discussion, fabric arts generally refer to any arts employing fabric sheet as its substrate or supporting sheet. This may include commonly known oil or Acrylic paintings on canvas, and cross stitching, needlepoint, or embroidery on cotton or synthetic fabric sheets.

Many such fabric arts will need framing for their proper display. It is difficult to frame such fabric arts due to its softness nature. It is also often required that no intimate contact on its front surface to a glass sheet be allowed.

Figure 48:
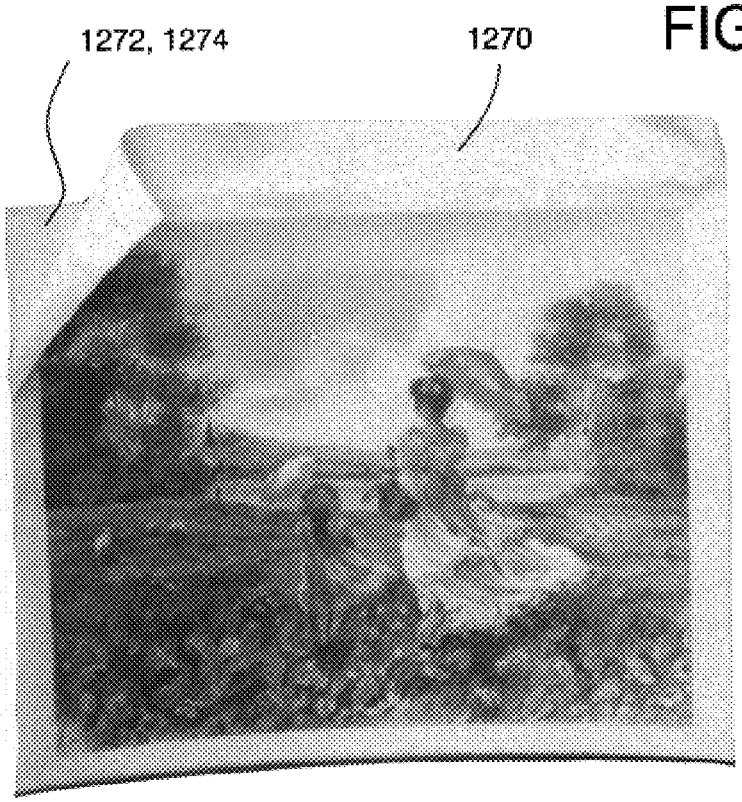
FIG. 48 shows a pre-curved backing plate with double sided adhesive for holding a fabric art.

FIG. 48 discloses one novel means for supporting and displaying such fabric arts in the 3D frame of the present invention. This would enable the 3D effect or eye movement effect to be achieved in such fabric arts. It would also create needed 3D space for the proper display of certain fabric arts.

In FIG. 48 a cross stitching fabric art 1270 is shown adhered to a pre-curved backing plate 1272 with the use of a double-sided adhesive 1274. This fabric art 1270, with the backing plate 1272, can be mounted in the frame body 1102 of FIG. 35 and displayed behind the flat glass 1106.

The backing plate 1272 is similar to the backing plate 1206 in FIG. 43. It is made of plastic sheet and is thermally formed to a desired curvature. The double-sided adhesive 1274 is preferably a rubber based pressure sensitive adhesive. The adhesive may include a foam layer which adds some softness to the contact and helps smooth out some unevenness typically found on the back side of the cross stitching art sheet 1270.

One major advantage in the use of the pre-curved backing plate 1272 with double sided adhesive 1274 is to ensure that the entire back surface of the soft fabric art 1270 is adhered to the backing plate 1272 and thus conformed to the curvature of the backing plate 1272. This is important for achieving the desired 3D effect and eye movement effect.

Since the fabric art 1270 is closely adhered to the backing plate 1272, a well defined arch-shaped 3D space is created between the fabric art 1270 and the flat glass 1106. This 3D space is especially desirable for some fabric arts such as ribbon embroidery which needs considerable amount of clearance in front of the art sheet.

The use of rubber based adhesive also has one advantage of allowing most fabrics to be removably adhered to the backing plate 1272. This is desirable during the initial mounting process for adjusting the positioning of the fabric art 1270. This fabric art 1270 can also be easily removed later from the backing plate 1272 when it is no longer needed for such display.

For certain fabric arts such as oil canvas painting it is possible to mount the blank canvas sheet on the backing plate 1272 before the painting process. This blank canvas supported by the backing plate 1272 can be readily held steadily on a conventional easel stand for the painting work. This means that the painting is done on a pre-curved canvas sheet. It is desirable since the canvas sheet does not have to be curved again after painting and can be readily mounted in a 3D frame for display.

Figure 49:
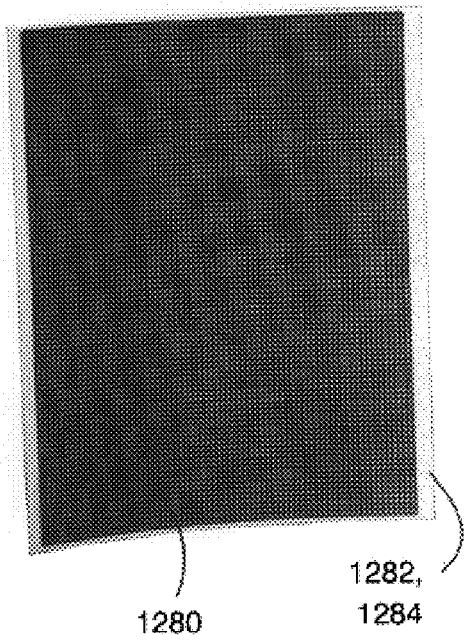
FIG. 49 shows a pre-curved backing plate with double sided adhesive for holding a mesh screen.

FIG. 49 shows a sheet of conventional mesh screen 1280 which is referred to as plastic canvas in the trade. It is made of soft plastics and may have ten or less mesh per inch (2.54 cm). It serves as a substrate for yarn needlepoint. But it can also be used for holding any objects such as dried flowers that can be fastened onto the mesh screen 1280 with one or more pieces of twisted wires.

Also seen in FIG. 49 is a novel pre-curved backing plate 1282 with a layer of double-sided adhesive 1284. This backing plate 1282, similar to the backing plate 1206 in FIG. 43, is mountable in a 3D frame such as the frame body 1252 in FIG. 47. It is placeable behind the flat glass 1254 for forming an arch-shaped 3D space between the flat glass 1254 and the backing plate 1282.

Once the mesh screen 1280 is loaded with yarn needlepoint or other art objects it can be attached to the backing plate 1282 with the help of the double-sided adhesive 1284. The mesh screen 1280 will be conformed to the curvature of the backing plate 1282. This in turn will yield adequate 3D space to accommodate the installed art objects once the backing plate 1282, along with the mesh screen 1280, is mounted behind the flat glass 1252 in the frame body 1252.

The mesh screen 1280 is a flat and flexible plastic sheet. It is possible with the present teaching, that a mesh screen made of hard plastics such as ABS can be molded with a predetermined curvature for the present application. No pre-curved backing plate would be needed. Once loaded with are objects, this mesh screen can be directly mounted in the 3D frame body 1252 for display.

FIG. 50

In this section a brief discussion on the curvature of the glass 1108 and backing plate 1110 of FIG. 35 will be made. In order to achieve the most ideal 3D effect, and more critically, the eye movement effect, the degree of the curvature of the glass must be carefully chosen. With inadequate glass curvature the eye movement effect may not be easily noticeable. On the other hand, with too much of the glass curvature, the image of the person in the picture may begin to show some distortion.

Figure 50:
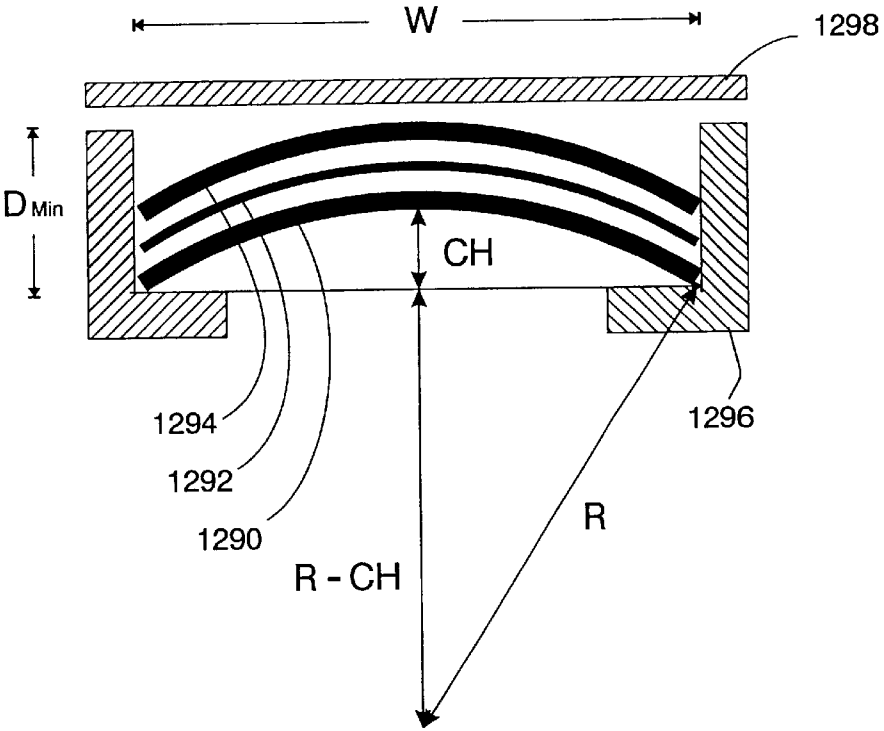
FIG. 50 shows the schematics of a 3D frame for the explanation of the curvature radius(R), curve height (CH), and minimum depth (Dmin) of the frame rabbit as a function of the frame width (W).

FIG. 50 shows the schematics of a curved glass 1290, a picture sheet 1292, and a curved backing plate 1294 resting on a 3D frame body 1296. A backboard 1298 is also shown closing off the frame body 1296. Also marked in the figure are several terms which are defined as follow:

R=Curvature Radius; radius of the inside surface of the glass 1290 or the backing plate 1294, indicating the curvature of the glass 1290 or backing plate 1294.

W=Width of the frame body 1296, or the curved glass 1290.

CH=Curve Height which is calculated based on the terms R and W.

Dmin=Minimum Depth of the frame rabbet which is equal to the sum of the thickness of the glass 1290, picture sheet 1292, and backing plate 1294, plus the curve height.

AL=Arc Length; the length of the glass before it is curved.

It is found that the ratio of the curvature radius (R) to the frame body width (W) generally stays constant for ideal 3D effect or eye movement effect regardless of the 3D frame size. For a 3D frame with W=8" (20.3 cm), the ideal curvature radius (R) was experimentally found to be 13" (33 cm) for achieving satisfactory eye movement effect. Therefore, the curvature radius can be expressed as a function of the frame body width (W) as follow:

$$R=(13/8)\ W=1.625\ W\ \text{(for eye movement effect)} \quad (1)$$

Referring to FIG. 50, the curve height (CH) of the glass 1290 is expressible in the following formula:

$$(R-CH)^2+(0.5\ W)^2=R^2 \quad (2)$$

Combining the equations (1) and (2) the following equation can be deduced.

$$CH=0.079\ W\ \text{(for eye movement effect)} \quad (3)$$

The arc length (AL) is related to the curvature radius according to the following equation.

$$AL=0.6255\ R\ \text{(for eye movement effect)} \quad (4)$$

For a given frame body width (W), the critical dimensions of the 3D frame (R, CH, AL) for achieving satisfactory eye movement effect can therefore be determined based on the equations (1), (3) and (4). The following table lists such dimensions for three commonly used 3D portrait frames for achieving satisfactory eye movement effect.

| Frame Body Width W | Curvature Radius R | Curve Height CH | Arc Length AL |
|---|---|---|---|
| 8" (20.32 cm) | 13" (33.02 cm) | 0.632" (1.61 cm) | 8.13" (20.65 cm) |
| 11" (27.94 cm) | 17.88" (45.42 cm) | 0.869" (2.21 cm) | 11.18" (28.41 cm) |
| 16" (40.64 cm) | 26" (66.04 cm) | 1.264" (3.21 cm) | 16.26" (41.31 cm) |

The curvature radius (R) required for best 3D effect is generally smaller than that for eye movement effect. This means that for a given frame body width (W) the glass must be more curved for achieving desirable 3D effect than that for the eye movement effect.

It was discovered that for a frame body width (W) of 10" (25.4 cm), the required curvature radius (R) for the pre-curved glass or backing plate is also 13" for achieving satisfactory 3D effect. Therefore, the required curvature radius (R) can be expressed as a function of the frame body width (W) as follow:

$$R=(13/10)\ W=1.3\ W\ \text{(for 3D effect)} \quad (5)$$

The equation (2) is also applicable here which, when combined with the equation (5), will yield the following equation.

$$CH=0.1\ W\ \text{(for 3D effect)} \quad (6)$$

The arc length (AL) is also related to the curvature radius (R) by the following equation.

$$AL=0.79\ R\ \text{(for 3D effect)} \quad (7)$$

The equations (5) to (7) will provide a guide for the determination of the critical dimensions (R, CH, AL) of the 3D frame for achieving satisfactory 3D effect. The following table lists such dimensions for three commonly used 3D landscape frames for achieving satisfactory 3D effect.

| Frame Body Width W | Curvature Radius R | Curve Height CH | Arc Length AL |
|---|---|---|---|
| 10" (25.4 cm) | 13" (33.02 cm) | 1.0" (2.54 cm) | 10.26" (26.06 cm) |
| 14" (35.56 cm) | 18.2" (46.23 cm) | 1.4" (3.56 cm) | 14.37" (36.5 cm) |
| 20" (50.8 cm) | 26" (66.04 cm) | 2.0" (5.08 cm) | 20.53" (52.15 cm) |

It should be pointed out that the equations (1) and (5) only provide a guideline for the design of 3D frames in achieving satisfactory eye movement effect and 3D effect. The exact choice of most suitable value of R must also be dependent on two other factors which are difficult to generalize.

The first factor of concern is the difference in perception of the eye movement effect and 3D effect by each individual viewer. It is possible that a picture mounted in a 3D frame may show a great eye movement effect or 3D effect to a first viewer, while fails to impress a second viewer under the same condition.

The second factor to be considered is the size of the critical image in the picture in relation to the width of the frame body (W). The critical image refers to the image in the picture to be viewed and judged for its eye movement effect or 3D effect.

For example, the picture in FIG. 39 is to be viewed for its eye movement effect. The critical image will be the lady's face. In the case of FIG. 45*b* which is to be viewed for its 3D effect. The critical image will be the image of the two persons in the picture.

Generally speaking, for a given 3D frame, the larger the critical image in relation to the width of the frame, the more pronounced the achieved eye movement effect or 3D effect will be. If a person's image in a picture is too small, it is suggested that the picture be cropped to yield a smaller picture. This smaller picture can then be mounted in a smaller 3D frame which will come with its own set of R and CH values, more suitable for bringing out the desired eye movement effect or 3D effect.

In view of the above-mentioned factors, the preferable curvature radius (R) for eye movement effect or 3D effect in most case would be within the 30 % range from the value indicated by the equation (1) or (5), respectively. It can be expressed mathematically by the following two equations.

| | | |
|---|---|---|
| 1.14 W < R < 2.11 W | (for eye movement effect) | (8) |
| 0.91 W < R < 1.69 W | (for 3D effect) | (9) |

It is also preferable that the curvature radius (R) be individually set within this 30% range to fit each viewer's own circumstance.

FIG. 51

Figure 51:
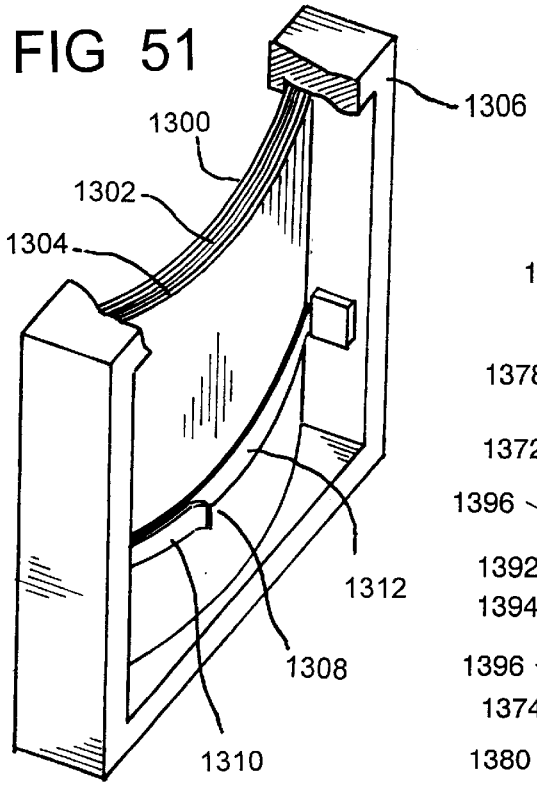
FIG. 51 is a perspective view, showing a fastening means for the 3D Frame of the present invention.

FIG. 51 discloses a novel fastening means for the 3D frame of the present invention. In this figure a stack of pre-curved glass 1300, picture sheet 1302, and pre-curved backing plate 1304 is shown placed in a 3D frame body 1306. Also shown in this figure is a strap 1308 which may include a pair of Velcro ribbons 1310 and 1312 with one ends of said ribbons secured to two opposing inside walls of the 3D frame body 1306.

It is important that the anchoring ends of each Velcro ribbon be positioned as close as possible to the edge of the backing plate 1304 along its straight side. This will ensure that the strap 1308 will tightly wrap around the curved backing plate 1304 from edge to edge to securely fasten the stack to the 3D frame body 1306.

Velcro is a trade name of a hook fastener commercially available from Velcro USA, Inc., Manchester, N.H., USA. There are two parts to each Velcro strap. The first part is the male part which consist of a layer of closely packed hook-like fiber. The second part is the female part which has a layer of closely packed loops. When the two parts are pressed together many hooks will enter the loops and thus lock the two parts together. The strap can be untied by simply pulling one part up and away from the other part. With enough length for overlap the two parts can overlap at any point thus allowing the tightness of the strap easily adjustable.

Obviously, with the present teaching many other types of straps can also be adopted. This may include a conventional two-ring buckle that allows a ribbon to be locked between the two rings. Snap-on type buckle is also an acceptable choice.

The unique advantage in the use of strap 1308 as opposed to any conventional clip-type stops for the present 3D frame system is that the soft ribbon in the strap will tightly wrap around the entire length of the curved backing plate from one straight side edge to the other. This will prevent the entire stack from popping loose or out of position during shipping or heavy handling.

Figure 52A:
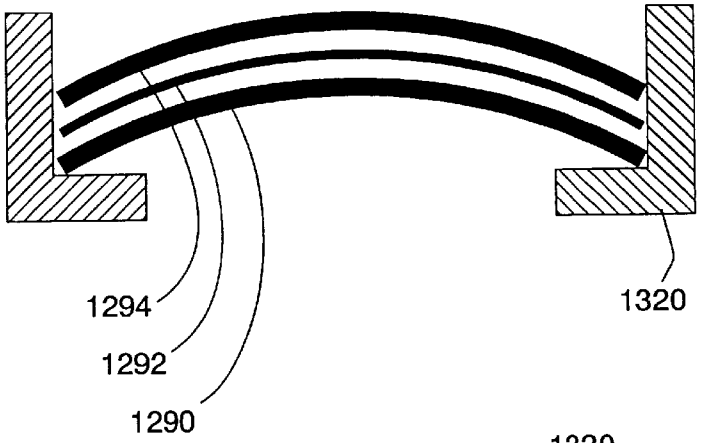
FIGS. 52*a* and 52*b* are schematic drawings showing a flexible pre-curved glass and the adjustment of its curvature radius (R).
Figure 52B:
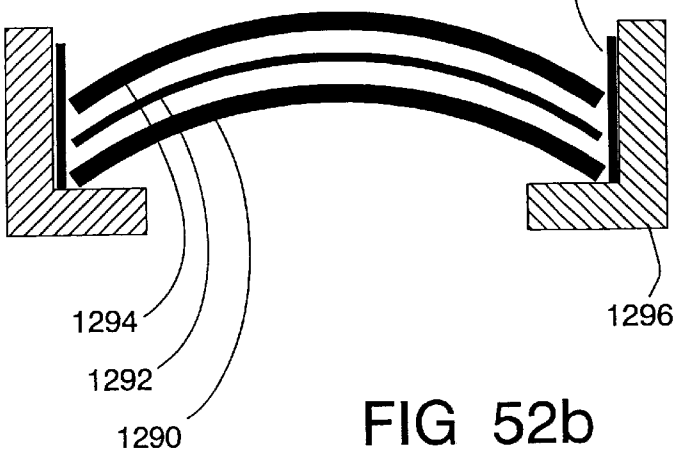

FIGS. 52*a* and 52*b*

The curved glass of the present invention is preferably made of Acrylic sheet which is available commercially in non-glare grade which would eliminate most glare in the present 3D frame system. At adequate thickness the Acrylic sheet can be heat treated to form a rigid curved glass for the present application. But for the sake of cost economy a thinner thickness at 0.060" (0.15 cm) or less is preferable. One other reason for this choice is that the formed Acrylic sheet is flexible which has some advantages as will be clear in the following discussion.

FIG. 52*a* shows the same curved glass 1290, picture sheet 1292, and backing plate 1294, rested on a 3D frame body 1320 whose width (W) is slightly wider than that of the 3D frame body 1296 of FIG. 50. It is assumed that the curved glass is made of Acrylic sheet of 0.060" (0.15 cm) thick or less and is flexible. The picture sheet 1292 is assumed to be flexible. The backing plate 1294 can also be flexible if it is made of Acrylic sheet or other plastic material such as high impact polystyrene (HIPS) of thickness of 0.060" or less.

Also installed, not shown in the figure, in the frame body 1320 is a strap wrapped around this stack of the curved glass 1290, picture 1292, and backing plate 1294, all of which are considered flexible. An downward force applied by the strap will collapse the stack and cause it to spread out to fill the entire width of the 3D frame body 1320. This is a convenient way to reduce the curvature of the curved glass 1290 and backing plate 1294. It also illustrates a new use of the present novel strap means for adjusting the curvature of the curved glass.

FIG. 52*b* again shows the same stack of the curved glass 1290, picture sheet 1292, and backing plate 1294, resting on the same 3D frame 1296 of FIG. 50. This figure also shows a cardboard strip 1310 inserted to each side of the stack. Since this stack is flexible as assumed before, it can be easily squeezed to reduce its width (W) and increase its curve height (CH). This is a convenient way to increase the eye movement effect or 3D effect on the displayed picture 1292. A strap is not shown, but also can be included to hold down the stack and fasten it to the 3D frame body 1296.

It should be noted that the above described method for adjusting the curvature of the curved glass 1290 and backing plate 1294 is recommended only for making small adjustment. Such adjustment by bending or depressing the curved glass will mainly change the curvature in the middle section and will cause the curved glass to be out of round. This will consequently distort the observed image in the picture. For making large change of the curvature a new curved glass and backing plate with different curvature radius (R) must be made.

In a rare occasion even a flat but flexible glass and backing plate can be bent to fit into a 3D frame body and fastened by a strap. Referring to FIG. 52*a* the pre-curved glass 1290 and pre-curved backing plate 1294 can be replaced by a normally flat but flexible glass and backing plate, both of which will be bent to fit into the 3D frame body 1320. This approach is useful but is not recommended in general because such glass and backing plate are very likely out of round and may produce unpleasant distorted image. However, for very large 3D frames with width exceeding several feet this approach may become acceptable as the image distortion problem using 0.060" Acrylic sheet becomes less severe while the normal approach of making pre-curved glasses is getting more expensive.

FIG. 53

FIG. 53 shows a fixture or preview frame 1340 which allows a picture to be viewed for its eye movement effect and/or 3D effect. It has a base plate 1342 shown with two grooves 1344 and 1346 with different curvatures. Two poles or threaded rods 1348 are mounted on the base plate 1342. Also shown in the figure is a top plate 1350 which has two holes for the poles to penetrate there through and for the top plate 1350 to slide along the poles 1348. Means such as nuts or clips, not shown, may also be included for holding the top plate 1350 at a desired height above the base plate. There are also two grooves 1352 and 1354 on the top plate which are mirror images of the two grooves 1344 and 1346, respectively, on the base plate.

The picture to be viewed can be sandwiched between a glass and a backing plate. The entire stack is inserted into one of the grooves on the base plate 1342. The top plate 1350 is then lowered to engage with the stack and firmly hold the stack between the top plate 1350 and the base plate 1342 for viewing.

It is interesting to note that the preview frame 1340 can also be used to hold a blank canvas adhered to a pre-cured backing plate. The mounted unit can be used for later painting work. Upon completion, the finished art can be transferred to a 3D frame for display.

A supporting sheet such as the paper sheet 1264 of FIG. 47 and mesh screen 1280 of FIG. 49 can also be similarly mounted between two pre-curved mat plate 1258 of FIG. 47. Double-sided adhesive can be applied to one or both pre-curved mat plates 1258 and bind the supporting sheet into a single unit. This unit is then mounted on the fixture 1340 for relief art work, dried flower arrangement, etc., that may require access to both sides of the supporting sheet. Upon completion, the finished art work, along with the two mat plates 1258, can be removed from the fixture 1340 and mounted in a 3D frame for display.

FIG. 54

FIG. 54 discloses another innovative improvement in the present 3D frame system. Because of the need of high rabbet depth there is no easy lighting condition that can make the entire display area equally visible. The most difficult area is near the top center of the picture which is often covered in the shadow of the top frame moulding.

FIG. 54 shows the back side of a 3D frame 1360 of the present invention with its backboard removed. Mounted on each of the two inside vertical walls of the 3D frame 1360 is a light fixture 1362 with a fluorescent lamp 1364. Also shown in the 3D frame 1360 is a pre-curved backing plate 1366 which is preferably made of white translucent material such as Acrylic sheet so that the light from the lamp 1364 will be diffused to cover the entire picture uniformly.

With the present lighting system the picture in the 3D frame 1360 will always be properly lighted regardless of the surrounding light condition. Furthermore, this unique 3D frame may even serves as a room light source under certain condition.

FIG. 55

Figure 55:
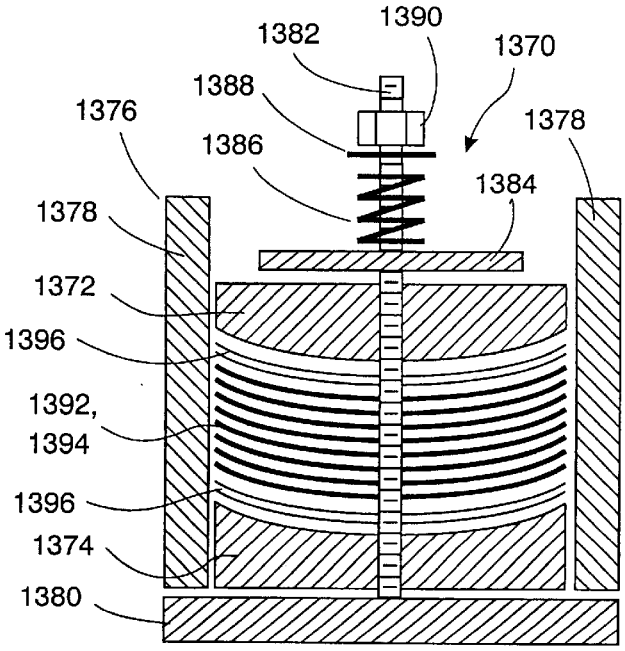
FIG. 55 shows the schematics of an improved heat forming unit for making the pre-curved glasses and backing plates of the present invention.

FIG. 55 discloses the schematics of an improved heat forming unit 1370 for making the curved glasses and curved backing plates of the present invention. In spite of its low cost of manufacturing it is capable of producing large number of curved sheets with good quality.

The central components of the present heat forming unit 1370 is a convex mold 1372 and a matching concave mold 1374. Both these molds are preferably machined from aluminum block for better heat conductivity. The width of these molds can be slightly less than the width of the 3D Frame (W) while the radius of the curved surface is designated by equation (1) or (5) depending on the type of the effect to be desired.

The convex mold 1372 and concave mold 1374 are shown placed in a holder 1376 which includes two side plates 1378 and a bottom plate 1380 firmly joined together. The distance between the two side plates is set to be the same as the 3D frame's inside width (W). For best heat conductivity, these plates are also preferably made of aluminum.

Also shown in the figure are two threaded rods one on each side of the molds 1372 and 1374. These rods are threaded into the two threaded holes on the bottom plate 1380. A top plate 1384 is also shown which has two clearance holes for inserting the threaded rods 1382 there through. A compression spring 1386, washer 1388, and a nut 1390 are engaged with each rods 1382 as shown in the figure.

Before loading, the convex mold is removed from the holder 1376. The compression spring 1386, washers 1388 and nuts 1390 are all temporally removed from the threaded rods 1382. At this time only the concave mold is placed in the holder 1376 and centrally positioned between the two threaded rods 1382.

The flat glass sheets 1392 and flat backing plates 1394 to be thermal formed must be cut to predetermined size for the 3D frame chosen. They are alternately loaded into the holder 1376 one sheet at a time. This will assure that each matching pair will have the same curvature and to avoid any miss match due to possible variation on the curvature from batch to batch.

It is important that upon loading, each sheet must be individually pressed down and bent to a curvature similar to that of the concave mold 1374. The sheet will stay curved once the pressing hand is lifted. This is important since it would be very difficult to bend a large stack of flat sheets at a later time due to the friction between adjacent sheets. The side of each loaded sheet must be in touch with both the side plates 1378 and the sheet beneath it. The presence of gap between two adjacent sheets at either side indicates that the liner length of the sheet must be trimmed before further proceeding. On the other hand, the sheet with inadequate linear length will not stay curved It is not unusual that after ten or more pairs are loaded, some small gap may exist in the middle section. This gap will be mostly eliminated later when pressure is applied. Several sheets of flexible steel 1396 are also optionally added to the top and bottom of the loaded pack. These sheets will provide a smooth surface in contact with the glass sheet and backing plate.

Once the sheet loading is completed, the convex mold 1372 can be placed on top of the stack. The top plate 1384, springs 1386, washers 1388 can now be slid down along the threaded rods 1382. The nuts 1390 are then applied and threaded down along the rods 1382. Further tightening the nuts will compress the compression springs 1386 and close down the gap existed in the middle section.

The completed unit can now be placed in an oven. For Acrylic sheets a temperature set at 200 degree Fahrenheit for 2 hours is adequate but shorter duration is still possible.

As the glass sheets 1392 and backing plate 1394 are heated they become soften and pressed down by the compression springs 1386. Any previously existed gap will now be closed off. Any stress existed in the glass sheets 1392 and backing plates 1394 will now be relieved. At this point, all the glass sheet 1392 and backing plates 1394 will conform to the curvature of the concave mold 1374.

After oven heating the heat forming unit 1370 is removed from the oven. Once cooled off the unit 1370 can be disassembled and the glass sheets 1392 and backing plates 1394 are now permanently curved and ready for use.

Although the preferred embodiments of the frame systems of the present invention have been described, it will be understood that within the purview of this invention various changes can be made in the form, details, proportion and arrangement of parts, the combination thereof and the construction thereof, which generally stated, consist in a frame system within the scope of the appended claims.

What is claimed is:

1. A picture frame for displaying a first sheet and a second sheet, comprising:

(A) a frame body having a frame window, (B) a pre-curved transparent plate, having a concave side and a convex side, removably mounted behind said frame window with said concave side facing said frame window, (C) mounting means (a) for urging said first sheet against said pre-curved transparent plate and conforming the curvature of said first sheet to that of said pre-curved transparent plate, and (b) for displaying said first sheet through said pre-curved transparent plate and said frame window, and (D) a second transparent plate removably mounted in said frame body, below and at a right angle with respect to said pre-curved transparent plate, for holding said second sheet below said second transparent plate and displaying said second sheet through said second transparent plate and said frame window.

2. The picture frame of claim 1 also comprising a third transparent plate removably mounted in said frame body and positioned above and at a right angle with respect to said pre-curved transparent plate.

3. A picture frame for displaying a photograph which is trimmed to yield a first sheet and a second sheet, comprising:

(A) a frame body having a frame window, (B) a pre-curved transparent plate, having a concave side and a convex side, removably mounted behind said frame window with said concave side facing said frame window, (C) mounting means (a) for urging said first sheet against said pre-curved transparent plate and conforming the curvature of said first sheet to that of said pre-curved transparent plate, and (b) for displaying said first sheet through said pre-curved transparent plate and said frame window, and (D) a second transparent plate removably mounted in said frame body, below and at a right angle with respect to said pre-curved transparent plate, for holding said second sheet below said second transparent plate and displaying said second sheet through said second transparent plate and said frame window, whereby a wrap-around effect is achieved for said first sheet.

4. A picture frame for displaying a picture, comprising:

(A) a frame body having a frame window, (B) a pre-curved transparent plate, having a concave side and a convex side, removably mounted behind said frame window with said concave side facing said frame window, (C) a first mat sheet with a mat opening, (D) mounting means (a) for urging said first mat sheet and said picture against said pre-curved transparent plate, (b) for conforming the curvatures of said picture and said first mat sheet to that of said pre-curved transparent plate, and (c) for displaying said picture through said mat opening and said frame window, and (E) a second mat sheet removably mounted in said frame body, below and at a right angle with respect to said first mat sheet.

5. The picture frame of claim 4 also comprising a third mat sheet removably mounted in said frame body, above and at a right angle with respect to said first mat sheet.

6. A picture frame for displaying a picture, comprising:

(A) a frame body having a frame window, (B) a concavo-convex shaped transparent plate having an all-concave side and an all-convex side, removably mounted in said frame body, with said all-concave side facing said frame window, and (C) mounting means (a) for mounting said picture behind said transparent plate, and (b) for urging said picture against said transparent plate and conforming the curvature of said picture to that of said transparent plate for adding a three dimensional effect and an eye movement effect to an entire image of said picture.

7. The picture frame of claim 6 in which said mounting means includes a concavo-convex shaped backing plate for urging said picture against said transparent plate.

8. The picture frame of claim 6 in which said mounting means includes a door.

9. The picture frame of claim 6 in which said transparent plate has a width (W) and a curvature radius (R), said width (W) being related to said radius (R) by the following equation for achieving satisfactory three-dimensional effect:

$$0.91\ W<R<1.69\ W.$$

10. The picture frame of claim 6 in which said transparent plate has a width (W) and a curvature radius (R), said width (W) being related to said radius (R) by the following equation for achieving satisfactory eye movement effect:

$$1.14\ W<R<2.11\ W.$$

11. The picture frame of claim 6 also comprising holding means for holding a three-dimensional article between said frame window and said transparent plate, and for displaying said three-dimensional article through said frame window.

12. The picture frame of claim 11 in which said holding means includes a magnetic element.

* * * * *